US007378882B2

(12) United States Patent
Kimura

(10) Patent No.: US 7,378,882 B2
(45) Date of Patent: May 27, 2008

(54) SEMICONDUCTOR DEVICE INCLUDING A PIXEL HAVING CURRENT-DRIVEN LIGHT EMITTING ELEMENT

(75) Inventor: Hajime Kimura, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 564 days.

(21) Appl. No.: 10/827,624

(22) Filed: Apr. 20, 2004

(65) Prior Publication Data

US 2005/0162206 A1 Jul. 28, 2005

(30) Foreign Application Priority Data

Apr. 25, 2003 (JP) ..... 2003-123000

(51) Int. Cl.
*H03B 1/00* (2006.01)

(52) U.S. Cl. ..... 327/108

(58) Field of Classification Search ..... 327/108, 327/109, 110

See application file for complete search history.

(56) References Cited

U.S. PATENT DOCUMENTS

| | | | | |
|---|---|---|---|---|
| 4,742,292 | A | 5/1988 | Hoffman | |
| 5,905,677 | A * | 5/1999 | Casagrande et al. | 365/185.23 |
| 6,087,821 | A | 7/2000 | Kojima | |
| 6,222,357 | B1 | 4/2001 | Sakuragi | |
| 6,229,506 | B1 | 5/2001 | Dawson et al. | |
| 6,373,454 | B1 | 4/2002 | Knapp et al. | |
| 6,437,550 | B2 | 8/2002 | Andoh et al. | |
| 6,600,305 | B2 | 7/2003 | Andoh et al. | |
| 6,661,180 | B2 | 12/2003 | Koyama | |
| 6,693,388 | B2 | 2/2004 | Oomura | |
| 6,873,200 | B2 * | 3/2005 | Evers et al. | 327/365 |
| 2001/0020844 | A1 | 9/2001 | Andoh et al. | |
| 2002/0135312 | A1 | 9/2002 | Koyama | |
| 2002/0153844 | A1 | 10/2002 | Koyama | |
| 2002/0175664 | A1 | 11/2002 | Andoh et al. | |

(Continued)

FOREIGN PATENT DOCUMENTS

EP 0 282 725 9/1988

(Continued)

OTHER PUBLICATIONS

International Search Report (Application No. PCT/JP2004/005001), Aug. 10, 2004, 3 pages.

(Continued)

*Primary Examiner*—Jeffrey Zweizig
(74) *Attorney, Agent, or Firm*—Fish & Richardson P.C.

(57) ABSTRACT

The invention provides a semiconductor device having a transistor that can supply a proper current to a load (EL pixel and signal line) without being influenced by variations. A voltage of each terminal of a transistor is controlled by a feedback circuit using an amplifier circuit. A current Idata is inputted from a current source circuit to the transistor, and the feedback circuit sets a gate-source voltage that the transistor requires for supplying the current Idata. The feedback circuit controls the transistor to operate in a saturation region. Then, a gate voltage required for supplying the current Idata is set. When using the transistor set in this manner, a proper current can be supplied to a load (EL pixel and signal line). Note that a required gate voltage can be set quickly because of an amplifier circuit.

54 Claims, 39 Drawing Sheets

U.S. PATENT DOCUMENTS

| | | | |
|---|---|---|---|
| 2003/0020413 | A1 | 1/2003 | Oomura |
| 2003/0128199 | A1 | 7/2003 | Kimura |
| 2003/0128200 | A1 | 7/2003 | Yumoto |
| 2003/0156102 | A1 | 8/2003 | Kimura |
| 2003/0169250 | A1 | 9/2003 | Kimura |
| 2003/0205993 | A1 | 11/2003 | Andoh et al. |
| 2004/0085029 | A1 | 5/2004 | Kimura |
| 2004/0085270 | A1 | 5/2004 | Kimura |
| 2004/0100202 | A1 | 5/2004 | Koyama |

FOREIGN PATENT DOCUMENTS

| | | |
|---|---|---|
| EP | 1 103 946 | 5/2001 |
| EP | 1 130 565 | 9/2001 |
| EP | 1 333 422 | 8/2003 |
| JP | 63-229509 | 9/1988 |
| JP | 11-149783 | 6/1999 |
| JP | 2000-081920 | 3/2000 |
| JP | 2000-112548 | 4/2000 |
| JP | 2001-005426 | 1/2001 |
| JP | 2001-284464 | 10/2001 |
| JP | 2001-343933 | 12/2001 |
| JP | 2002-514320 | 5/2002 |
| JP | 2002-517806 | 6/2002 |
| JP | 2002-351357 | 12/2002 |
| JP | 2003-43993 | 2/2003 |
| JP | 2003-043993 | 2/2003 |
| JP | 2003-058106 | 2/2003 |
| JP | 2003-108069 | 4/2003 |
| WO | WO98-48403 | 10/1998 |
| WO | WO99-65011 | 12/1999 |
| WO | WO01-06484 | 1/2001 |
| WO | WO 01/06484 | 1/2001 |
| WO | WO 02/39420 | 5/2002 |
| WO | WO 03/038793 | 5/2003 |
| WO | WO 03/038794 | 5/2003 |
| WO | WO 03/038795 | 5/2003 |
| WO | WO 03/038796 | 5/2003 |
| WO | WO 03/038797 | 5/2003 |

OTHER PUBLICATIONS

Written Opinion (Application No. PCT/JP2004/005001), Aug. 10, 2004, 5 pages with partial translation.
International Search Report (Application No. PCT/JP2004/005969), Aug. 31, 2004, 2 pages.
Written Opinion (Application No. PCT/JP2004/005969), Aug. 31, 2004, 5 pages with partial translation.
International Search Report (Application No. PCT/JP2004/007367), Aug. 31, 2004, 2 pages.
Written Opinion (Application No. PCT/JP2004/007367), Aug. 31, 2004, 4 pages with partial translation.

* cited by examiner (A) SIGNAL INPUTTING PERIOD (B) COMPLETION OF SIGANL INPUTTING PERIOD (C) LIGHT EMITTING PERIOD (D)

(E)

SEMICONDUCTOR DEVICE INCLUDING A PIXEL HAVING CURRENT-DRIVEN LIGHT EMITTING ELEMENT

TECHNICAL FIELD

The present invention relates to a semiconductor device having a function to control current supply to a load by a transistor. More particularly, the invention relates to a semiconductor device that includes a pixel having a current-driven light emitting element whose luminance changes depending on current, and a signal line driver circuit for driving the pixel.

BACKGROUND ART

In recent years, a so-called self-luminous type display device that includes a pixel formed of a light emitting element such as a light emitting diode (LED) attracts attention. As a light emitting element used for such a self-luminous type display device, an organic light emitting diode (OLED), an organic EL element, or an electro luminescence (EL) element attracts attention and has been used for an organic EL display and the like.

Since a light emitting element such as an OLED is self-luminous type, it has the advantages of a higher visibility of a pixel than a liquid crystal display, a fast response without a need of backlight, and the like. Further, the luminance of a light emitting element can be controlled by current.

As a driving method of a display device using such a self-luminous type light emitting element, a passive matrix method and an active matrix method are known. The former has problems such as difficulty in realizing a large and high luminance display, though its simple structure. Therefore, in recent years, the active matrix method has been actively developed, in which a current flowing to a light emitting element is controlled by a thin film transistor (TFT) provided in a pixel circuit.

In the case of a display device adopting such an active matrix method, there are problems in that a current flowing to a light emitting element changes due to variations in current characteristics of driving TFTs and variations in luminance are caused.

That is, in the case of a display device adopting the active matrix method, driving TFTs for driving a current flowing to light emitting elements are used in a pixel circuit, and there are problems in that a current flowing to the light emitting elements changes due to variations in characteristics of these driving TFTs and variations in luminance are caused. Thus, suggested are various circuits for suppressing variations in luminance, in which a current flowing to light emitting elements does not change even when characteristics of driving TFTs in a pixel circuit vary.

(Patent Document 1)

Published Japanese Translation of PCT International Publication for Patent Application No. 2002-517806

(Patent Document 2)

International Publication WO 01/06484

(Patent Document 3)

Published Japanese Translation of PCT International Publication for Patent Application No. 2002-514320

(Patent Document 4)

International Publication WO 02/39420

A configuration of an active matrix display device is disclosed in Patent Documents 1 to 4. Disclosed in Patent Documents 1 to 3 is a circuit configuration in which a current flowing to light emitting elements does not change due to variations in characteristics of driving TFTs disposed in a pixel circuit. This configuration is called a current writing pixel or a current input pixel. Meanwhile, disclosed in Patent Document 4 is a circuit configuration for suppressing changes in signal current due to variations in TFTs in a source driver circuit.

FIG. 6 shows a first configuration example of an existing active matrix display device disclosed in Patent Document 1. A pixel shown in FIG. 6 comprises a source signal line 601, first to third gate signal lines 602 to 604, a current supply line 605, TFTs 606 to 609, a storage capacitor 610, an EL element 611, and an image signal inputting current source 612.

A gate electrode of the TFT 606 is connected to the first gate signal line 602, a first electrode thereof being connected to the source signal line 601 and a second electrode thereof being connected to a first electrode of the TFT 607, a first electrode of the TFT 608 and a first electrode of the TFF 609. A gate electrode of the TFT 607 is connected to the second gate signal line 603, a second electrode thereof being connected to a gate electrode of the TFT 608. A second electrode of the TFT 608 is connected to the current supply line 605. A gate electrode of the TFT 609 is connected to the third gate signal line 604, a second electrode thereof being connected to an anode of the EL element 611. The storage capacitor 610 is connected between the gate electrode of the TFT 608 and the current supply line, and holds a gate-source voltage of the TFT 608. The current supply line 605 and a cathode of the EL element 611 are inputted with respective predetermined potentials and have a potential difference therebetween.

Operations from writing of a signal current to light emission are described with reference to FIG. 7. Each component in the drawings is denoted by the same reference numeral as FIG. 6. FIGS. 7A to 7C are schematic diagrams each showing a current flow. FIG. 7D shows a relationship between currents flowing in each path in writing a signal current. FIG. 7E shows a voltage that is held in the storage capacitor 610 in writing a signal current also, namely the gate-source voltage of the TFT 608.

First, a pulse is inputted to the first gate signal line 602 and the second gate signal line 603, and the TFTs 606 and 607 are turned on. A current flowing in the source signal line at this time, namely a signal current is referred to as Idata.

Since the current Idata flows in the source signal line, a current flows in a pixel through current paths I1 and 12 as shown in FIG. 7A. The relationship between the divided currents is shown in FIG. 7D. It is needless to say that Idata=I1+I2 is satisfied.

At the moment when the TFT 606 is turned on, electric charges are not held in the storage capacitor 610 yet, thus the TFT 608 is off. Accordingly, I2 is equal to 0 whereas Idata is equal to I1. That is, during this period, current flows only in accordance with electric charges accumulated in the storage capacitor 610.

Then, electric charges are slowly accumulated in the storage capacitor 610, and thereby a potential difference begins to occur between both electrodes (FIG. 7E). When a potential difference between both electrodes being equal to Vth (FIG. 7E, point A), the TFT 608 is turned on and I2 is generated. Since Idata=I1+I2 is satisfied as described above, I1 gradually decreases, though current flows yet and electric charges are accumulated in the storage capacitor.

In the storage capacitor 610, electric charges continue to be accumulated until a potential difference between both electrodes thereof, that is, the gate-source voltage of the TFT 608 becomes equal to a desired voltage, namely a voltage (VGS) that allows the TFT 608 to supply the current Idata. When the accumulation of electric charges is completed (FIG. 7E, point B), the current I1 stops flowing, the TFT 608 supplies a current corresponding to the VGS at this time, and thereby Idata becomes equal to I2 (FIG. 7B). Thus, the steady state is reached. That is the end of the writing operation of signals. Finally, the selection of the first gate signal line 602 and the second gate signal line 603 is completed and the TFTs 606 and 607 are turned off.

Subsequently, a light emitting operation starts. A pulse is inputted to the third gate signal line 604 and the TFT 609 is turned on. Since the storage capacitor 610 holds the VGS that has been written earlier, the TFT 608 is on and the current Idata is supplied from the current supply line 605. Accordingly, the EL element 611 emits light. When the TFT 608 is set to operate in a saturation region at this time, the current Idata can flow without changes even when a source-drain of the TFT 608 voltage varies.

Such an operation that outputs a set current is called an output operation herein. The current writing pixel shown above as an example has the advantages that even when there are variations in characteristics of the TFT 608 and the like, the storage capacitor 610 holds a gate-source voltage required for flowing the current Idata, a desired current can be supplied to the EL element with accuracy, and thereby variations in luminance due to variations in characteristics of TFTs can be suppressed.

Described above is an example for correcting changes in current due to variations of driving TFTs in a pixel circuit. The same problem occurs in a source driver circuit. Disclosed in Patent Document 4 is a circuit configuration for preventing changes in signal current due to production variations of TFTs in a source driver circuit.

DISCLOSURE OF THE INVENTION (Problems to be Solved by the Invention)

As set forth above, according to the conventional technologies, a circuit is configured so that a signal current and a current for driving a TFT, or a signal current and a current flowing to a light emitting element in light emission may be equal or proportional to each other.

However, parasitic capacitance of wiring used for supplying a signal current to a driving TFT and a light emitting element is considerably large. Therefore, there are problems in that in the case of a signal current being small, the time constant for charging parasitic capacitance of wiring is increased, and thereby signal writing speed becomes slower. That is, the problem is that it takes a long time to develop at a gate terminal a voltage required for flowing a signal current supplied to a transistor, and signal writing speed becomes slower.

In view of the foregoing, it is an object of the invention to provide a semiconductor device that can reduce the influences of variations in characteristics of transistors, and improve sufficiently signal writing speed even in the case of a signal current being small.

(Means for Solving the Problems)

In order to achieve the aforementioned object, according to the invention, a potential of a transistor that supplies a current to a load is controlled by an amplifier circuit, and a potential of a gate of the transistor is stabilized by a feedback circuit.

The invention is characterized by having a circuit in which a current supplied to a load is controlled by a transistor whose source or drain is connected to a current source circuit, and an amplifier circuit for controlling at least one potential selected from a source potential, a drain potential and a gate potential of the transistor.

The invention is characterized by having a circuit in which a current supplied to a load is controlled by a transistor whose source or drain is connected to a current source circuit, and an amplifier circuit for controlling the transistor to operate in a saturation region when a current is supplied from the current source circuit thereto.

The invention is characterized by having a circuit in which a current supplied to a load is controlled by a transistor whose source or drain is connected to a current source circuit, and an amplifier circuit for stabilizing a potential between the drain and a gate of the transistor.

The invention is characterized by having a circuit in which a current supplied to a load is controlled by a transistor whose source or drain is connected to a current source circuit, and a feedback circuit for stabilizing a potential between the drain and a gate of the transistor.

The invention is characterized by having a transistor that controls a current supplied to a load and an operational amplifier, wherein a non-inverting input terminal of the operational amplifier is connected to a drain terminal of the transistor connected to a current source circuit, an inverting input terminal of the operational amplifier is connected to a gate terminal of the transistor, and an output terminal of the operational amplifier is connected to the gate terminal and the inverting input terminal.

The invention provides a semiconductor device characterized by having a transistor that controls a current supplied to a load and a voltage follower circuit, wherein an input terminal of the voltage follower circuit is connected to a drain terminal of the transistor connected to a current source circuit, and an output terminal of the voltage follower circuit is connected to a gate terminal of the transistor. In this configuration of the invention, the voltage follower circuit may be constituted by a source follower circuit.

In the invention, the type of applicable transistor is not especially limited, and a thin film transistor (TFT) using a non-single crystalline semiconductor film typified by amorphous silicon and polycrystalline silicon, a MOS transistor formed by using a semiconductor substrate or an SOI substrate, a junction transistor, a transistor using an organic semiconductor or a carbon nanotube, and other transistors may be employed. In addition, the type of substrate on which the transistor is disposed is not especially limited, and the transistor may be formed on a single crystalline substrate, an SOI substrate, a glass substrate, or the like.

Note that in the invention, connection means electrical connection. Accordingly, other element, switch and the like may be disposed therebetween.

(Effect of the Invention)

According to the invention, a feedback circuit is constituted by an amplifier circuit in order to control a transistor. As a result, the transistor can output a constant current without being influenced by variations. Such a setting operation can be carried out quickly since the amplifier circuit is used. Thus, a current can be outputted with accuracy in an output operation.

BEST MODE FOR CARRYING OUT THE INVENTION

Embodiment modes of the invention will be described hereinafter with reference to the accompanying drawings. However, it is to be understood that various changes and modifications will be apparent to those skilled in the art. Therefore, unless such changes and modifications depart from the scope of the invention, they should be constructed as being included therein.

Embodiment Mode 1

The invention can be applied to various analog circuits having a current source as well as a pixel having a light emitting element such as an EL element. Thus, in this embodiment mode, the principle of the invention is described.

Figure 1:
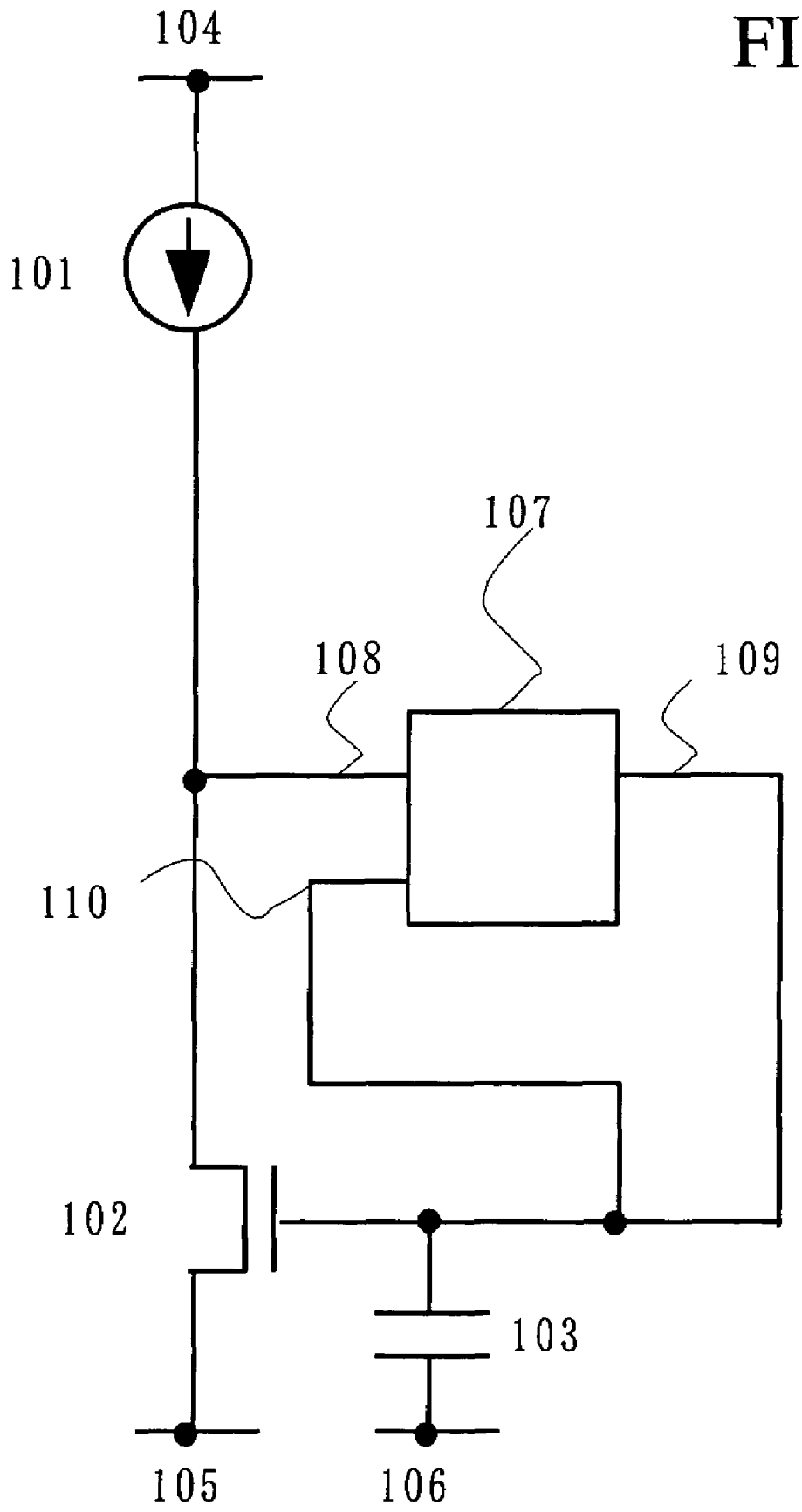
FIG. 1 is a diagram showing a configuration of the semiconductor device of the invention.

FIG. 1 shows a configuration based on the basic principle of the invention. A current source circuit 101 and a current source transistor 102 are connected between a wiring 104 and a wiring 105. FIG. 1 shows the case in which a current flows from the current source circuit 101 to the current source transistor 102. A first input terminal 108 of an amplifier circuit 107 is connected to a drain terminal of the current source transistor 102. A second input terminal 110 of the amplifier circuit 107 is connected to a gate terminal of the current source transistor 102. An output terminal 109 of the amplifier circuit 107 is connected to the gate terminal of the current source transistor 102.

A capacitor element 103 is connected to the gate terminal of the current source transistor 102 and a wiring 106 in order to hold a gate voltage of the current source transistor 102. It is to be noted that the storage capacitor element 103 can be omitted when a gate capacitor of the current source transistor 102 or the like is used instead.

In such a configuration, a current Idata is supplied and inputted from the current source circuit 101 and it flows to the current source transistor 102. The amplifier circuit 107 controls so that the current Idata supplied from the current source circuit 101 may flow to the current source transistor 102 and the steady state may be reached during a period in which the current source transistor 102 operates in a saturation region. Thus, a gate potential of the current source transistor 102 is set to a value required for flowing the current Idata. At this time, the gate potential of the current source transistor 102 is set to a proper value independently of current characteristics (mobility, threshold voltage and the like) and size (gate width W and gate length L) of the current source transistor 102. Therefore, even there are variations in current characteristics and size of the current source transistor 102, the current source transistor 102 can supply the current Idata. As a result, the current source transistor 102 can operate as a current source without being influenced by variations in current characteristics and size, and supply a current to various loads (another current source transistor, a pixel, a signal line driver circuit, and the like).

Since the output impedance of the amplifier circuit 107 is not high, a large current can be outputted from the output terminal 109. Thus, the gate terminal of the current source transistor 102 can be charged quickly. That is, writing of the current Idata can be carried out faster to be completed quickly, and thereby it takes a short time to reach the steady state.

An operation of the amplifier circuit 107 is described next. The amplifier circuit 107 has a function to detect voltages of the first input terminal 108 and the second input terminal 110, and amplify the difference between these input voltages to output to the output terminal 109. In FIG. 1, the second input terminal 110 and the output terminal 109 are connected to each other, namely they constitute a feedback circuit. Because of the feedback circuit, the voltage of the second input terminal 110 changes depending on the voltage of the output terminal 109, and the voltage of the output terminal 109 changes also depending on the voltage of the second input terminal 110. Through such a feedback operation, a voltage to stabilize the state of each input terminal can be outputted from the output terminal 109.

In FIG. 1, the drain terminal of the current source transistor 102 is connected to the first input terminal 108, the gate terminal thereof being connected to the second input terminal 110 and the output terminal 109. Accordingly, a voltage to stabilize the voltages of the drain terminal and the gate terminal of the current source transistor 102 is outputted to the gate terminal of the current source transistor 102 by the amplifier circuit 107. At this time, the current Idata is supplied from the current source circuit 101 to the current source transistor 102. As a result, a voltage that allows the current source transistor 102 to supply the current Idata is outputted from the current source circuit 101 to the gate terminal of the current source transistor 102.

In general, an operating region of a transistor (an NMOS transistor taken as an example herein for simplicity) can be divided into a linear region and a saturation region. The boundary between these regions is, when a drain-source voltage is Vds, a gate-source voltage is Vgs and a threshold voltage is Vth, a point at which (Vgs−Vth)=Vds is satisfied. In the case of (Vgs−Vth)>Vds being satisfied, a transistor operates in a linear region and a current value is determined by the Vds and Vgs. On the other hand, in the case of (Vgs−Vth)<Vds being satisfied, a transistor operates in a saturation region and a current value does not change so much even when the Vds varies. That is, the current value is determined only by the Vgs.

As is evident from the foregoing, the amplifier circuit 107 controls the current source transistor 102 to operate in a saturation region. According to this, the gate potential of the current source transistor 102 is set to a voltage required for supplying the current Idata. In order that the current source transistor 102 operates in a saturation region, (Vgs−Vth) <Vds has to be satisfied. The threshold voltage Vth of an N-channel transistor is generally more than 0, therefore, the potential of the drain terminal of the current source transistor 102 has to be at least equal to or more than the potential of the gate terminal. The amplifier circuit 107 controls the current source transistor 102 so as to achieve such an operation.

As set forth above, the feedback circuit including the amplifier circuit 107 allows the gate potential of the current source transistor 102 to be set so as to flow a current as large as that supplied from the current source circuit 101. The setting operation can be completed quickly because the amplifier circuit 107 is used, and thereby writing is completed in a short time. The current source transistor 102 set in this manner can operate as a current source circuit and supply a current to various loads.

Figure 2:
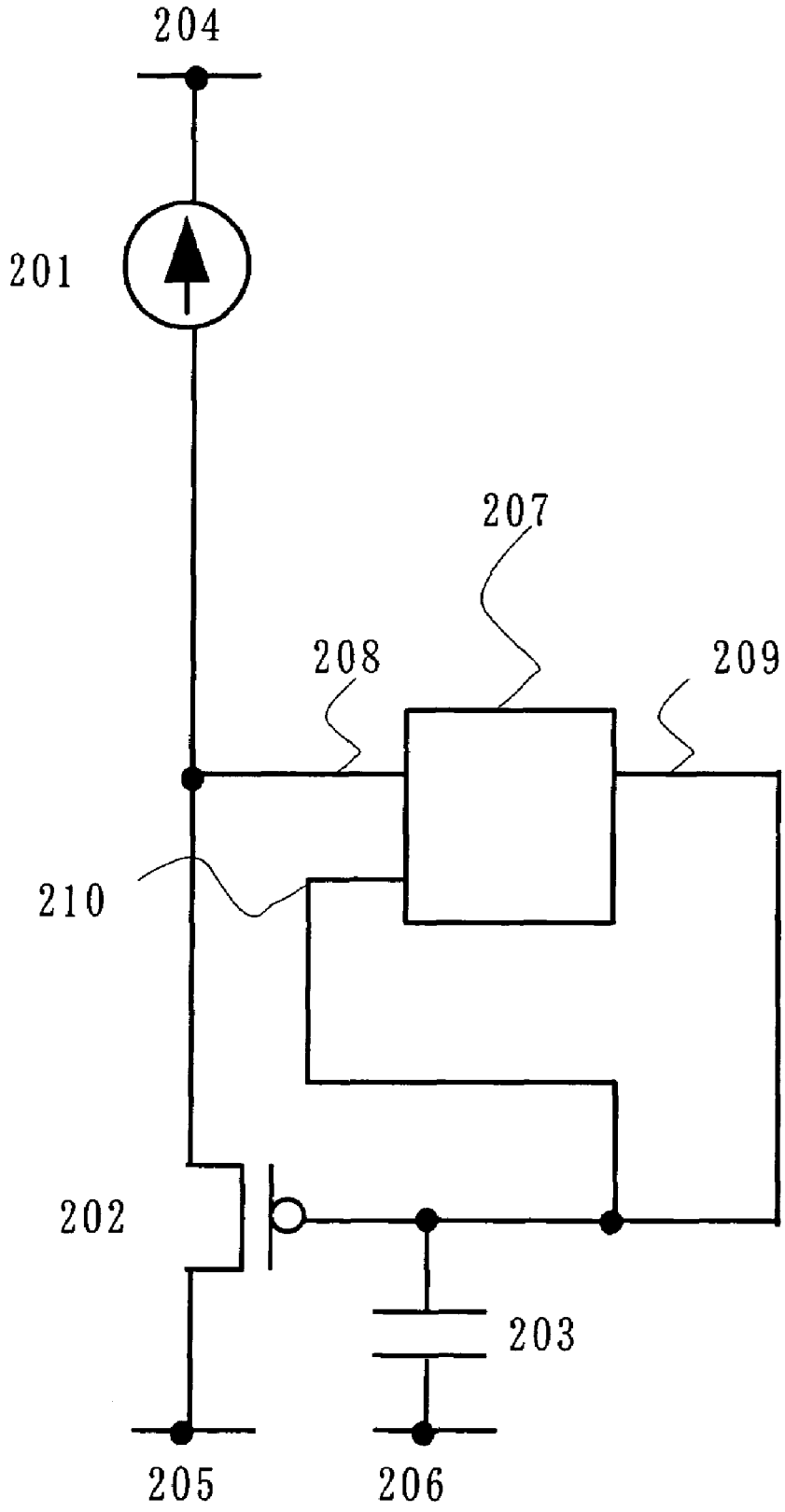
FIG. 2 is a diagram showing a configuration of the semiconductor device of the invention.

Although FIG. 1 shows the case in which a current flows from the current source circuit 101 to the current source transistor 102, the invention is not limited to this. FIG. 2 shows the case in which a current flows from a current source transistor 202 to a current source circuit 201. As shown in the drawings, when the polarity of the current source transistor 202 is changed, the direction of current can be changed without modifying the connection of the circuit.

Figure 3:
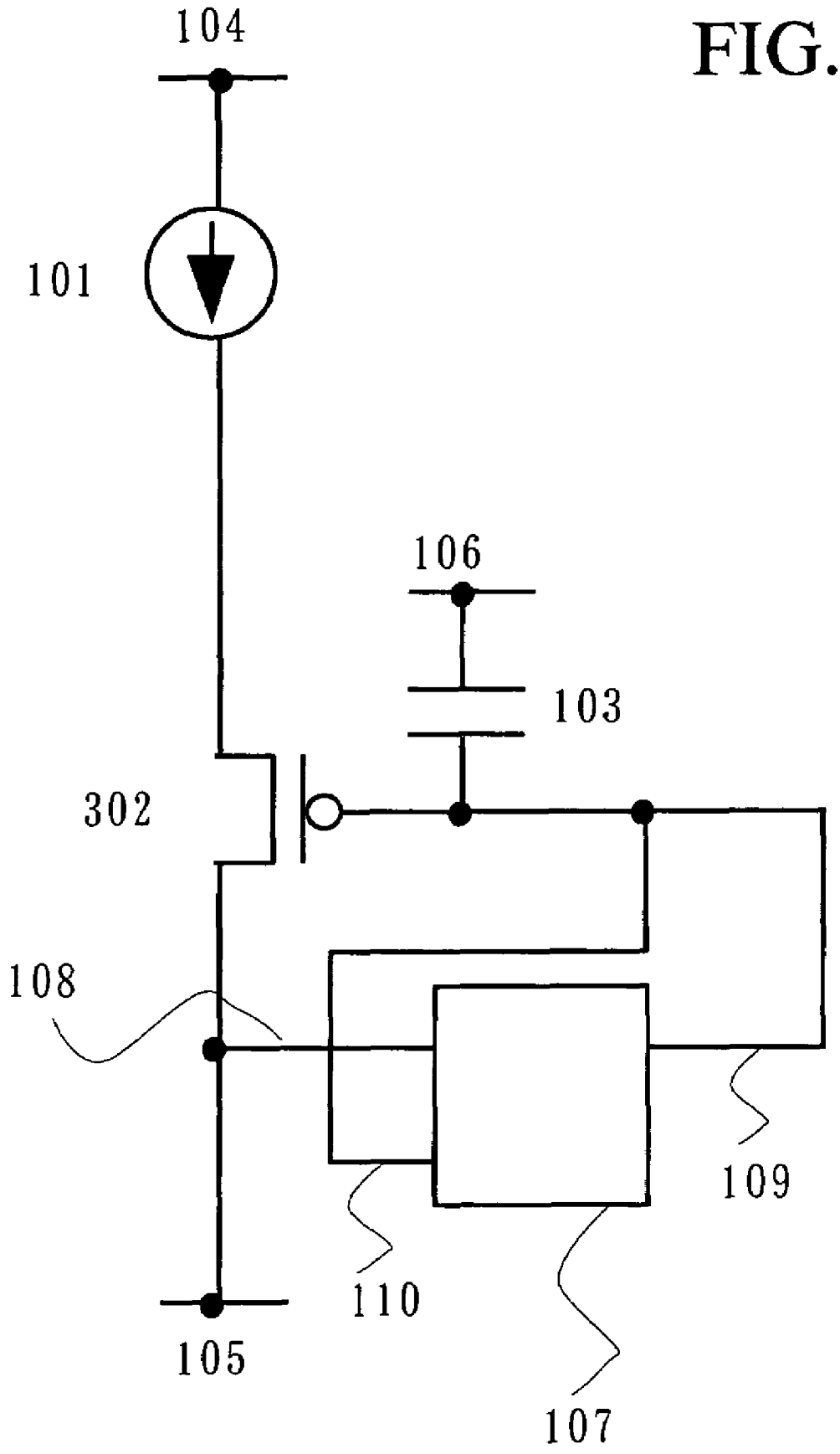
FIG. 3 is a diagram showing a configuration of the semiconductor device of the invention.

Although an N-channel transistor is used for the current source circuit 101, the invention is not limited to this, and a P-channel transistor may be used as well. However, when the polarity of the transistor is changed without modifying the direction of current, a source terminal and a drain terminal are changed over. Therefore, the connection of the circuit has to be changed. A configuration in that case is shown in FIG. 3. The current source circuit 101 and a current source transistor 302 are connected between the wiring 104 and the wiring 105. FIG. 3 shows the case in which a current flows from the current source circuit 101 to the current source transistor 302, though the direction of current can be changed as the case shown in FIG. 2. The first input terminal 108 of the amplifier circuit 107 is connected to a drain terminal of the current source transistor 302. The second input terminal 110 of the amplifier circuit 107 is connected to a gate terminal of the current source transistor 302. The output terminal 109 of the amplifier circuit 107 is connected to the gate terminal of the current source transistor 302.

Accordingly, a voltage to stabilize the voltages of the drain terminal and the gate terminal of the current source transistor 302 is outputted to the gate terminal of the current source transistor 302 by the amplifier circuit 107. At this time, the current Idata is supplied from the current source circuit 101 to the current source transistor 302. As a result, a voltage that allows the current source transistor 302 to supply the current Idata is outputted from the current source circuit 101 to the gate terminal of the current source transistor 302.

It is to be noted that in FIG. 1, the capacitor element 103 is only required to hold the gate potential of the current source transistor 102, thus a potential of the wiring 106 may be set arbitrarily. Therefore, potentials of the wiring 105 and the wiring 106 may be equal or different. However, a current value of the current source transistor 102 is determined by the gate-source voltage thereof. Accordingly, the capacitor element 103 preferably holds the gate-source voltage of the current source transistor 102, and the wiring 106 is thus preferably connected to the source terminal of the current source transistor 102 (wiring 105). As a result, influences of wiring resistance and the like can be suppressed.

Similarly in FIG. 2, it is desirable that a wiring 206 is connected to a source terminal of the current source transistor 202 (wiring 205). Furthermore, in FIG. 3, the wiring 106 is preferably connected to a source terminal of the current source transistor 302.

Note that any type of load can be employed. It may be an element such as a resistor, a transistor, an EL element, other light emitting elements, a current source circuit including a transistor, a capacitor, a switch and the like, and a wiring connected to a certain circuit. In addition, a signal line may be used as well as a signal line and a pixel connected thereto. The pixel may comprise any display element such as an EL element and an element used for an FED.

Embodiment Mode 2

Shown in Embodiment Mode 2 is an example of the amplifier circuit used in FIGS. 1 to 3.

Figure 4:
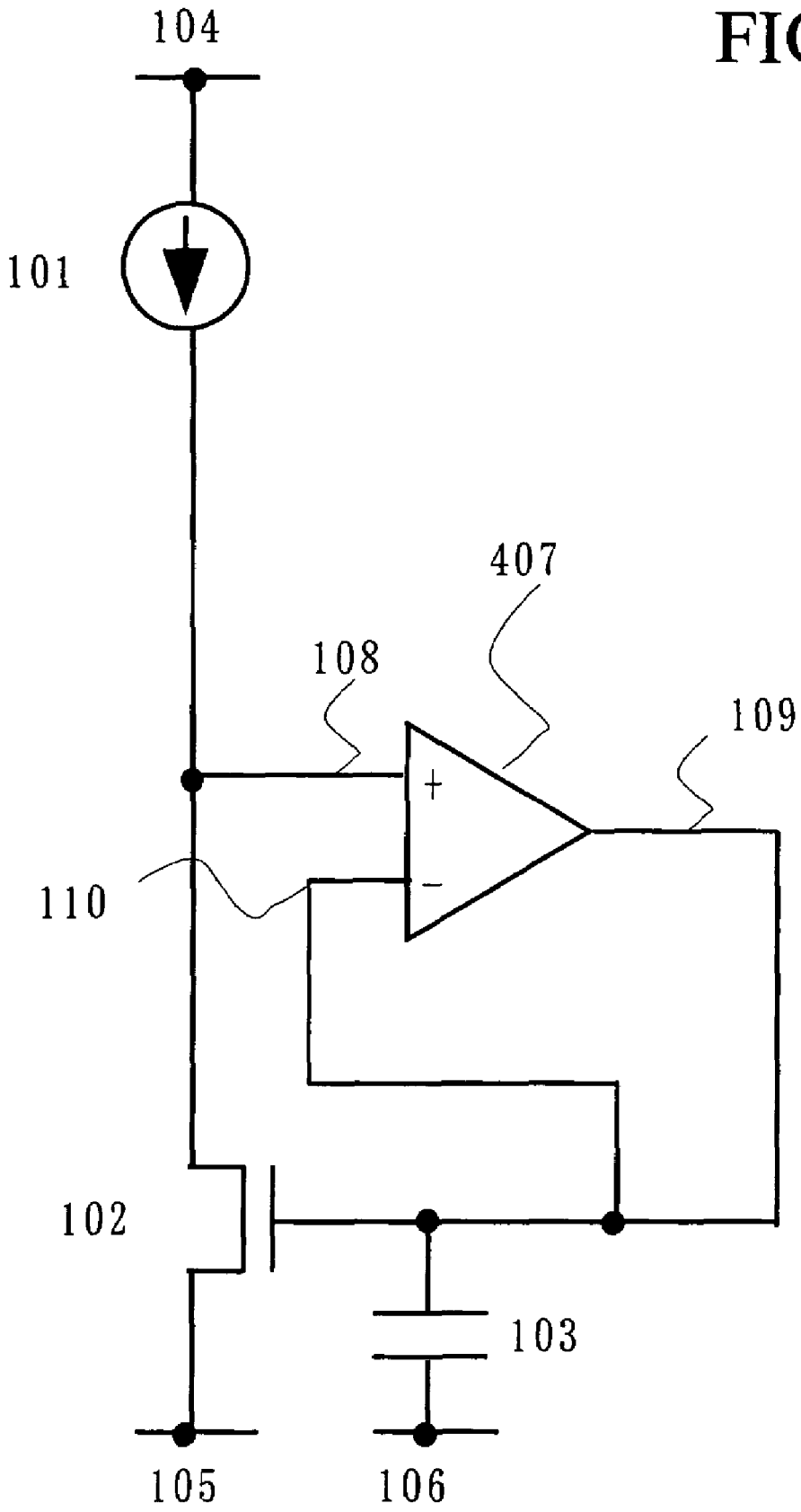
FIG. 4 is a diagram showing a configuration of the semiconductor device of the invention.

First, an operational amplifier is taken as an example of the amplifier circuit. FIG. 4 is a configuration diagram corresponding to FIG. 1, which shows the case of adopting an operational amplifier as an amplifier circuit. The first input terminal 108 of the amplifier circuit 107 corresponds to a non-inverting (positive phase) input terminal of an operational amplifier 407 whereas the second input terminal 110 corresponds to an inverting input terminal.

The operational amplifier normally operates so that a potential of a non-inverting (positive phase) input terminal may be equal to a potential of an inverting input terminal. Accordingly, in FIG. 4, the gate potential of the current source transistor 102 is controlled to be equal to the drain potential of the current source transistor 102. Thus, Vgs=Vds is satisfied, and thereby the current source transistor 102 operates in a saturation region in the case of Vth being more than 0.

Figure 5:
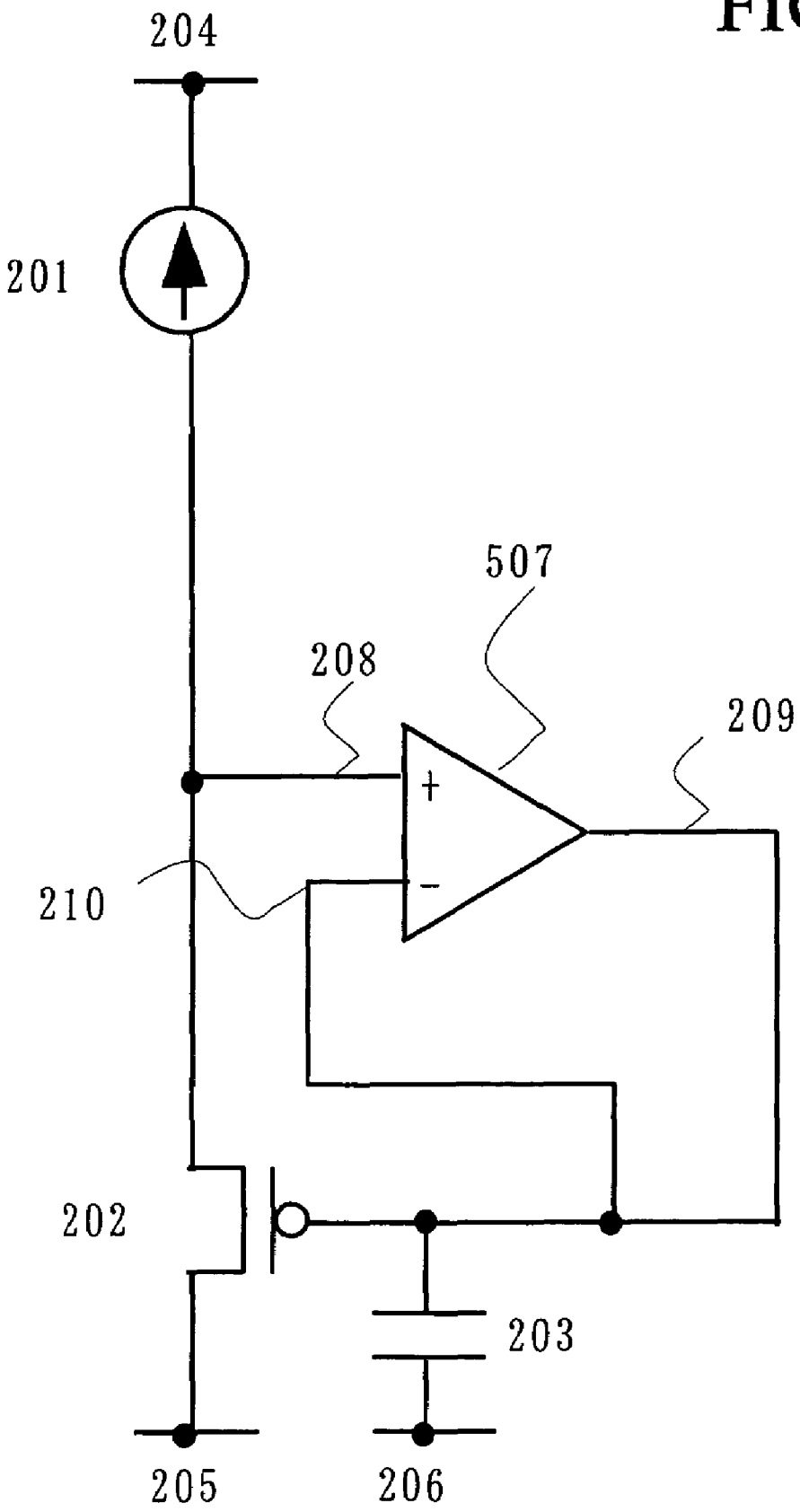
FIG. 5 is a diagram showing a configuration of the semiconductor device of the invention.
Figure 6:
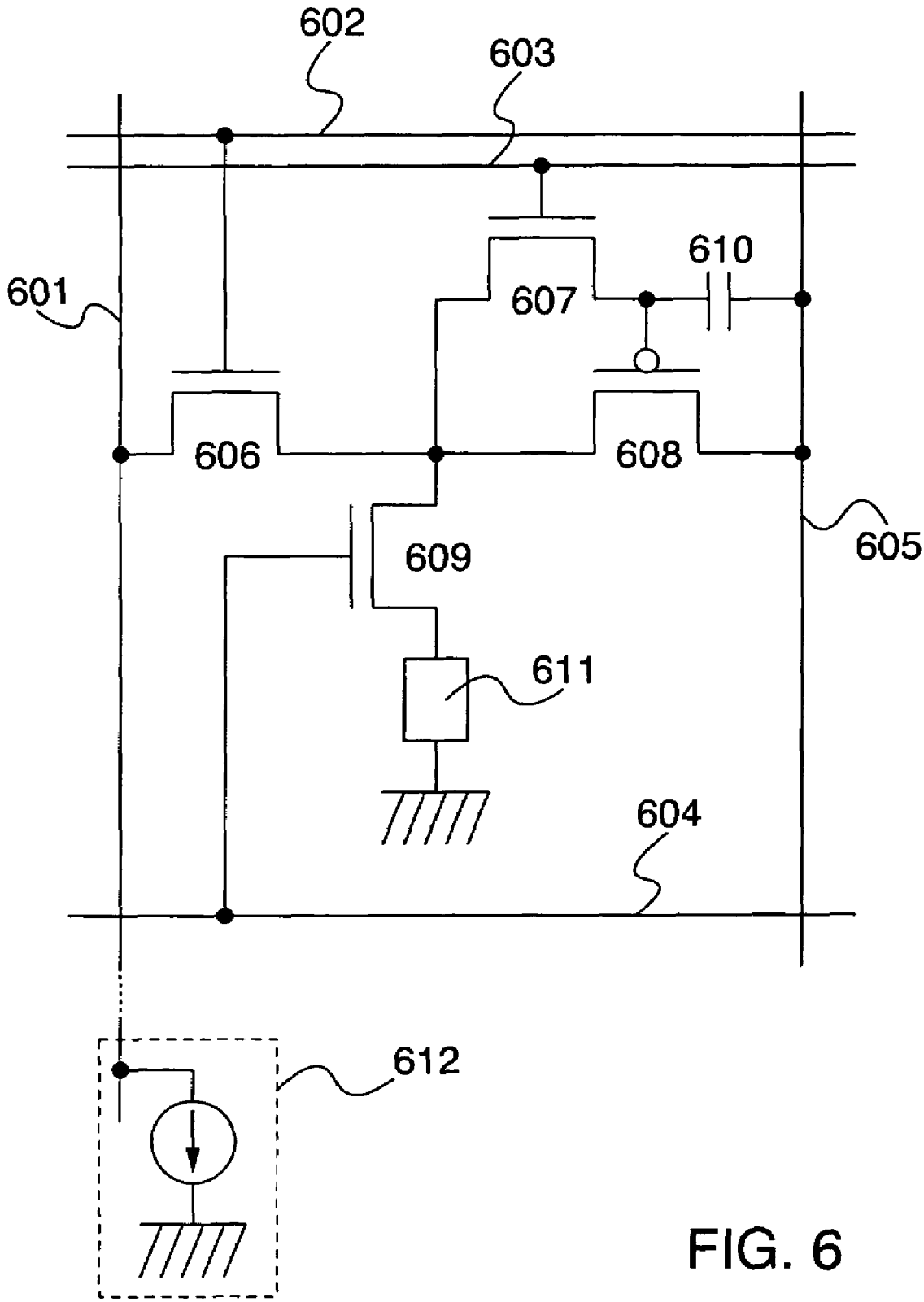
FIG. 6 is a diagram showing a configuration of an existing pixel.
Figure 7:
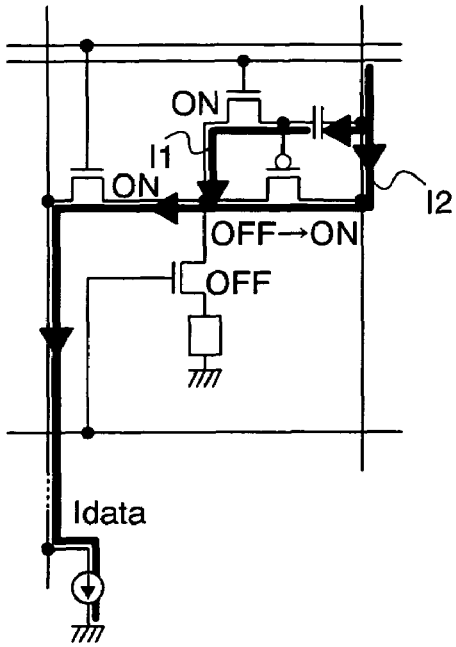
FIG. 7 shows operations of an existing pixel.
Figure 7:
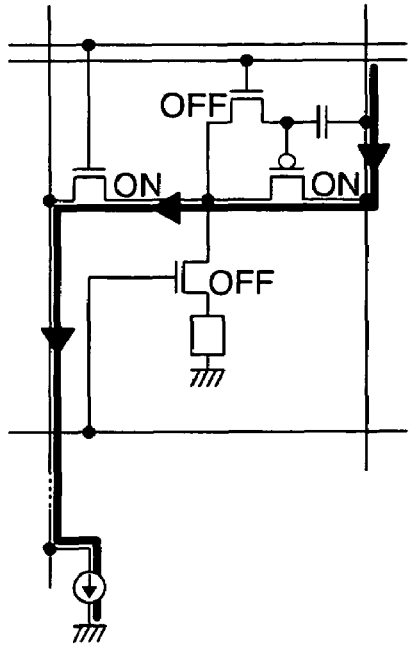
Figure 7:
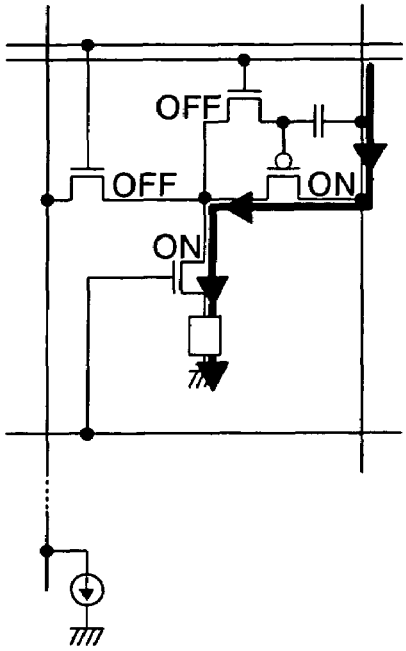
Figure 7:
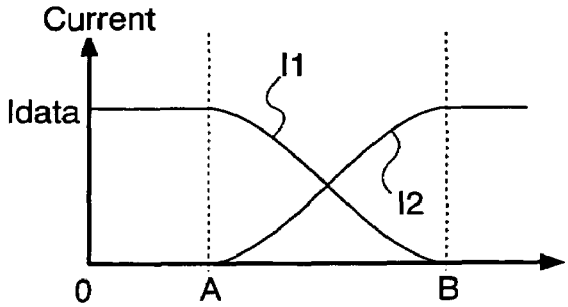
Figure 7:
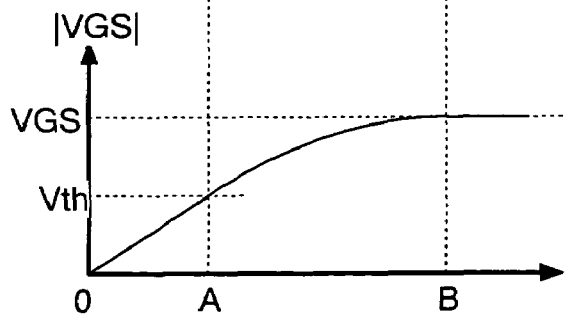
Figure 8:
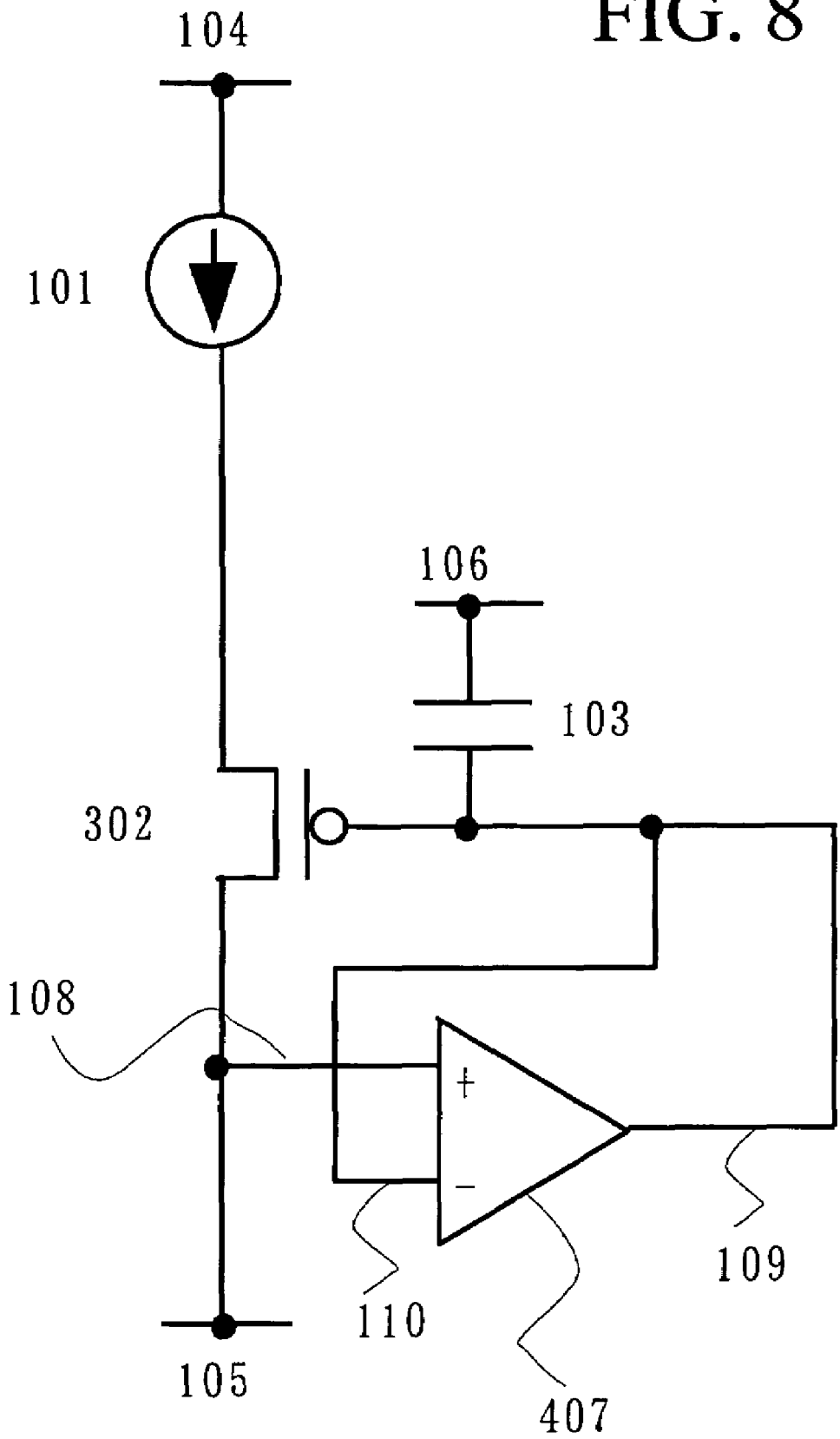
FIG. 8 is a diagram showing a configuration of the semiconductor device of the invention.

Similarly to FIG. 4, FIG. 5 shows a configuration diagram corresponding to FIG. 2 and FIG. 8 shows a configuration diagram corresponding to FIG. 3. It is to be noted that any type of operational amplifier may be used as the operational amplifier used in FIGS. 4, 5 and 8. A voltage feedback operational amplifier or a current feedback operational amplifier may be used. Alternatively, an operational amplifier added with various correction circuits such as a phase compensation circuit, a variation correction circuit and an offset voltage correction circuit.

The operational amplifier normally operates so that a potential of a non-inverting (positive phase) input terminal may be equal to a potential of an inverting input terminal, though the potentials of the non-inverting (positive phase) input terminal and the inverting input terminal may not be equal due to variations in characteristics and the like. In other words, an offset voltage may be generated. In that case, similarly to a normal operational amplifier, potentials of a non-inverting (positive phase) input terminal and an inverting input terminal may be adjusted to be equal to each other. In the case of the invention, however, the current source transistor 102 is only required to be controlled to operate in a saturation region. Therefore, within a range where the current source transistor 102 operates in a saturation region, an offset voltage may be generated in the operational amplifier and variations in offset voltages do not have an affect. Accordingly, even when the operational amplifier is constituted by transistors whose current characteristics vary significantly, it can operate normally.

Accordingly, a thin film transistor (including amorphous and polycrystalline), an organic transistor or the like may be effectively used instead of a single crystalline transistor.

When focusing on the connection of the circuit shown in FIG. 4, the inverting input terminal of the operational amplifier is connected to the output terminal. This is a circuit configuration that is generally called a voltage follower circuit. That is, a voltage of the non-inverting (positive phase) input terminal is outputted to the output terminal, and the input and output impedance is converted. Therefore, not only the operational amplifier connected as shown in FIG. 4 but also a circuit having a function similar to the voltage follower circuit may be utilized as the amplifier circuit shown in FIGS. 1 to 3.

Figure 9:
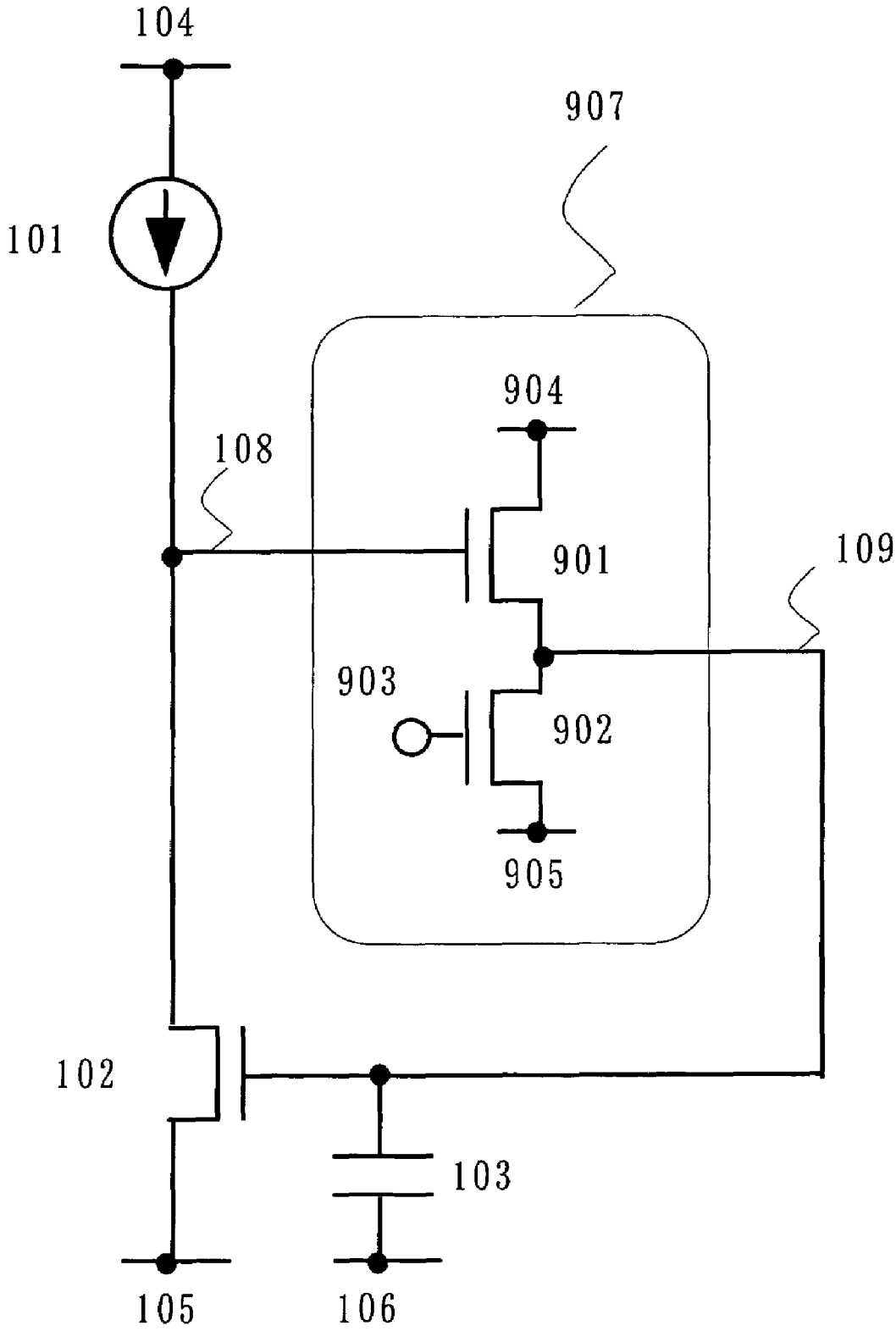
FIG. 9 is a diagram showing a configuration of the semiconductor device of the invention.

There is a source follower circuit as a circuit for converting the input and output impedance. In a normal source follower circuit, an input potential and an output potential are not equal to each other. However, in the amplifier circuit used in FIGS. 1 to 3, the input potential and the output potential thereof are not required to be equal to each other, that is, it has only to be a circuit that can control the current source transistor 102 to operate in a saturation region. Thus, FIG. 9 shows a configuration in the case of using a source follower circuit as an amplifier circuit. When a potential of an input terminal (gate terminal of an amplifying transistor 901), namely a potential of the drain terminal of the current source transistor 102 changes, a potential of an output terminal (source terminal of the amplifying transistor 901), namely a potential of the gate terminal of the current source transistor 102 also changes. When the potential of the gate terminal of the current source transistor 102 changes, a potential of the drain terminal of the current source transistor 102 also changes. In this manner, a feedback circuit is constituted.

Figure 10:
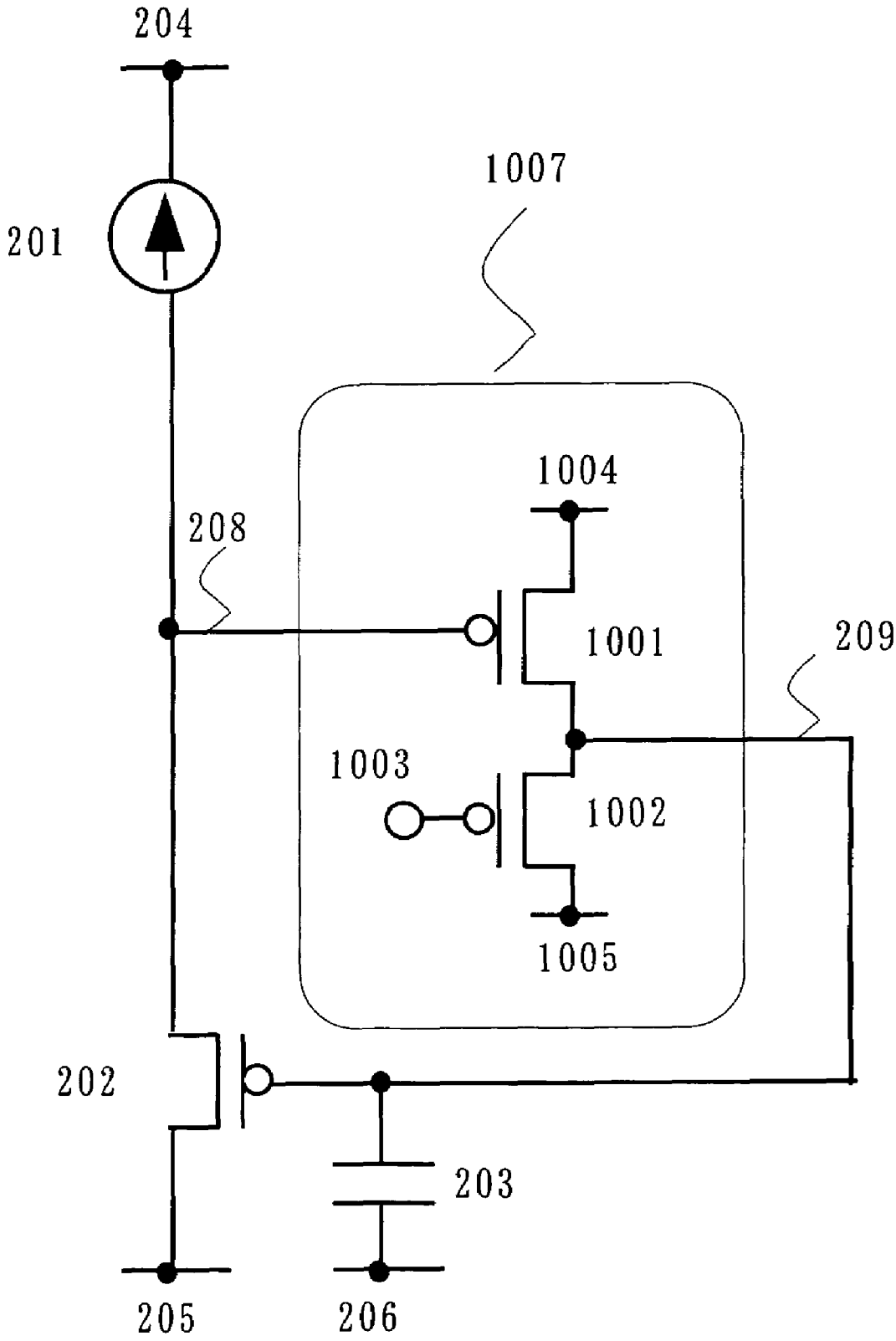
FIG. 10 is a diagram showing a configuration of the semiconductor device of the invention.
Figure 11:
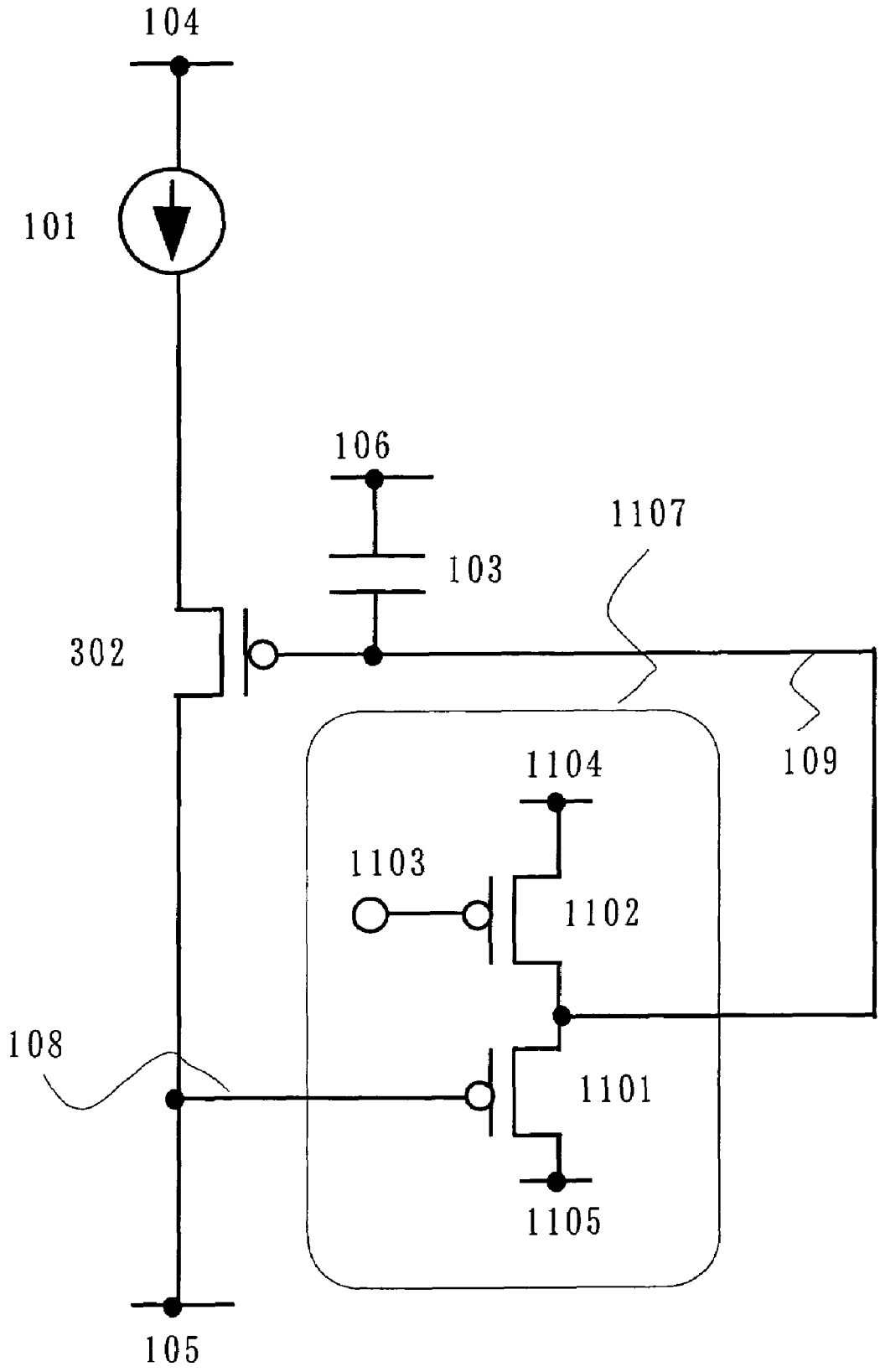
FIG. 11 is a diagram showing a configuration of the semiconductor device of the invention.

In FIG. 9, an N-channel transistor that is the same polarity as the current source transistor 102 is used as the amplifying transistor 901. Accordingly, the potential of the output terminal (source terminal of the amplifying transistor 901) is lower than the potential of the input terminal (gate terminal of the amplifying transistor 901) by a gate-source voltage of the amplifying transistor 901. Thus, the current source transistor 102 operates in a saturation region. As is evident from the foregoing, in the case of the source follower circuit being used as an amplifying circuit, it is preferably configured so that the current source transistor 102 may operate in a saturation region easily (in the case of FIG. 9, the amplifying transistor 901 is an N-channel transistor). However, the invention is not limited to this, and a P-channel transistor may be employed. FIG. 10 shows a configuration diagram corresponding to FIG. 2 and FIG. 11 shows a configuration diagram corresponding to FIG. 3. An amplifying transistor 1001 that has the same polarity as the current source transistor is used in both FIG. 10 and FIG. 11, though the invention is not limited to this.

Although biasing transistors 902, 1002 and 1102 are used and a bias voltage is applied to gate terminals thereof in FIGS. 9 to 11, the invention is not limited to this. A resistor and the like may be used instead of the biasing transistor. Alternatively, a push-pull circuit may be constituted by a transistor that has the opposite polarity to the amplifying transistor.

In the case of the source follower circuit, similar to the case of the operational amplifier, variations in output voltages do not have an affect within a range where the current source transistor operates in a saturation region. Accordingly, even when the source follower circuit is constituted by transistors whose current characteristics vary significantly, it can operate normally.

As described above, within a range where the current source transistor operates in a saturation region, variations in output voltages of the amplifier circuit do not have an affect. Therefore, in the voltage follower circuit, the source follower circuit and the like, an input voltage has not to be proportional to an output voltage. That is, any circuit can be adopted as long as it controls the current source transistor to operate in a saturation region.

As set forth above, within a range where the current source transistor operates in a saturation region, variations in characteristics of the amplifier circuits used in FIGS. 1 to 3 do not have an affect. Accordingly, even in the case of the amplifier circuit being constituted by transistors whose current characteristics vary significantly, it can operate normally.

Accordingly, a thin film transistor (including amorphous and polycrystalline), an organic transistor or the like may be effectively used instead of a single crystalline transistor.

Although the operational amplifier and the source follower circuit are used as an example of the amplifier circuit, the invention is not limited to this. The amplifier circuit can be constituted by other various circuits such as a differential circuit, a common drain amplifier circuit and a common source amplifier circuit.

It is to be noted that the description in this embodiment mode corresponds to a detailed description of a part of the configuration shown in Embodiment Mode 1. However, various changes and modifications are possible unless such changes and modifications depart from the scope of the invention. Therefore, the description in Embodiment Mode 1 can be applied to this embodiment mode.

Embodiment Mode 3

A current Idata is supplied from a current source circuit, and a current source transistor is set to flow the current Idata. Then, the current source transistor set in this manner operates as a current source circuit and supplies a current to various loads. Described in this embodiment mode are a connection between a load and a current source transistor, a configuration of a transistor when supplying a current to a load, and the like.

Although this embodiment mode will be described, for simplicity, with reference to the configuration shown in FIG. 1, and more particularly the configuration using an operational amplifier as an amplifier circuit (FIG. 4), the invention is not limited to this. This embodiment mode can be easily applied to other configurations as shown in FIGS. 2 to 11.

In addition, described in this embodiment mode is the case where a current flows from the current source circuit to the current source transistor and the current source transistor is an N-channel transistor, though the invention is not limited to this. This embodiment mode can be easily applied to other configurations as shown in FIGS. 2 to 11.

Figure 12:
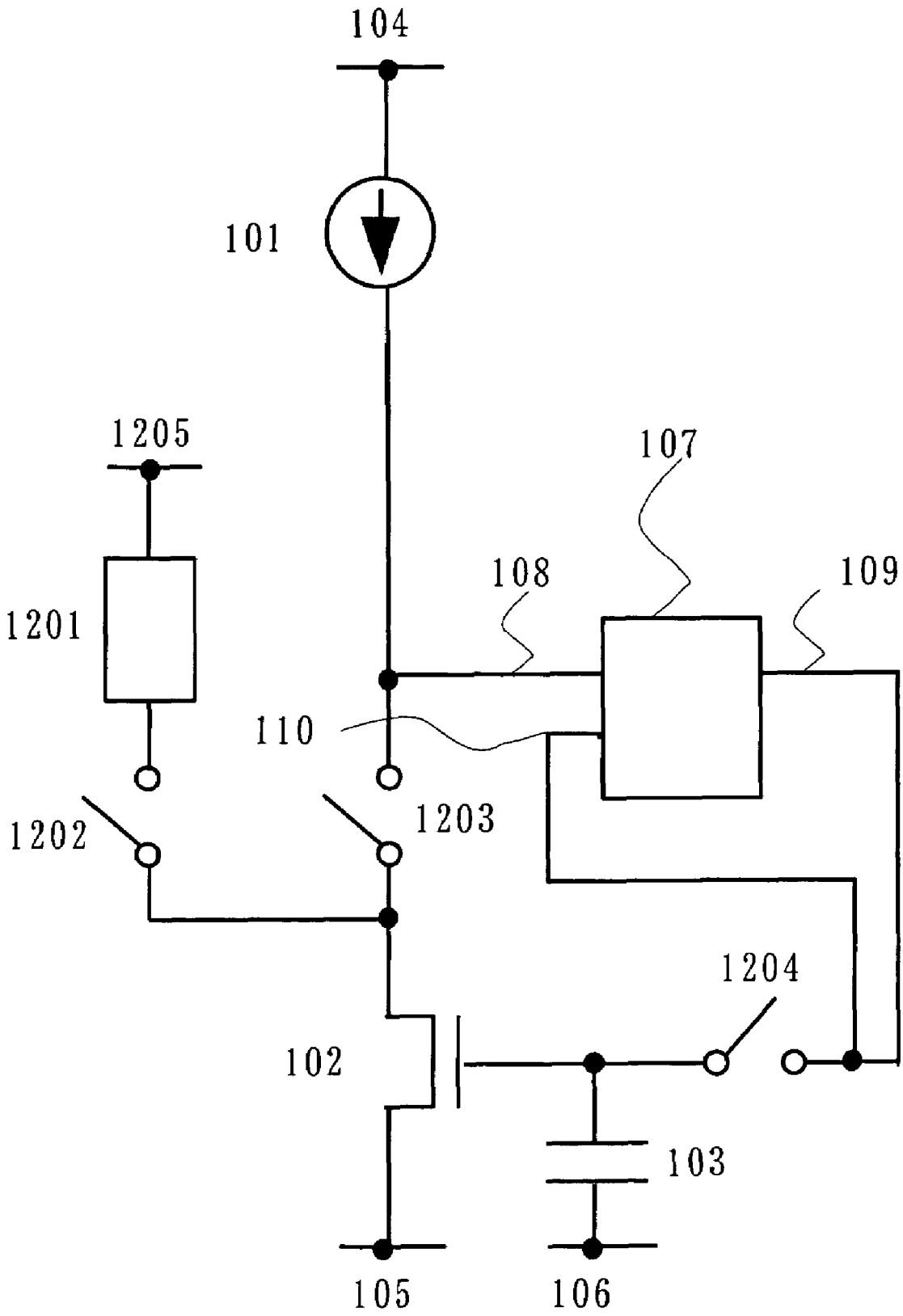
FIG. 12 is a diagram showing a configuration of the semiconductor device of the invention.
Figure 13:
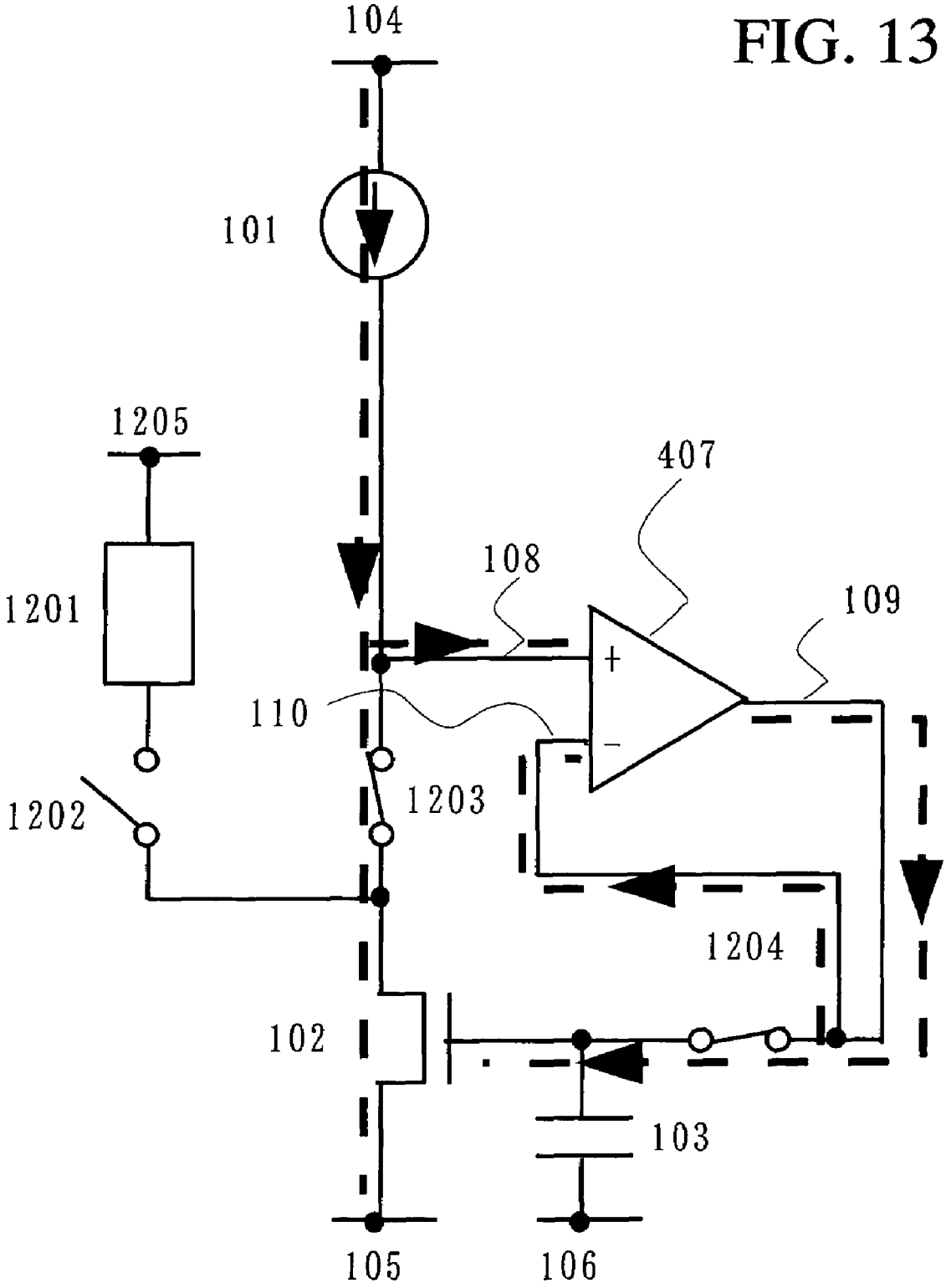
FIG. 13 is a diagram showing an operation of the semiconductor device of the invention.

First, FIG. 12 shows a configuration in which a current supplied from a current source circuit is supplied to a load by using a current source transistor only. In FIG. 13, an operational amplifier is used as an amplifier circuit.

Figure 14:
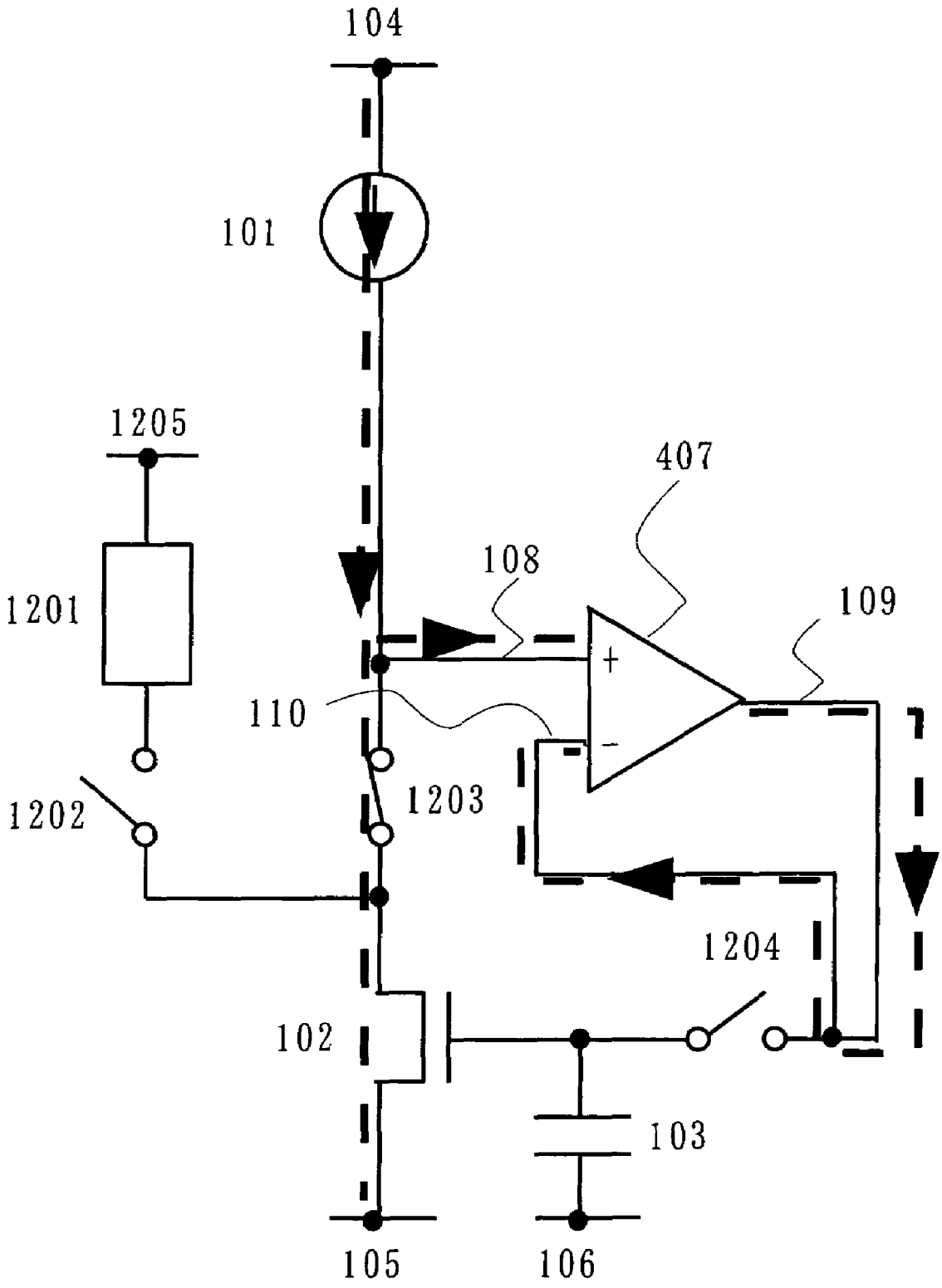
FIG. 14 is a diagram showing an operation of the semiconductor device of the invention.
Figure 15:
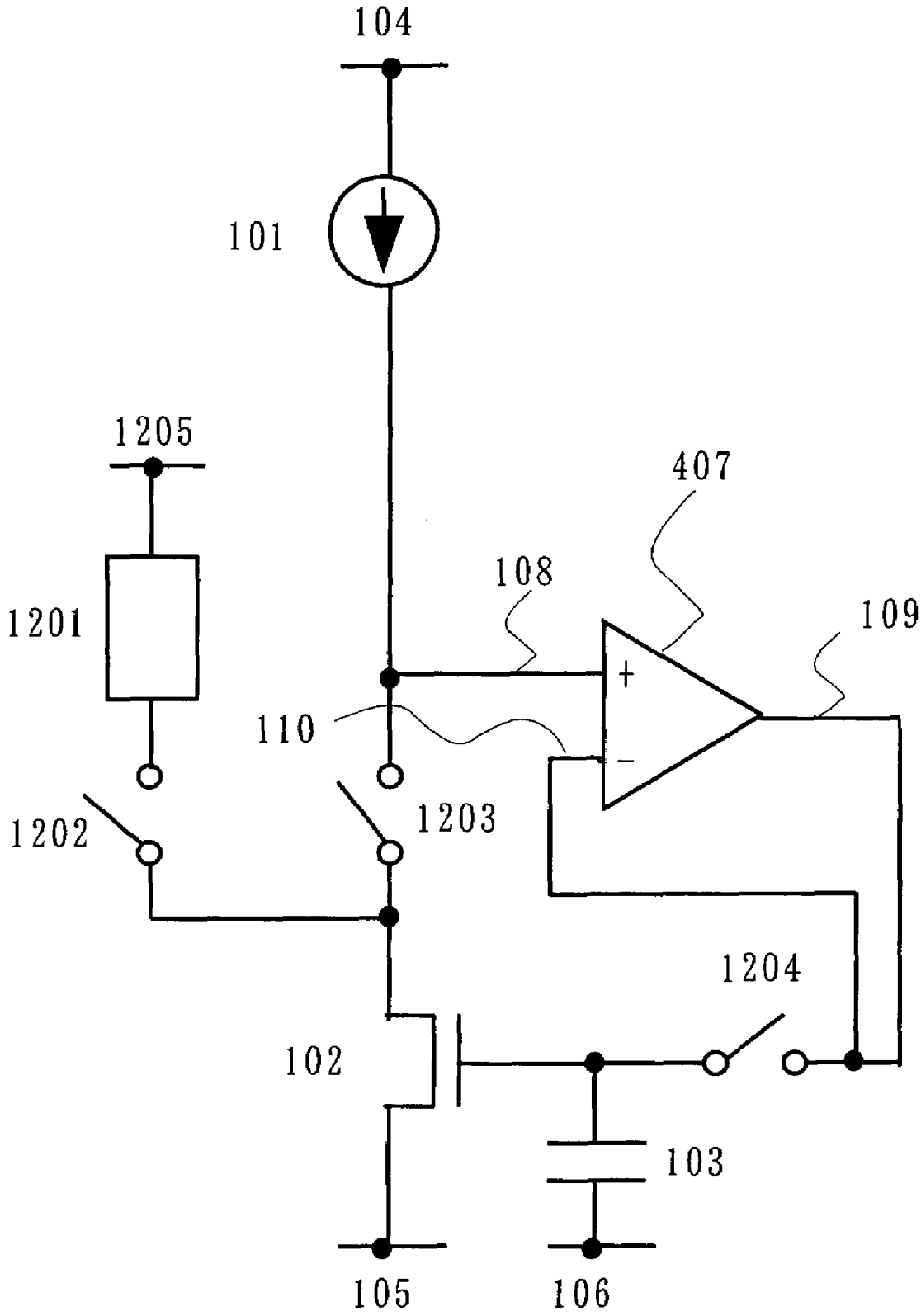
FIG. 15 is a diagram showing an operation of the semiconductor device of the invention.
Figure 16:
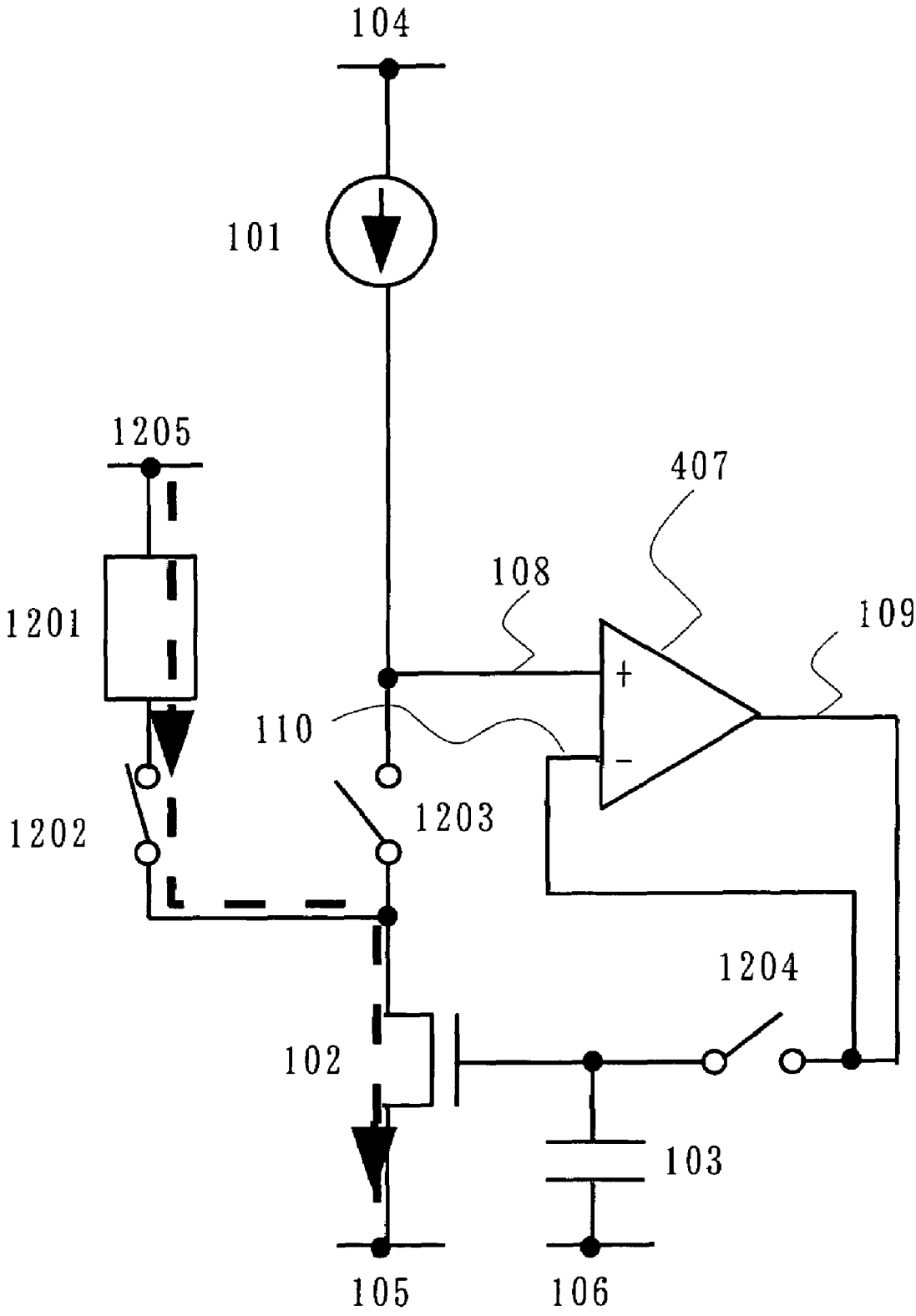
FIG. 16 is a diagram showing an operation of the semiconductor device of the invention.

An operation of FIG. 12 is described taking for example the case of an operational amplifier being used as an amplifier circuit. First, as shown in FIG. 13, a switch 1203 and a switch 1204 are turned on. Then, an operational amplifier 407 controls a gate potential of the current source transistor 102 so that the current source transistor 102 may flow a current Idata supplied from the current source circuit while operating in a saturation region. Since the operational amplifier 407 is used at this time, writing can be carried out quickly. Subsequently, the switch 1204 is turned off as shown in FIG. 14, and thereby the gate potential of the current source transistor 102 is held in the capacitor element 103. When the switch 1203 is turned off as shown in FIG. 15, current supply is stopped. Then, a switch 1202 is turned on as shown in FIG. 16, and thereby a current is supplied to a load 1201. The amount of current at this time is equal to the Idata when the current source transistor 102 operates in a saturation region. That is, even when there are variations in current characteristics and size of the current source transistor 102, influences thereof can be prevented.

Figure 17:
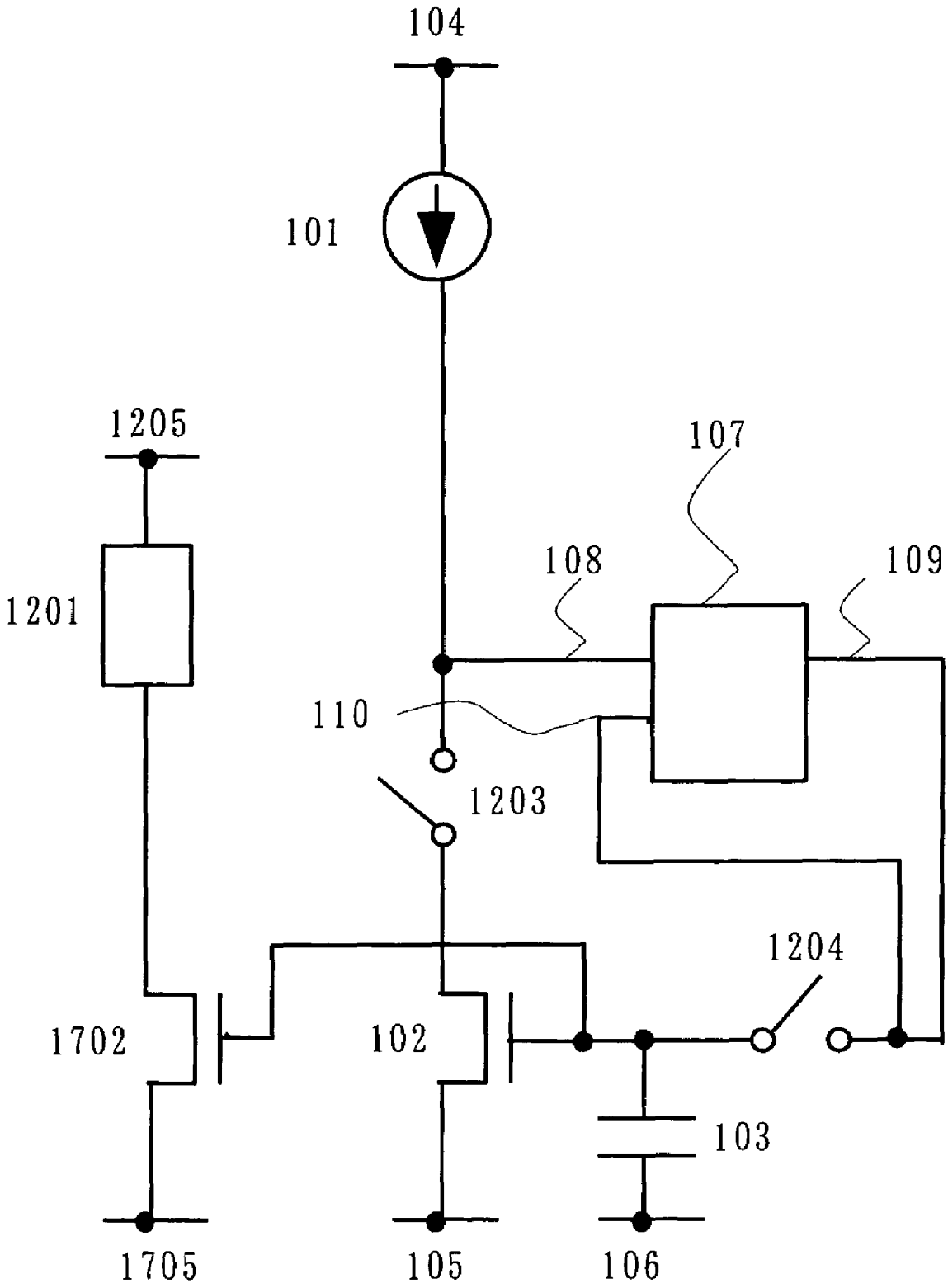
FIG. 17 is a diagram showing a configuration of the semiconductor device of the invention.

Next, FIG. 17 shows a configuration diagram in which a current is supplied to a load by using a transistor other than the current source transistor. A gate terminal of the current transistor 1702 is connected to the gate terminal of the current source transistor 102. Thus, when the W/L of the current source transistor 102 and the current transistor 1702 is adjusted, the amount of current supplied to a load can be changed. Note that W is the channel width whereas L is the channel length herein. For example, when the W/L of the current transistor 1702 is small, the amount of current supplied to a load is reduced, and thereby the amount of Idata can be increased. As a result, writing of current can be carried out quickly. However, when there are variations in current characteristics of the current source transistor 102 and the current transistor 1702, influences thereof are inevitable.

Figure 18:
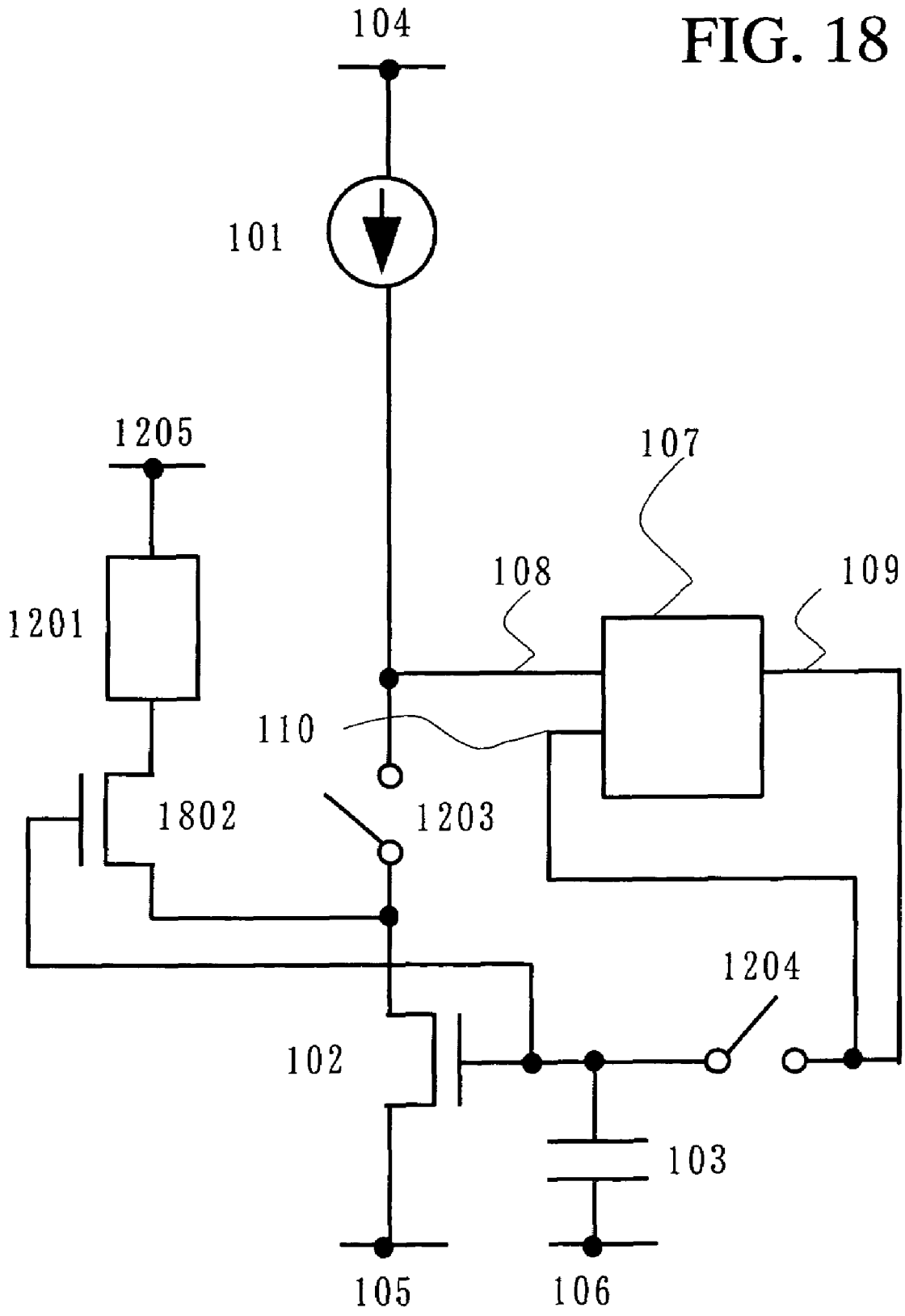
FIG. 18 is a diagram showing a configuration of the semiconductor device of the invention.

FIG. 18 shows a configuration diagram in which a current is supplied to a load by using another transistor as well as the current source transistor. In the case of the current Idata of the current source circuit 101 being supplied, when the current leaks to the load 1201 or a current leaks from the load 1201, the proper amount of current cannot be set. The current is controlled by the switch 1202 in the case of FIG. 12, while it is controlled by a multi-transistor 1802 in the case of FIG. 18. A gate terminal of the multi-transistor 1802 is connected to the gate terminal of the current source transistor 102. Therefore, when the switches 1203 and 1204 are on and the current source transistor 102 operates in a saturation region, the multi-transistor 1802 is off. Thus, it does not adversely affect when the current Idata of the current source circuit 101 is supplied. On the other hand, when a current is supplied to the load, the current source transistor 102 and the multi-transistor 1802 whose gate terminals are connected to each other operate as a multi-gate transistor. Accordingly, a current smaller than the Idata is supplied to the load 1201. Since the amount of current supplied to the load becomes smaller, the amount of Idata can be increased. As a result, writing of current can be carried out quickly. When there are variations in current characteristics of the current source transistor 102 and the multi-transistor 1802, influences thereof are inevitable. However, a current is supplied to the load 1201 by using also the current source transistor 102, thus influences of the variations can be suppressed.

Figure 19:
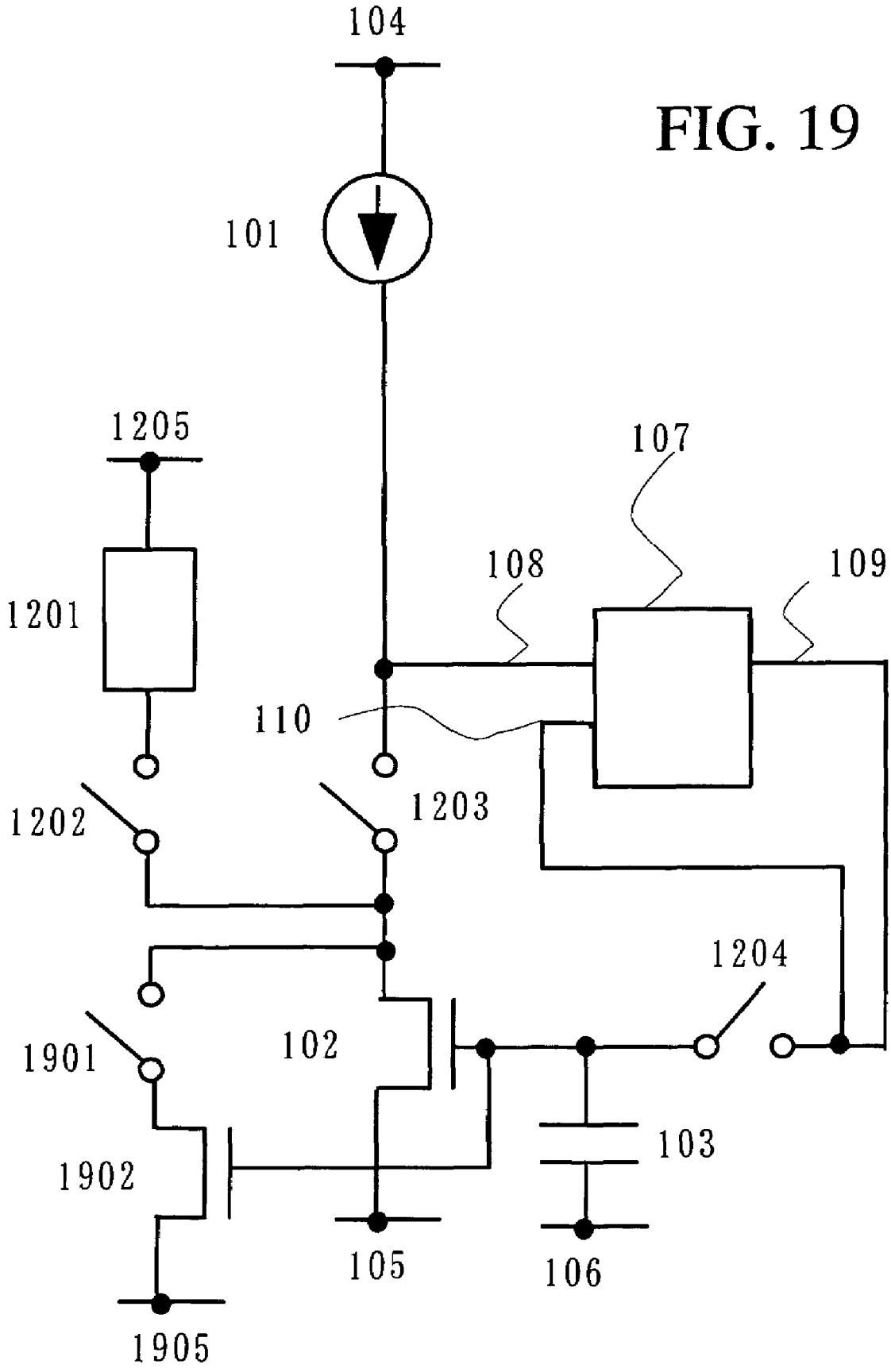
FIG. 19 is a diagram showing a configuration of the semiconductor device of the invention.

FIG. 19 shows a configuration for increasing the current Idata supplied from the current source circuit 101 in a different manner than the one shown in FIG. 17 or 18. In FIG. 19, a parallel transistor 1902 is connected in parallel with the current source transistor 102. Therefore, when a current is supplied from the current source circuit 101, a switch 1901 is turned on. Meanwhile, in the case of a current being supplied to the load 1201, the switch 1901 is turned off. According to this, the current supplied to the load 1201 becomes smaller, and thereby the current Idata supplied from the current source circuit 101 can be increased.

In that case, however, variations of the current source transistor 102 and the parallel transistor 1902 have an affect. Thus, in the case of FIG. 19, when a current is supplied from the current source circuit 101, the amount of current may vary. That is, a large current is supplied first and the switch 1901 is turned on in accordance with the current. Then, a current flows in the parallel transistor 1902 and writing of current can be carried out quickly. In other words, this corresponds to a precharge operation. The current supplied from the current source circuit 101 is reduced thereafter, and the switch 1901 is turned off. Thus, the current is supplied and written to the current source transistor 102 only. According to this, influences of variations can be prevented. Then, the switch 1202 is turned on and a current is supplied to the load 1201.

Figure 20:
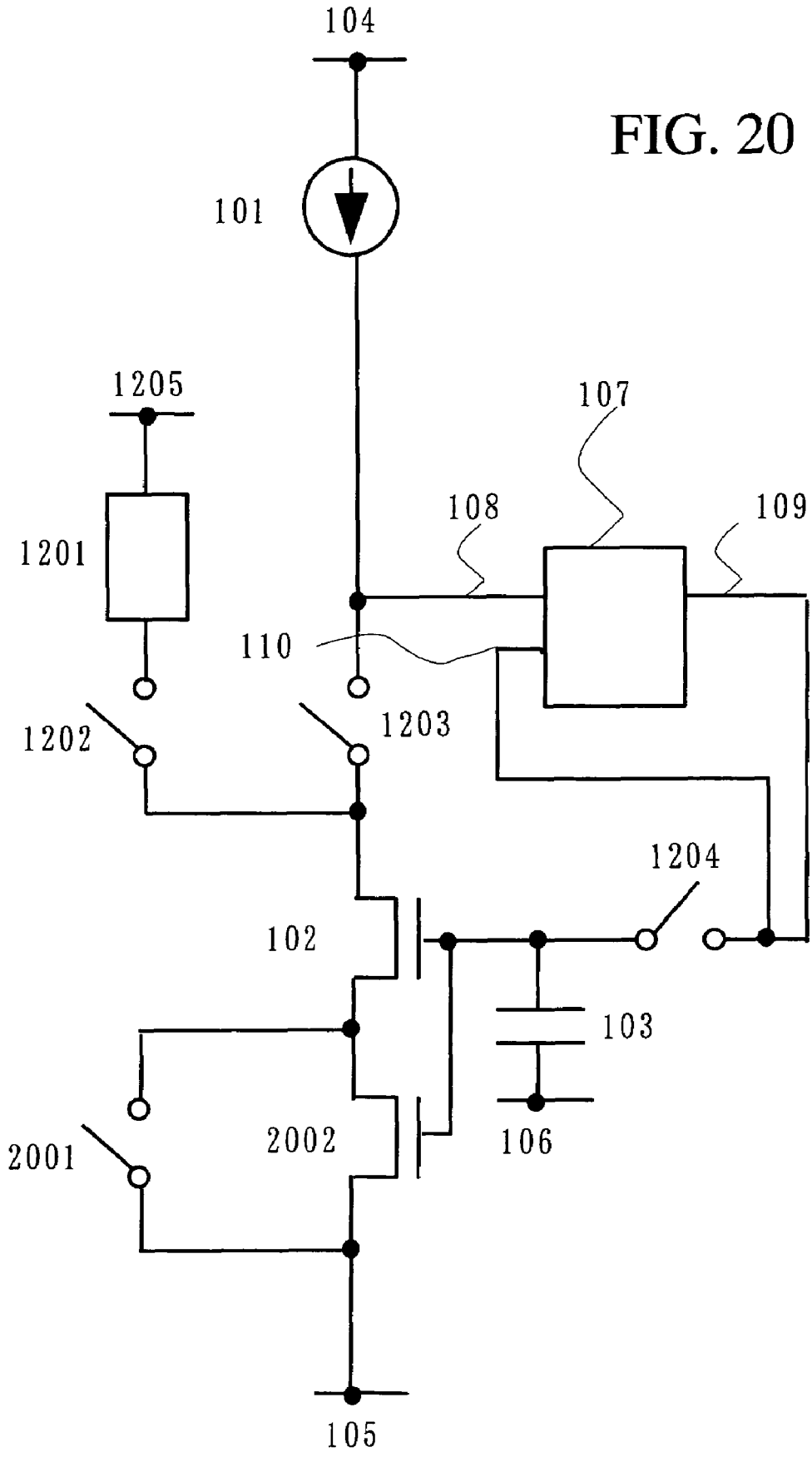
FIG. 20 is a diagram showing a configuration of the semiconductor device of the invention.

In FIG. 19, the transistor is added in parallel with the current source transistor. FIG. 20 shows a configuration diagram in which a transistor is added in series. In FIG. 20, a series transistor 2002 is connected in series with the current source transistor 102. Therefore, when a current is supplied from the current source circuit 101, a switch 2001 is turned on, and thereby a source and a drain of the series transistor 2002 are short-circuited. When a current is supplied to the load 1201, the switch 2001 is turned off. Thus, the current source transistor 102 and the series transistor 2002 whose gate terminals are connected to each other operate as a multi-gate transistor. Accordingly, the gate length L is increased and the amount of current flowing to the load 1201 is reduced, and thereby the current Idata supplied from the current source circuit 101 can be increased.

In that case, however, variations of the current source transistor 102 and the series transistor 2002 have an affect. Thus, in the case of FIG. 20, when a current is supplied from the current source circuit 101, the amount of current may vary. That is, a large current is supplied first and the switch 2001 is turned on in accordance with the current. Then, a current flows in the current source transistor 102 and writing of current can be carried out quickly. In other words, this corresponds to a precharge operation. The current supplied from the current source circuit 101 is reduced thereafter, and the switch 2001 is turned off. Thus, the current is supplied and written to the current source transistor 102 and the series transistor 2002. According to this, influences of variations can be prevented. Then, the switch 1202 is turned on and a current is supplied to the load 1201 by the current source transistor 102 and the series transistor 2002 that constitute a multi-gate transistor.

It is to be noted that various configurations shown in FIGS. 12 to 20 may be combined to obtain another configuration.

Figure 21:
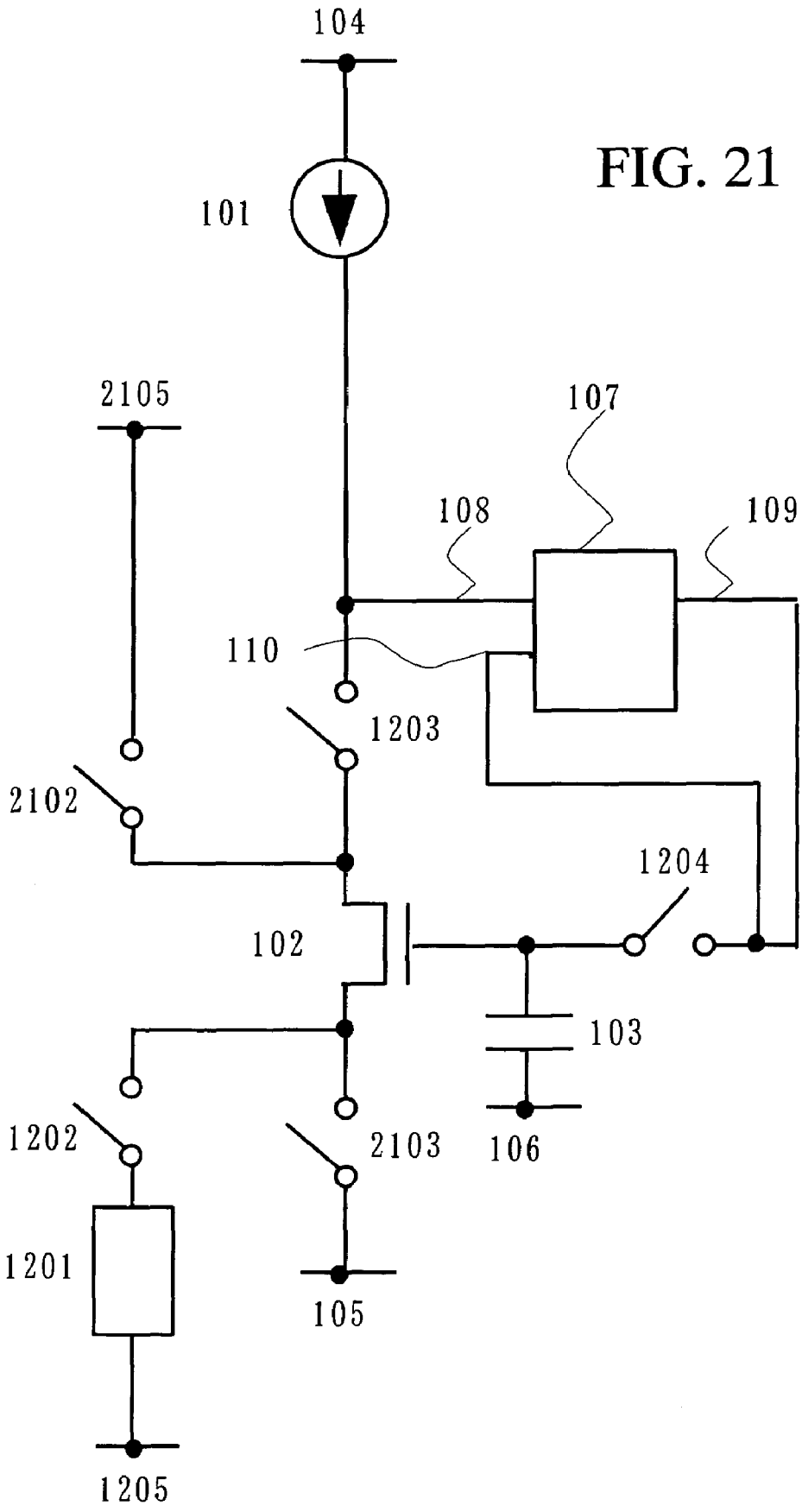
FIG. 21 is a diagram showing a configuration of the semiconductor device of the invention.
Figure 22:
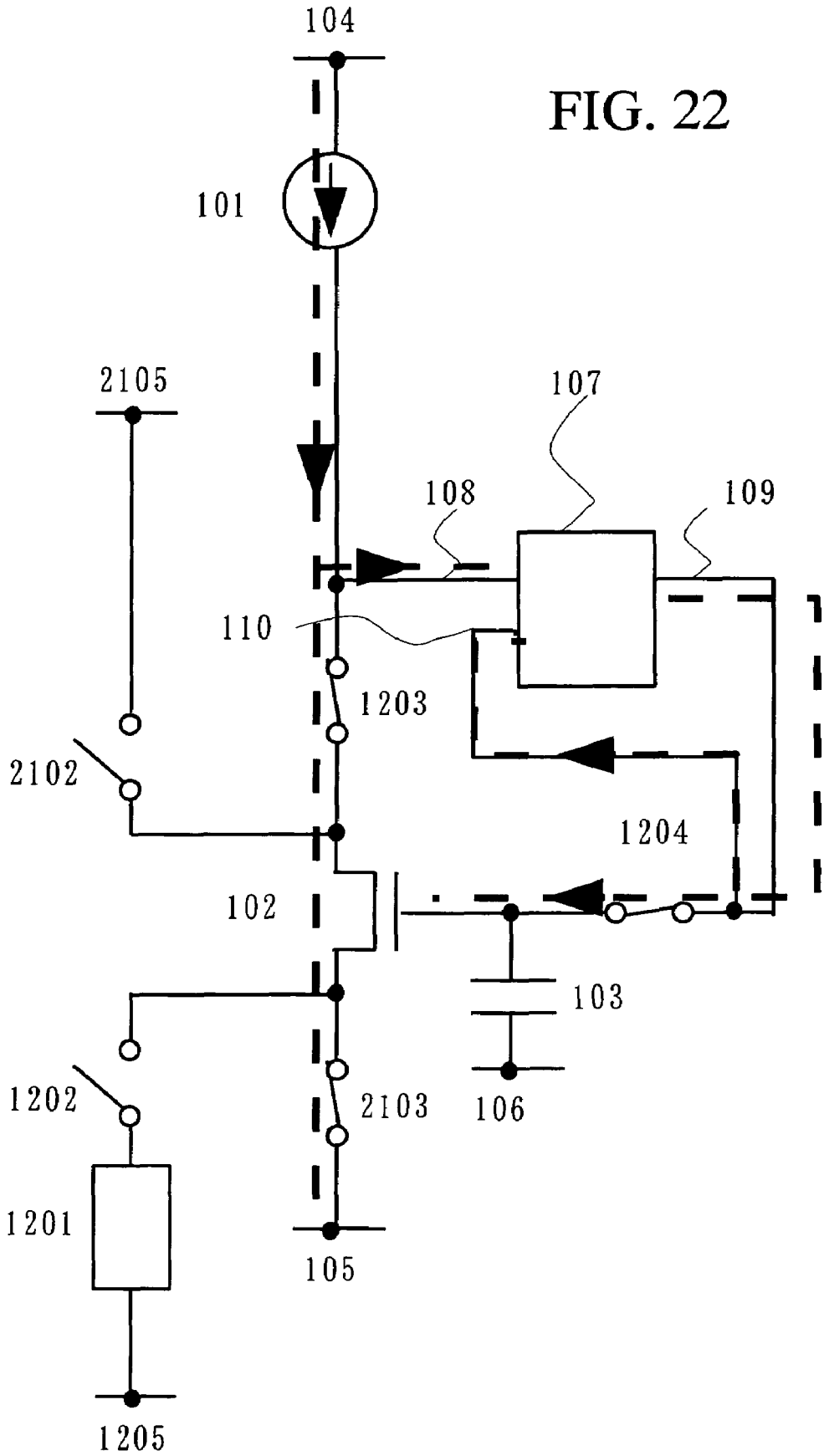
FIG. 22 is a diagram showing an operation of the semiconductor device of the invention.
Figure 23:
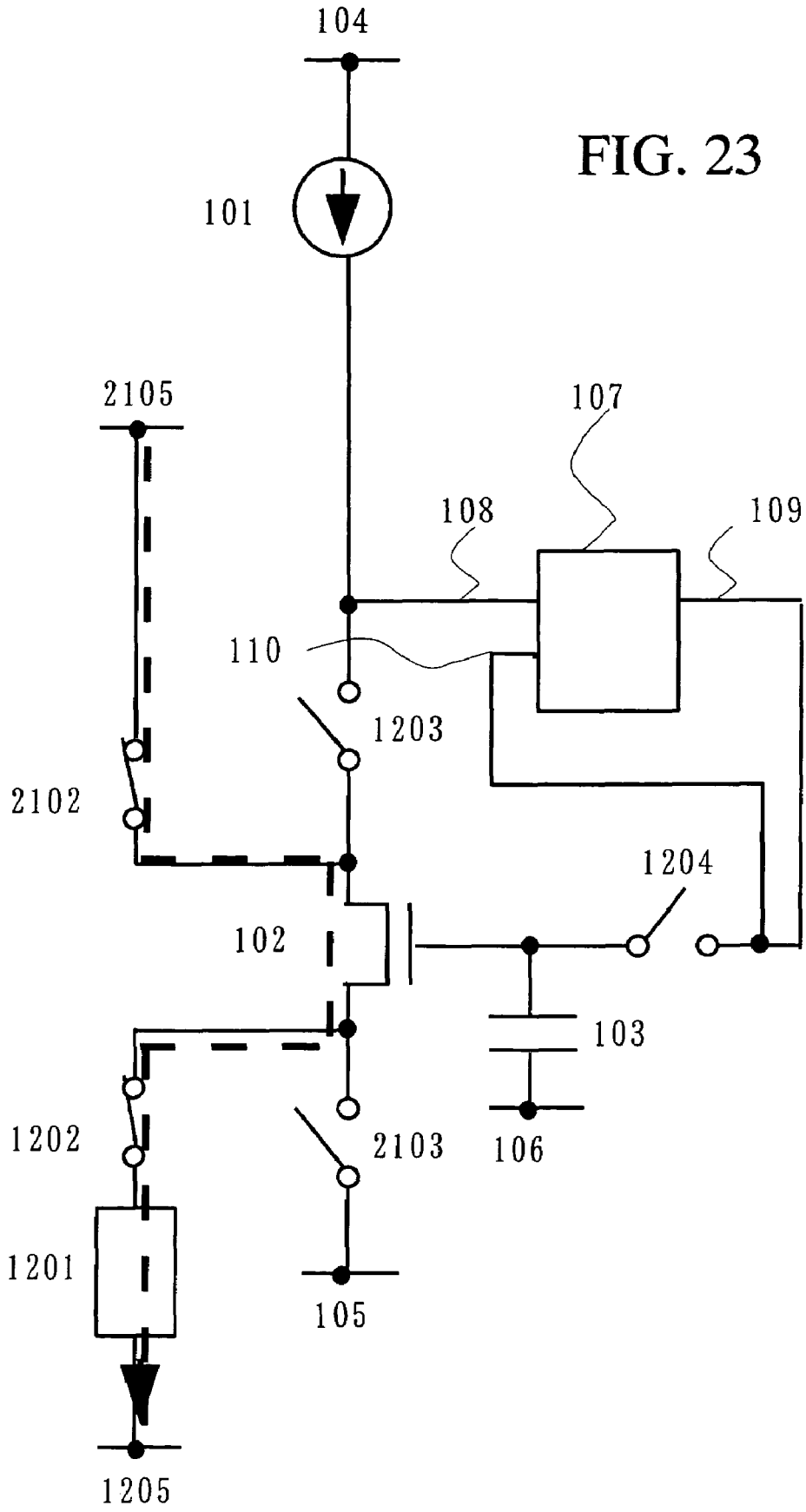
FIG. 23 is a diagram showing an operation of the semiconductor device of the invention.

Although the current source circuit 101 and the load 1201 are switched over in FIGS. 12 to 20, the invention is not limited to this. For example, the current source circuit 101 and a wiring may be switched over. FIG. 21 shows a configuration corresponding to FIG. 12, in which the current source circuit 101 and a wiring are switched over. An operation of FIG. 21 is described hereinafter. First, the current Idata is supplied from the current source circuit 101 to the current source transistor 102, and switches 1203, 1204 and 2103 are turned on in the case of a current being set. Then, the current source transistor 102 operates as a current source circuit, and switches 2102 and 1202 are turned on in the case of a current being supplied to the load. In this manner, when the switches 1203 and 2102 are turned on/off, the current source circuit 101 and a wiring 2105 are switched over.

In the case of the current Idata being supplied from the current source circuit 101 to the current source transistor 102, the switch 2103 is turned on and a current is supplied to the wiring 105 to turn off the switch 1202, though the invention is not limited to this. When the current Idata is supplied from the current source circuit 101 to the current source transistor 102, a current may flow into the load 1201.

The capacitor element 103 holds the gate potential of the current source transistor 102. It is more desirable that the wiring 106 is connected to the source terminal of the current source transistor in order to hold the gate-source voltage.

FIG. 21 shows a configuration diagram corresponding to FIG. 12, in which the current source circuit 101 and the load 1201 are switched over, though the invention is not limited to this. A configuration in which the current source circuit 101 and the load 1201 are switched over can be achieved in any one of the configurations shown in FIGS. 12 to 20.

It is to be noted that although the switches are arranged in each part in the configurations described above, the arrangement is not limited to the foregoing. The switches may be disposed anywhere as long as they operate normally.

Figure 24:
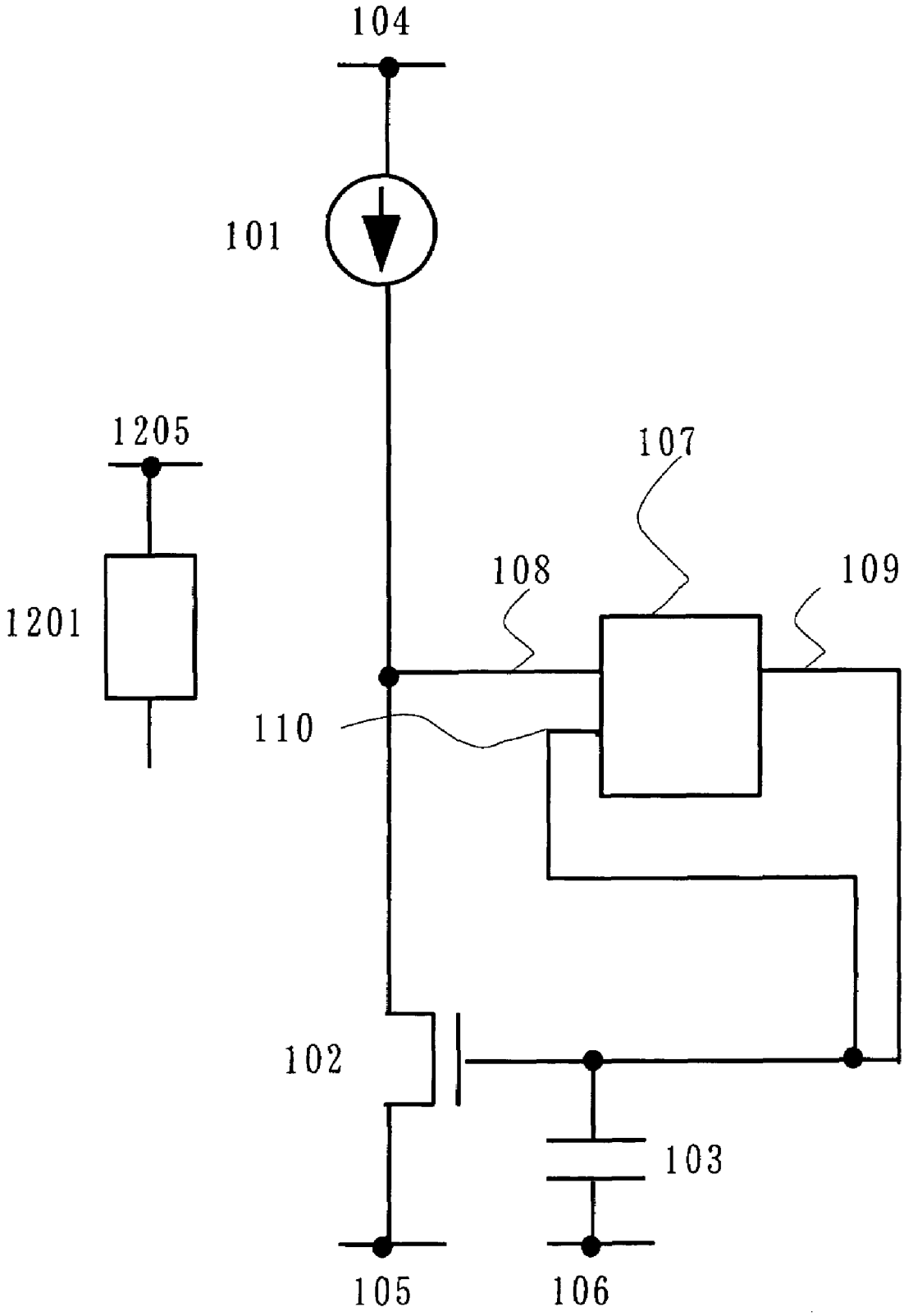
FIG. 24 is a diagram showing an operation of the semiconductor device of the invention.
Figure 25:
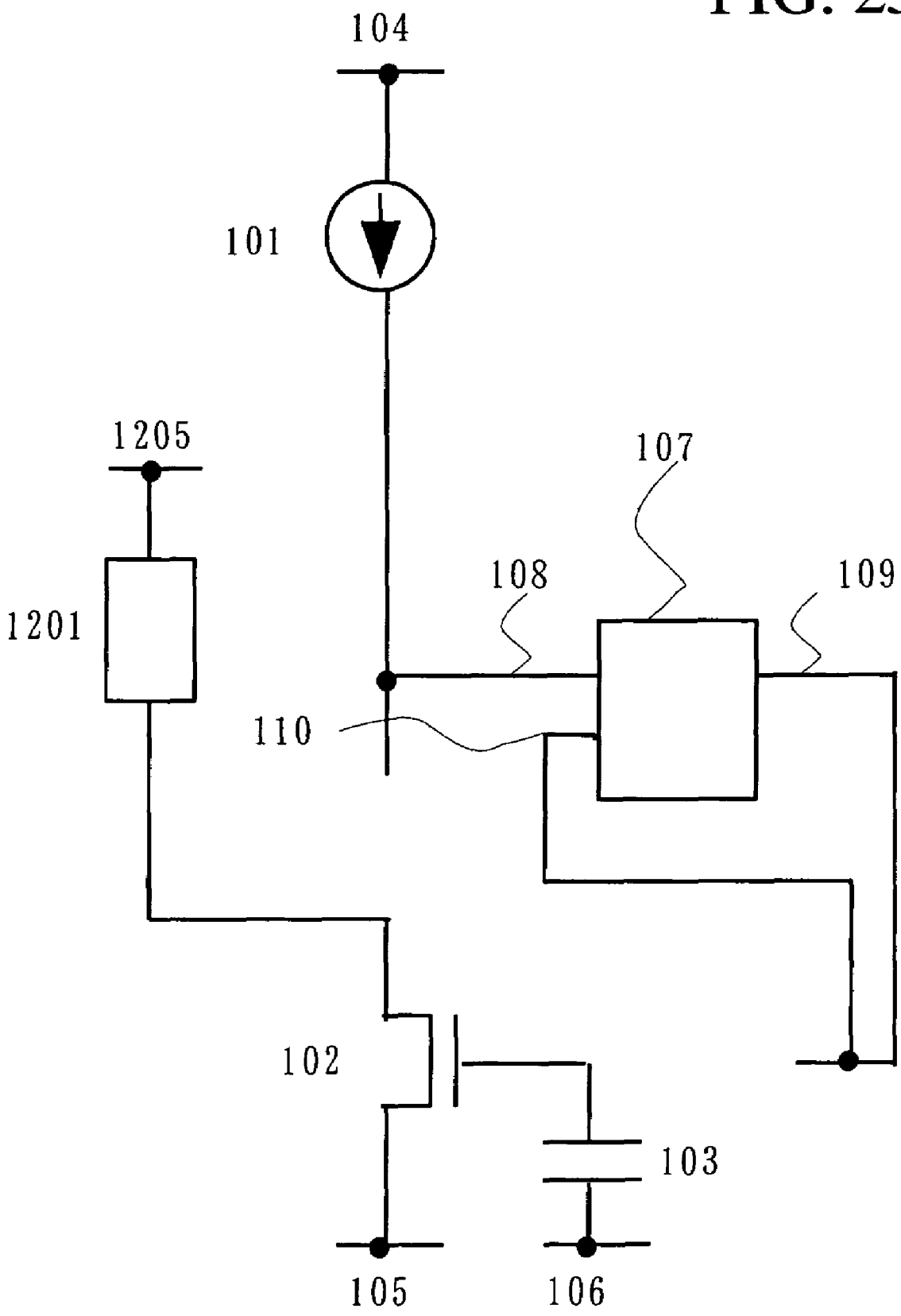
FIG. 25 is a diagram showing an operation of the semiconductor device of the invention.
Figure 26:
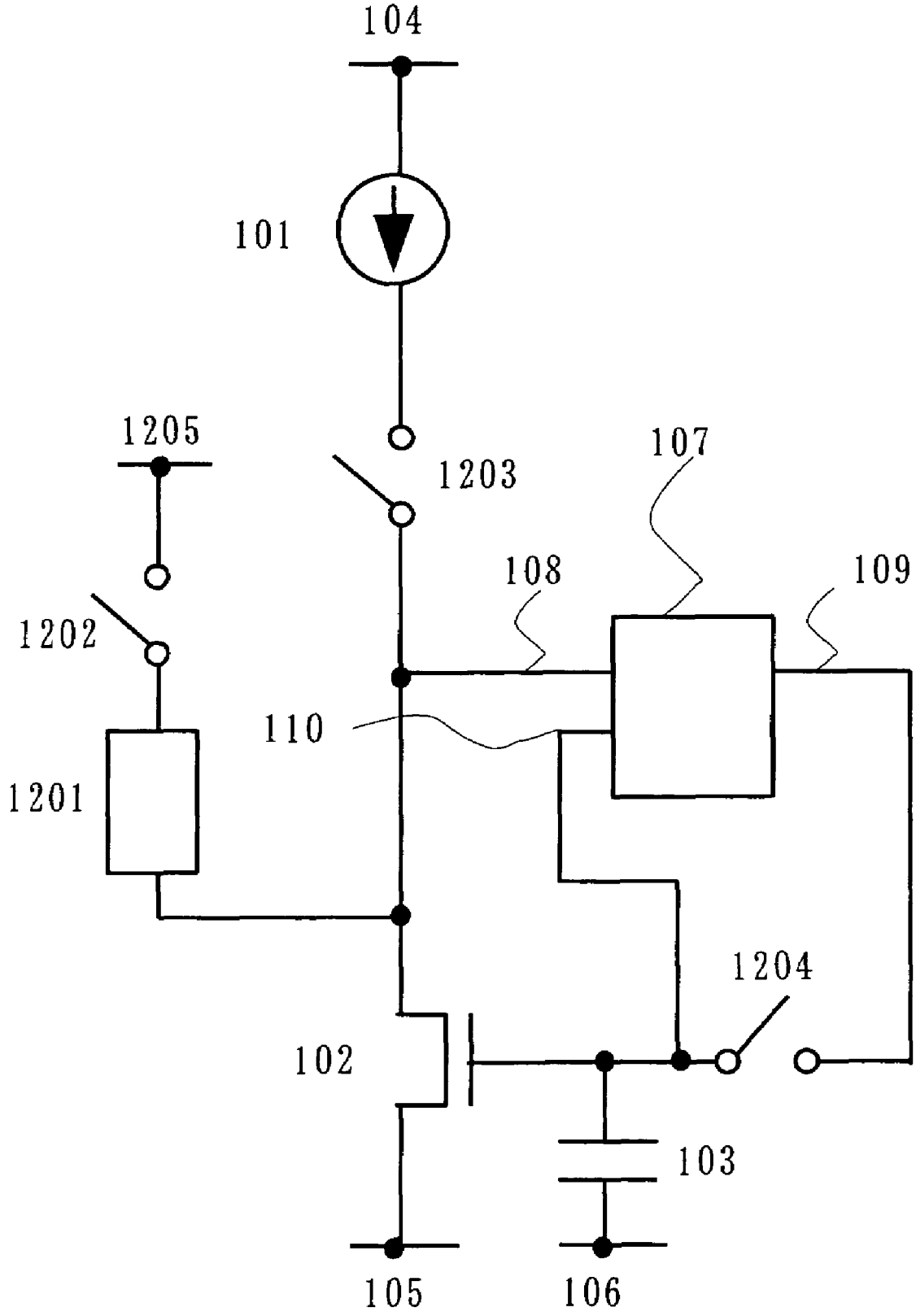
FIG. 26 is a diagram showing a configuration of the semiconductor device of the invention.

In the case of the configuration shown in FIG. 12, it may be connected as shown in FIG. 24 when the current Idata is supplied from the current source circuit 101 to the current source transistor 102, while it may be connected as shown in FIG. 25 when the current source transistor 102 operates as a current source circuit and a current is supplied to the load 1201. Thus, the configuration shown in FIG. 12 may be connected as shown in FIG. 26. The arrangement of the switches 1202, 1203 and 1204 is modified in FIG. 26, but they operate normally.

The switches shown in FIG. 12 and the like may be any one of electrical ones and mechanical ones as long as a current flow can be controlled. They may be transistors, diodes, or logic circuits made of combinations thereof. When a transistor being used as a switch, since it operates only as a switch, the polarity (conductivity type) of the transistor is not particularly restricted. However, in the case of an off current being desirable to be small, it is desirable to use a transistor having the polarity less in the off current. As a transistor less in the off current, there is the one in which an LDD region is disposed, and so on. Furthermore, when a transistor functioning as a switch operates in a state where a potential of a source terminal thereof is close to a low potential side power supply (Vss, Vgnd, 0 V and so on), an n-channel type is desirably used. On the contrary, when it operates in a state where a potential of the source terminal is close to a high potential side power supply (Vdd and so on), a p-channel type is desirably used. The reason for this is that since the absolute value of a gate-source voltage can be made larger, the transistor can easily operate as a switch. With both an n-channel type and a p-channel type, a CMOS type switch may be formed.

Although various examples are shown above, the invention is not limited to this. The current source transistor and various transistors operating as current sources may be disposed in various configurations. Therefore, the invention can be applied to any configuration as long as it operates similarly.

It is to be noted that this embodiment mode is described with reference to the configurations shown in Embodiment Modes 1 and 2. However, the invention is not limited to this and various changes and modifications are possible unless such changes and modifications depart from the scope of the invention. Therefore, the descriptions in Embodiment Modes 1 and 2 can be applied to this embodiment mode.

Embodiment Mode 4

The configurations each including one current source circuit and one current source transistor are described above. Described in this embodiment mode is the case where a plurality of current source transistors are disposed.

Figure 27:
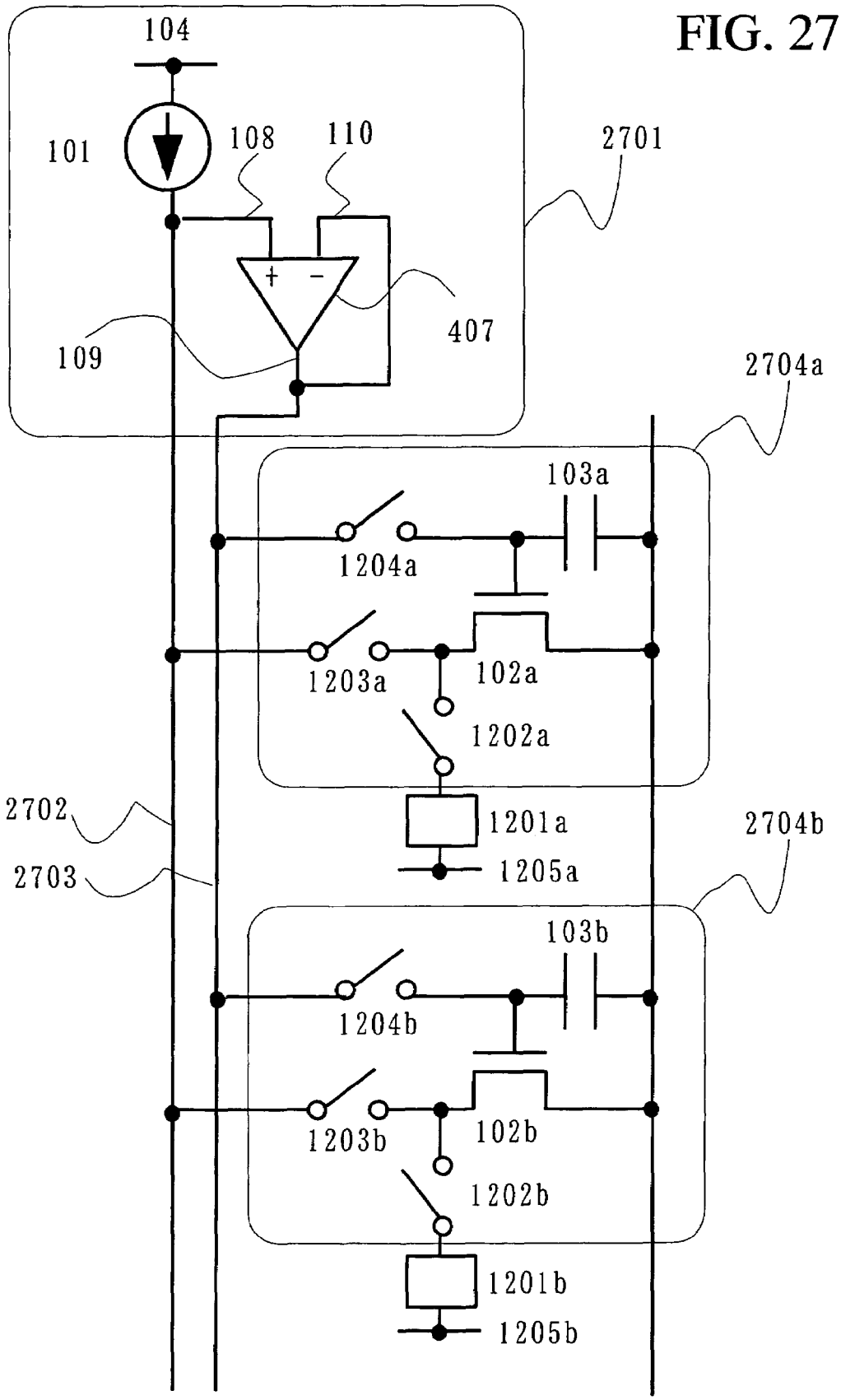
FIG. 27 is a diagram showing a configuration of the semiconductor device of the invention.

FIG. 27 shows a configuration corresponding to FIG. 13, in which a plurality of current source transistors are disposed. In FIG. 27, one current source circuit 101 and one operational amplifier 407 are disposed corresponding to a plurality of current source transistors. A plurality of current source circuits or a plurality of operational amplifiers may be disposed corresponding to a plurality of current source transistors. However, since the circuit scale increases, one current source circuit 101 and one operational amplifier 407 are preferably disposed.

A configuration of FIG. 27 is described next. First, the current source circuit 101 and the operational amplifier 407 are disposed, which are collectively called a resource circuit 2701 hereinafter. The resource circuit 2701 is connected to a current line 2702 connected to the current source circuit 101 and a voltage line 2703 connected to an output terminal of the operational amplifier 407. The current line 2702 and the voltage line 2703 are connected to a plurality of unit circuits. A unit circuit 2704*a* includes a current source transistor 102*a*, a capacitor element 103*a*, switches 1202*a*, 1203*a* and 1204*a*, and the like. The unit circuit 2704*a* is connected to a load 1201*a*. A unit circuit 2704*b* has a similar configuration to the unit circuit 2704*a*. The two unit circuits are connected herein for simplicity, though the invention is not limited to this. The number of unit circuits may be determined arbitrarily.

As for operations, since a plurality of unit circuits are connected to one current line 2702 and one voltage line 2703, each unit circuit is selected and a current and a voltage are sequentially supplied thereto from the resource circuit 2701 through the current line 2702 and the voltage line 2703. For example, the operation is carried out such that the switches 1203*a* and 1204*a* are turned on first to input a current and a voltage to the unit circuit 2704*a*, and switches 1203*b* and 1204*b* are turned on next to input a current and a voltage to the unit circuit 2704*b*.

These switches can be controlled by a digital circuit such as a shift register, a decoder circuit, a counter circuit, and a latch circuit.

In the case where the loads 1201*a*, 1201*b* and the like are display elements such as EL elements, the unit circuit and the load constitute one pixel, and the resource circuit 2701 corresponds to a (part of) signal line driver circuit that supplies a signal to a pixel connected to a signal line (current line or voltage line). In other words, FIG. 27 shows one column of pixels and a (part of) signal line driver circuit. In that case, a current outputted from the current source circuit 101 corresponds to an image signal. When this image signal current is changed in an analog manner or a digital manner, the proper amount of current can be supplied to each load (display element such as an EL element). At this time, the switches 1203*a* and 1204*a*, the switches 1203*b* and 1204*b*, and the like are controlled by a gate line driver circuit.

Further, in the case of the current source circuit 101 in FIG. 27 being a (part of) signal line driver circuit, the current source circuit 101 is required to output a current accurately without being influenced by variations in current characteristics and size of transistors. Accordingly, the current source circuit 101 in the (part of) signal line driver circuit is constituted by a current source transistor, and a current can be supplied from another current source circuit to the current source transistor. In other words, when the loads 1201*a*, 1201*b* and the like in FIG. 27 are a signal line, a pixel, or the like, a unit circuit constitutes a (part of) signal line driver circuit, and the resource circuit 2701 is a (part of) current source circuit that supplies a signal to a current source transistor (current source circuit) in the signal line driver circuit connected to a current line. That is, FIG. 27 shows a plurality of signal lines, a (part of) signal line driver circuit, and a (part of) current source circuit that supplies a current to the signal line driver circuit.

In this case, a current outputted from the current source circuit 101 corresponds to a current supplied to a signal line and a pixel. Therefore, in the case of, for instance, a current corresponding to a current outputted from the current source circuit 101 being supplied to a signal line and a pixel, the current outputted from the current source circuit 101 corresponds to an image signal. When this image signal current is changed in an analog manner or a digital manner, the proper amount of current can be supplied to each load (signal line and a pixel). At this time, the switches 1203*a* and 1204*a*, the switches 1203*b* and 1204*b*, and the like are controlled by a circuit (shift register, latch circuit and the like) that is a part of the signal line driver circuit.

It is to be noted that the circuit and the like (shift register, latch circuit and the like) for controlling the switches 1203*a* and 1204*a* and the switches 1203*b* and 1204*b* are disclosed in International Publication WO 03/038796, International Publication WO 03/038797, and the like. The invention can be implemented in combination with the descriptions thereof.

Alternatively, in the case of a predetermined amount of current being outputted from the current source circuit 101, a switch or the like being used for controlling whether to supply the current, and a current corresponding thereto being supplied to a signal line and a pixel, the current outputted from the current source circuit 101 corresponds to a signal current for supplying a predetermined amount of current. The switch for determining whether to supply a current to a signal line and a pixel is controlled in a digital manner to control the amount of current supplied to the signal line and the pixel, and thereby the proper amount of current can be supplied to each load (signal line and pixel). In that case, the switches 1203*a* and 1204*a*, the switches 1203*b* and 1204*b*, and the like are controlled by a circuit (shift register, latch circuit and the like) that is a part of a signal line driver circuit. At this time, however, a driver circuit (shift register, latch circuit and the like) is needed for controlling the switch that determines whether to supply a current to a signal line and a pixel. Accordingly, the driver circuit (shift register, latch circuit and the like) for controlling the switch is needed as well as a driver circuit (shift register, latch circuit and the like) for controlling the switches 1203*a* and 1204*a*, the switches 1203*b* and 1204*b*, and the like. These driver circuits may be provided separately. For example, a shift register for controlling the switches 1203*a* and 1204*a* and the switches 1203*b* and 1204*b* may be provided independently. Alternatively, the driver circuit (shift register, latch circuit and the like) for controlling the switch and the driver circuit (shift register, latch circuit and the like) for controlling the switches 1203*a* and 1204*a*, the switches 1203*b* and 1204*b*, and the like may be shared partially or entirely. For example, one shift register may be used for controlling both the switches, or an output (image signal) of a latch circuit and the like in a driver circuit (shift register, latch circuit and the like) may be used for controlling the switch that determines whether to supply a current to a signal line and a pixel.

It is to be noted that the driver circuit (shift register, latch circuit and the like) for controlling the switch that determines whether to supply a current to a signal line and a pixel and the driver circuit (shift register, latch circuit and the like) for controlling the switches 1203*a* and 1204*a*, the switches 1203*b* and 1204*b*, and the like are disclosed in International Publication WO 03/038793, International Publication WO 03/038794, International Publication WO 03/038795 and the like. The invention can be implemented in combination with the descriptions thereof.

FIG. 27 shows the case in which one current source transistor is disposed corresponding to one load. The case in which a plurality of current source transistors are disposed corresponding to one load is next shown in FIG. 28. Two unit circuits are connected to one load herein for simplicity, though the invention is not limited to this. Three or more unit circuits may be connected or a single unit circuit may be connected. The amount of current flowing to a load 1201*aa* can be controlled by turning on/off a switch 2801*aa* and a switch 2801*ba*. In the case of, for instance, a current value (Iaa) outputted from a unit circuit 2704*aa* being different from a current value (Iba) outputted from a unit circuit 2704*ba*, four different amounts of current flowing to the load 1201*aa* can be controlled by turning on/off the switch 2801*aa* and the switch 2801*ba*. For example, when Iba=2*Iaa is satisfied, the amount of current can be controlled by two bits. Therefore, in the case where the switch 2801*aa* and the switch 2801*ba* are turned on/off by digital data corresponding to each bit, a digital to analog conversion can be achieved by using the configuration shown in FIG. 28. Thus, in the case of the loads 1201*aa* and 1201*bb* being signal lines, a (part of) signal line driver circuit can be obtained by using the configuration shown in FIG. 28. In this case, a digital image signal can be converted into an analog image signal current. The switch 2801*aa* and the switch 2801*ba* can be turned on/off by an image signal. Accordingly, the switch 2801*aa* and the switch 2801*ba* can be controlled by a circuit (latch circuit) and the like for outputting an image signal.

The switch 2801*aa* and the switch 2801*ba* may be turned on/off temporally. For example, in a certain period, the switch 2801*aa* is turned on while the switch 2801*ba* is turned off, a current is set to be inputted from a resource circuit 2701*b* to the unit circuit 2704*ba* and outputted with accuracy, and a current is supplied from the unit circuit 2704*aa* to the load 1201*aa*. In another period, the switch 2801*aa* is turned off while the switch 2801*ba* is turned on, a current is set to be inputted from a resource circuit 2701*a* to the unit circuit 2704*aa* and outputted with accuracy, and a current is supplied from the unit circuit 2704*ba* to the load 1201*aa*. In this manner, the switches may be operated by switching temporally.

Figure 28:
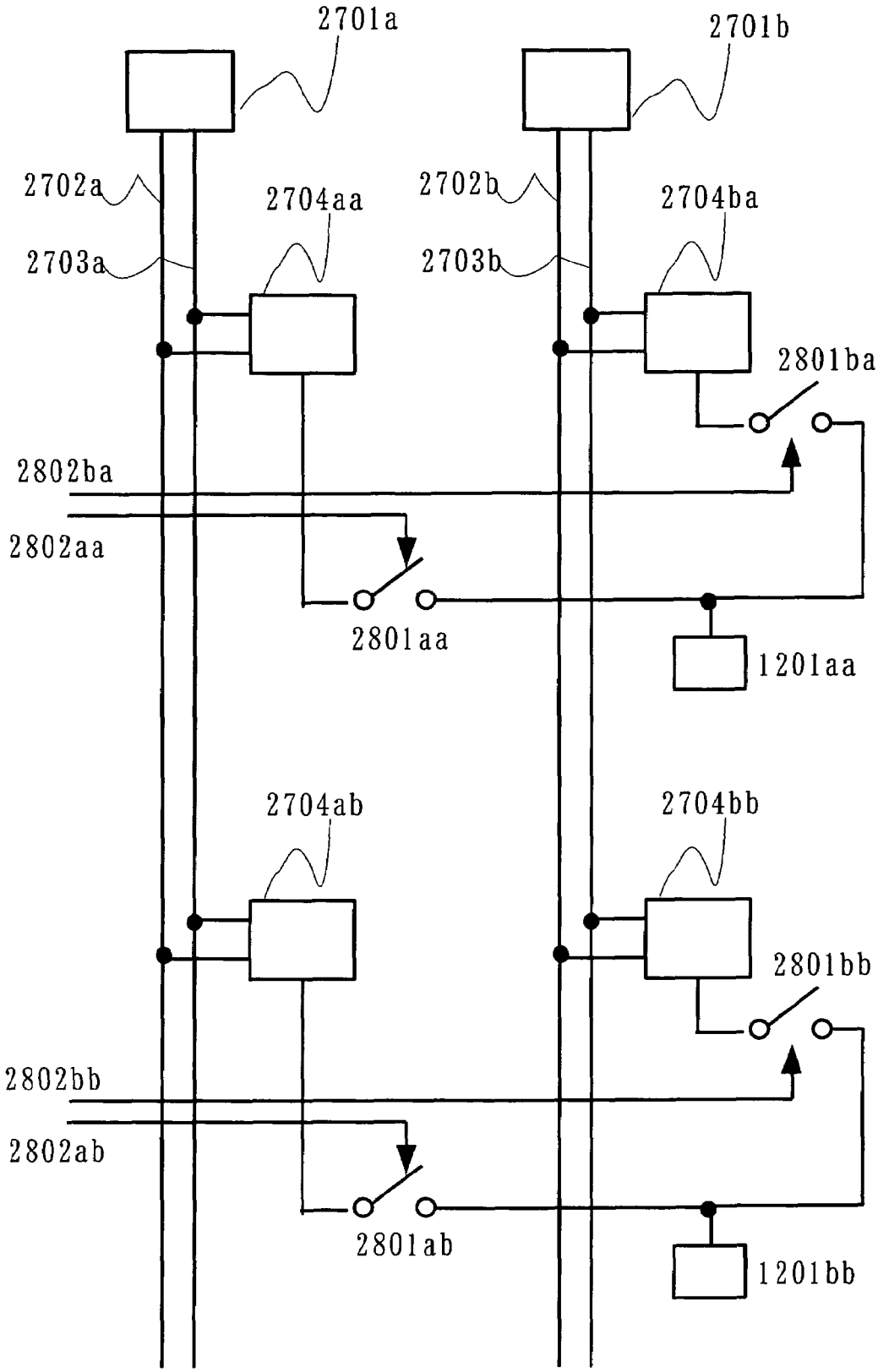
FIG. 28 is a diagram showing a configuration of the semiconductor device of the invention.
Figure 29:
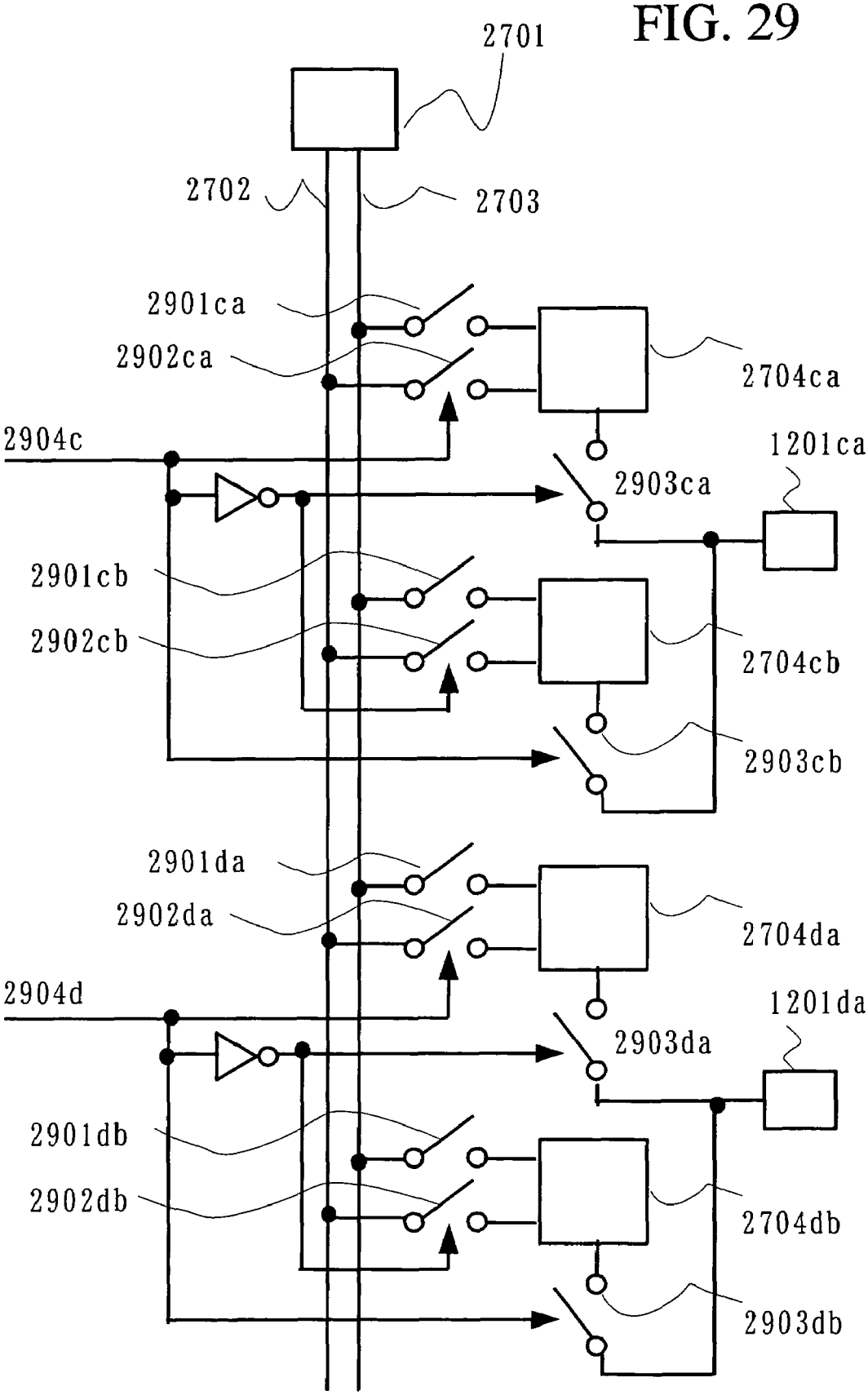
FIG. 29 is a diagram showing a configuration of the semiconductor device of the invention.

In FIG. 28, two resource circuits are used for supplying a current to unit circuits. FIG. 29 shows the case in which one resource circuit is used for supplying a current to unit circuits.

It is supposed that, for example, in the case of a wiring 2904*c* being an H signal, switches 2901*ca*, 2902*ca* and 2903*cb* are turned on while switches 2903*ca*, 2901*cb* and 292*cb* are turned off. Then, a unit circuit 2704*ca* becomes capable of being supplied with a current from the resource circuit 2701 whereas a unit circuit 2704*cb* becomes capable of supplying a current to a load 1201*ca*. On the contrary, in the case of the wiring 2904*c* being an L signal, the unit circuit 2704*cb* becomes capable of being supplied with a current from the resource circuit 2701 whereas the unit circuit 2704*ca* becomes capable of supplying a current to the load 1201*ca*. Further, the wiring 2904*c*, a wiring 2904*d* and the like may be selected in sequence by a signal. In this manner, the operation of a unit circuit may be switched temporally.

In the case of the loads 1201*ca* and 1201*da* being signal lines, a (part of) signal line driver circuit can be obtained by using the configuration shown in FIG. 29. In addition, the wiring 2904*c*, the wiring 2904*d* and the like may be controlled by a shift register and the like.

Although in this embodiment mode, the configuration including a plurality of current source transistors is shown with reference to the configuration shown in FIG. 13, the invention is not limited to this. The similar configuration can be achieved with reference to another configuration other than the one shown in FIG. 13.

It can be achieved with reference to the configuration shown in FIG. 9, for example. In that case, one current source circuit 101 and one amplifier circuit (source follower circuit) may be provided corresponding to a plurality of current source transistors. Alternatively, a plurality of current source circuits or a plurality of amplifier circuits (source follower circuits) may be disposed corresponding to a plurality of current source transistors. However, since the circuit scale increases, one current source circuit 101 and one amplifier circuit (source follower circuit) are preferably provided. Though, the amplifier circuit (source follower circuit) in FIG. 9 is constituted by two transistors in many cases, thus a plurality of amplifier circuits (source follower circuits) may be disposed corresponding to a plurality of current source transistors.

It is to be noted that this embodiment mode is described with reference to the configurations shown in Embodiment Modes 1, 2 and 3. However, the invention is not limited to this and various changes and modifications are possible unless such changes and modifications depart from the scope of the invention. Therefore, the descriptions in Embodiment Modes 1, 2 and 3 can be applied to this embodiment mode.

Embodiment Mode 5

Described in this embodiment mode is the case in which the invention is applied to a pixel having a display element.

Although this embodiment mode will be described with reference to the configurations shown in FIG. 1 (FIGS. 12, 2 and 5) and FIG. 3 (FIG. 8), the invention is not limited to this. This embodiment mode can be applied to various configurations shown in Embodiment Modes 1 to 4.

Figure 30:
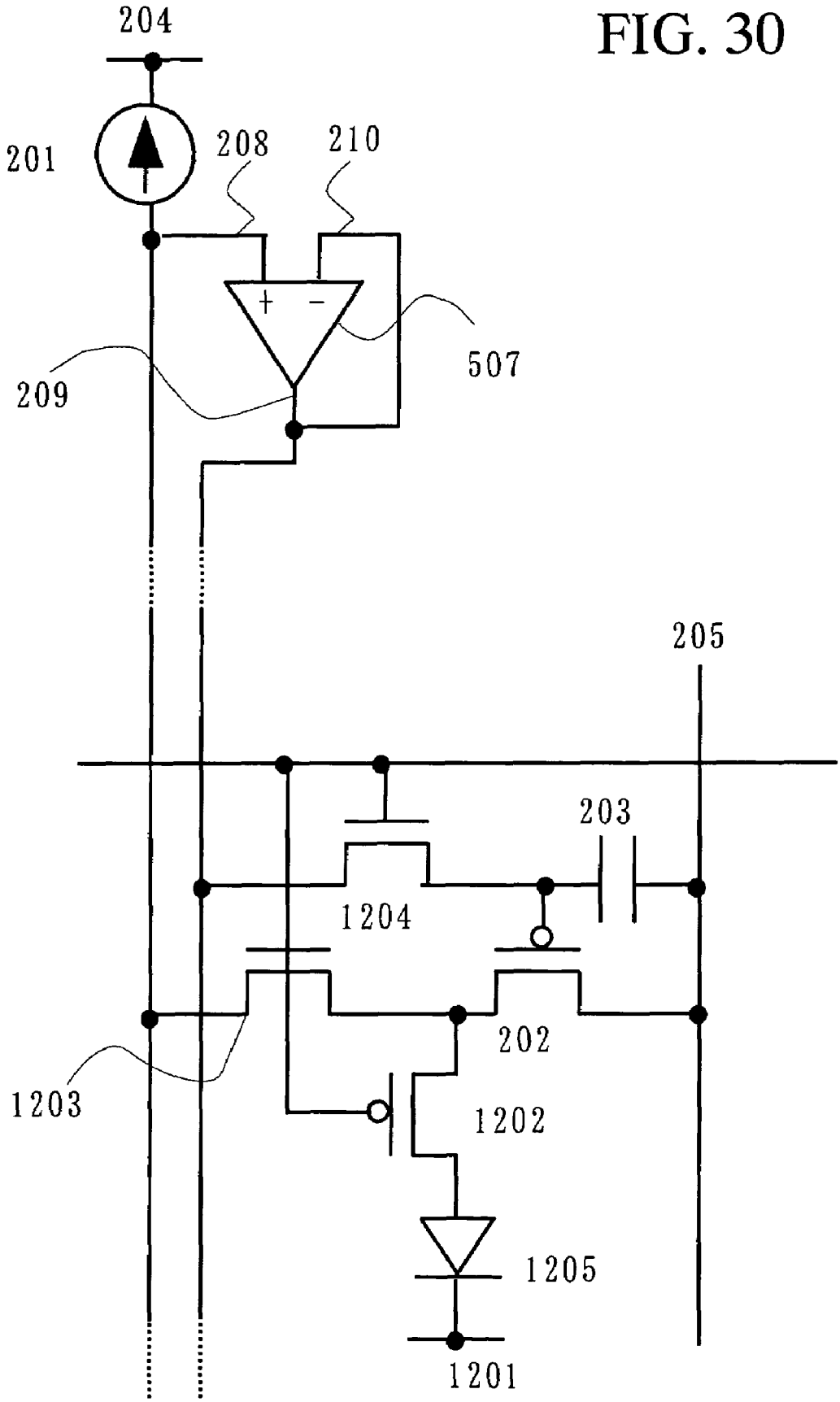
FIG. 30 is a diagram showing a configuration of the semiconductor device of the invention.
Figure 31:
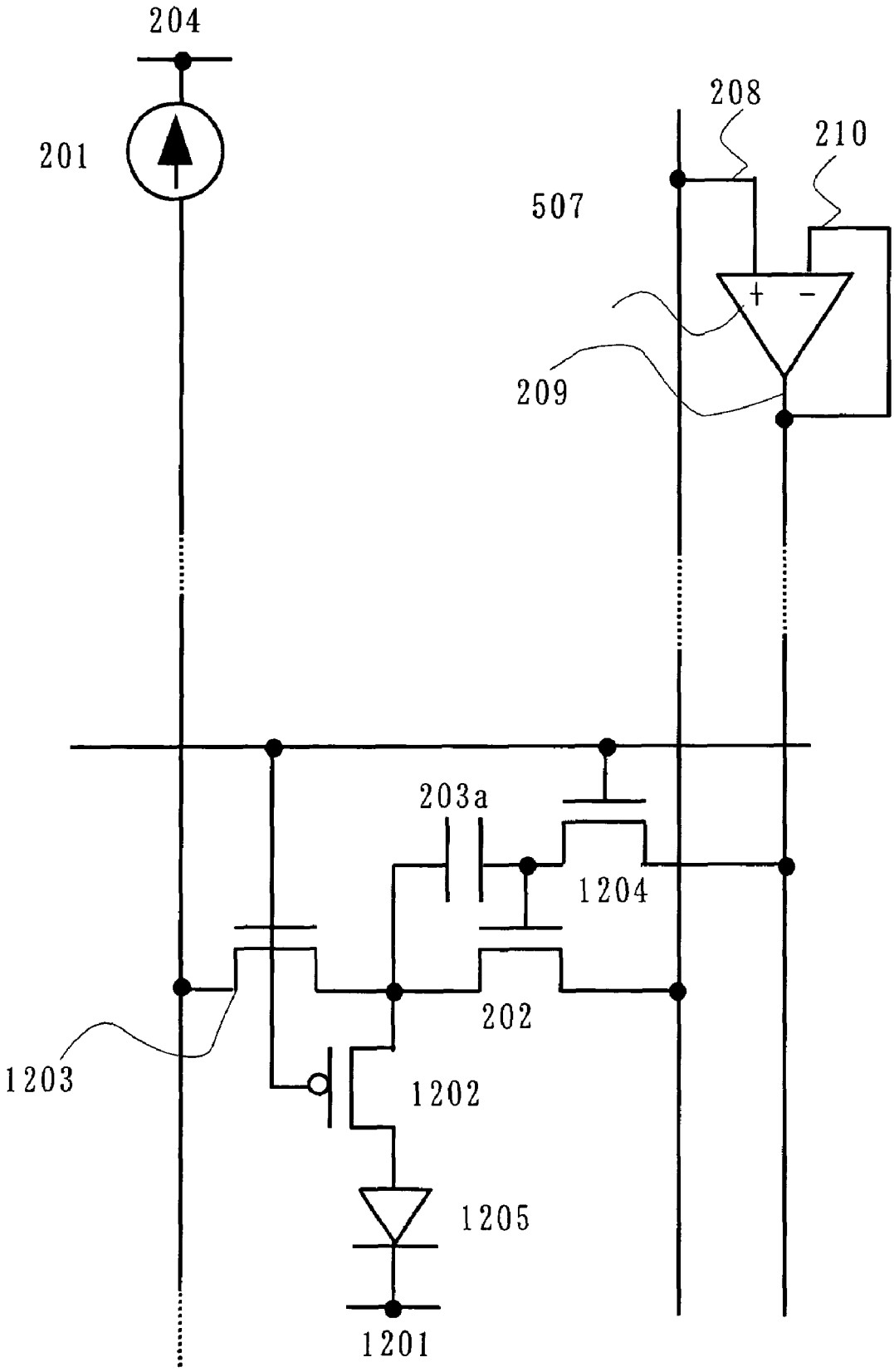
FIG. 31 is a diagram showing a configuration of the semiconductor device of the invention.

FIGS. 30 and 31 each shows a configuration in which the current source circuit 201 supplies a signal current as an image signal. The direction of current flow is the same in FIG. 30 and FIG. 31, though the polarity of transistors is different. Therefore, the connection is different in FIG. 30 and FIG. 31. Note that an EL element is taken as an example of a load herein.

When a signal current supplied as an image signal by the current source circuit 201 is an analog value, images can be displayed with analog gray scale. When a signal current is a digital value, images can be displayed with digital gray scale. In order to achieve multi-level gray scale, digital gray scale may be combined with a time gray scale method or an area gray scale method.

It is to be noted that the time gray scale method can be carried out in accordance with Japanese Patent Application No. 2001-5426, Japanese Patent Application No. 2000-86968 and the like, and the description thereof is omitted herein.

One gate line for controlling each switch is shared by adjusting the polarity of transistors. According to this, the aperture ratio can be improved, though respective gate lines may be disposed. In particular, when adopting the time gray scale method, a period in which a current is not supplied to a load (EL element) is needed. In that case, another wiring may be provided as a gate line for controlling a switch that can stop supplying a current to the load (EL element).

Figure 32:
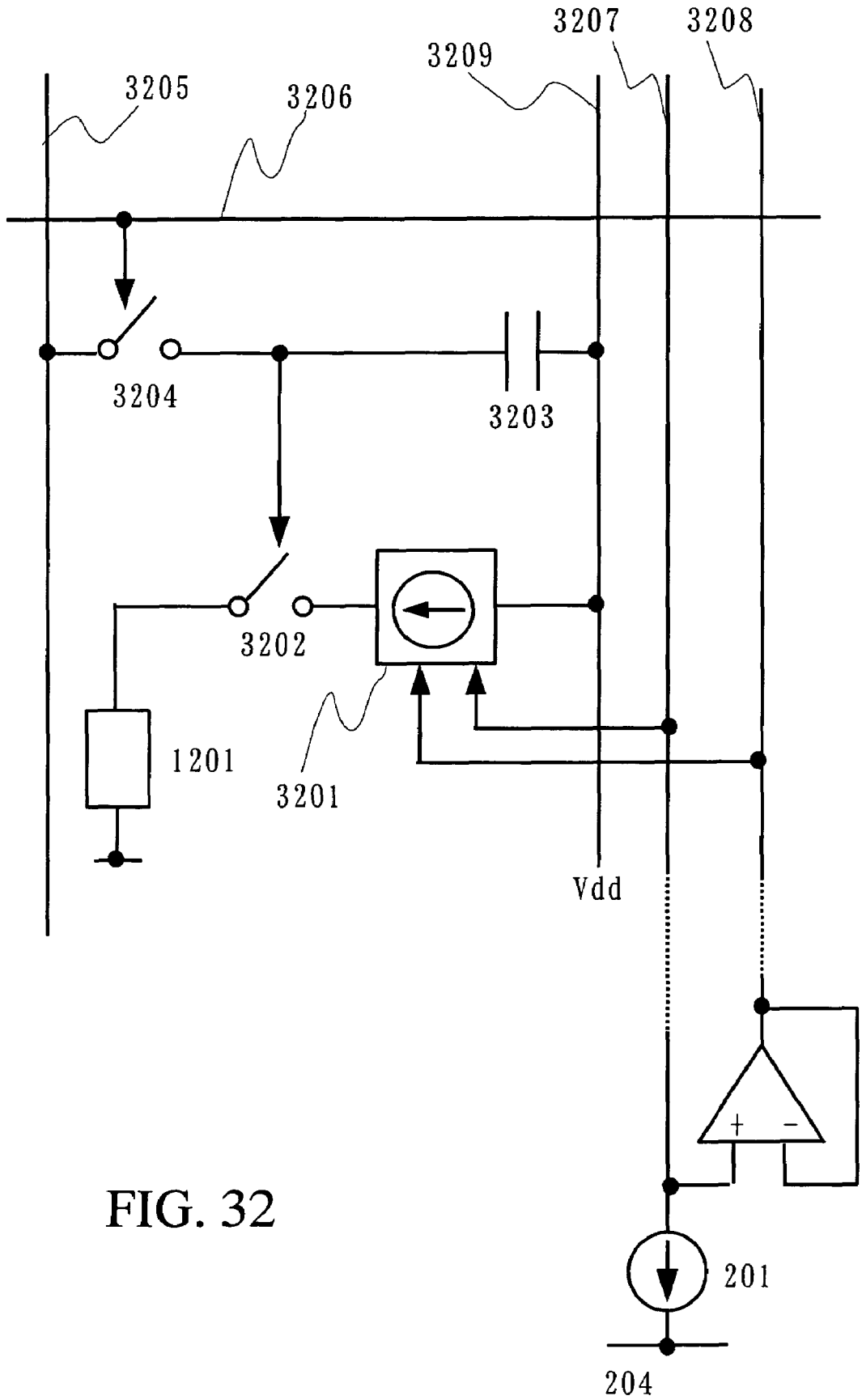
FIG. 32 is a diagram showing a configuration of the semiconductor device of the invention.

FIG. 32 shows a configuration of a pixel including a current source circuit, in which images are displayed in accordance with whether a current supplied by the current source circuit flows or not. When a selective gate line 3206 being selected, a digital image signal (a voltage value in general) is inputted from a signal line 3205 to a capacitor element 3203. It is to be noted that the capacitor element 3203 can be omitted when gate capacitance of a transistor is used instead. A switch 3202 is turned on/off by the held digital image signal. The switch 3202 controls whether a current supplied by a current source circuit 3201 flows to the load 1201 or not. As a result, images can be displayed.

In order to achieve multi-level gray scale, the time gray scale method and the area gray scale method may be adopted in combination.

Although one current source circuit 3201 and one switch 3202 are disposed in FIG. 32, the invention is not limited to this. A plurality of pairs of current source circuit and switch may be disposed to control whether a current from each current source circuit flows or not, and the sum of the current may flow to the load 1201.

Figure 33:
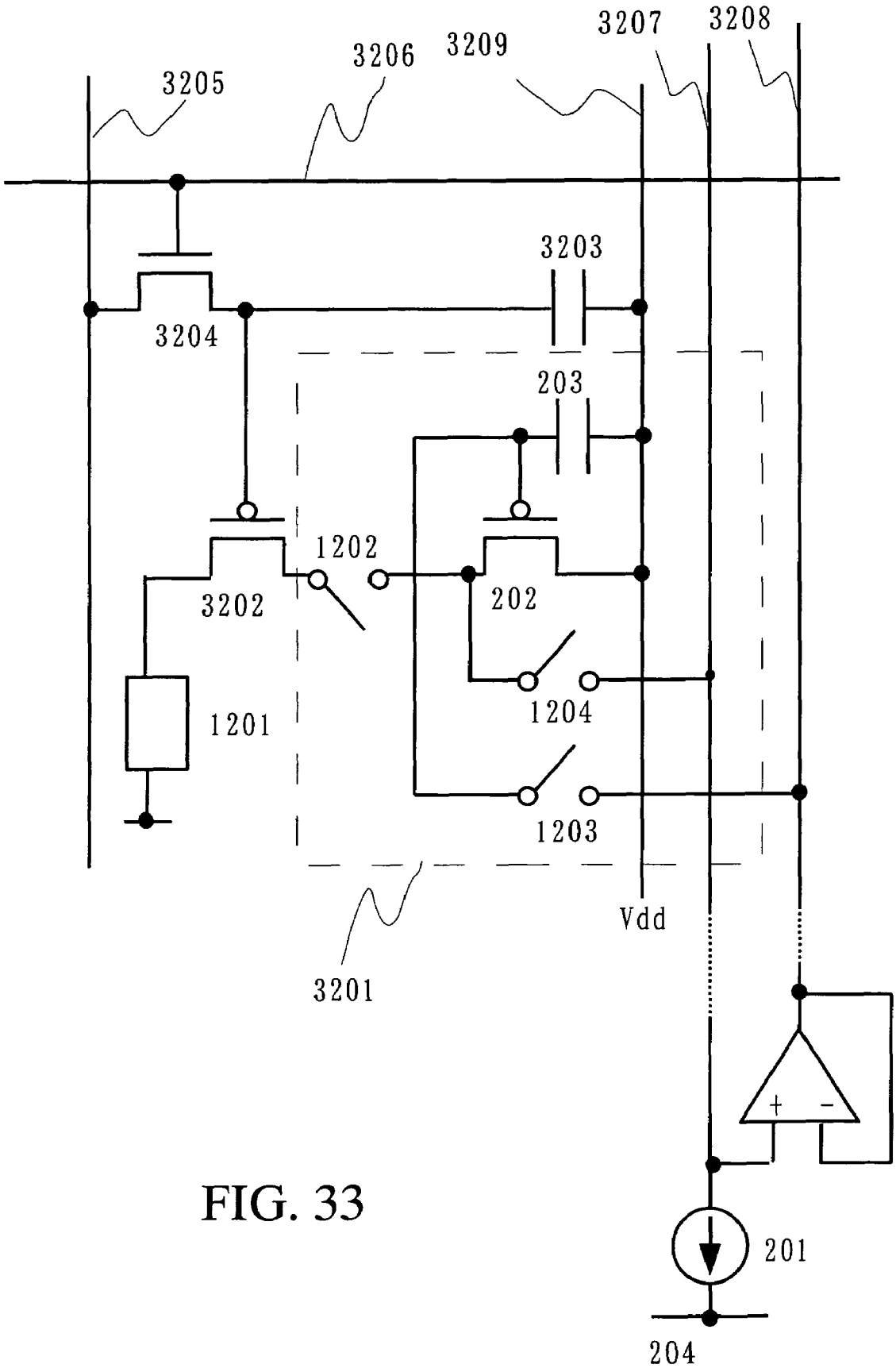
FIG. 33 is a diagram showing a configuration of the semiconductor device of the invention.

Next, a specific configuration example of FIG. 32 is shown in FIG. 33. The configuration shown in FIG. 1 (FIG. 12, FIG. 2 and FIG. 5) is adopted herein for a current source transistor. A current is supplied from the current source circuit 201 to the current source transistor 202, and the gate terminal of the current source transistor 202 is set to a proper voltage. Then, the switch 3202 is turned on/off in accordance with an image signal inputted from the signal line 3205 to supply a current to the load 1201, and thereby images are displayed.

It is to be noted that this embodiment mode is described with reference to the configurations shown in Embodiment Modes 1 to 4. However, the invention is not limited to this and various changes and modifications are possible unless such changes and modifications depart from the scope of the invention. Therefore, the descriptions in Embodiment Modes 1 to 4 can be applied to this embodiment mode.

Embodiment Mode 6

Described in this embodiment mode are configurations and operations of a display device, a signal line driver circuit and the like. The circuit of the invention can be applied to a part of a signal line driver circuit and a pixel.

Figure 34:
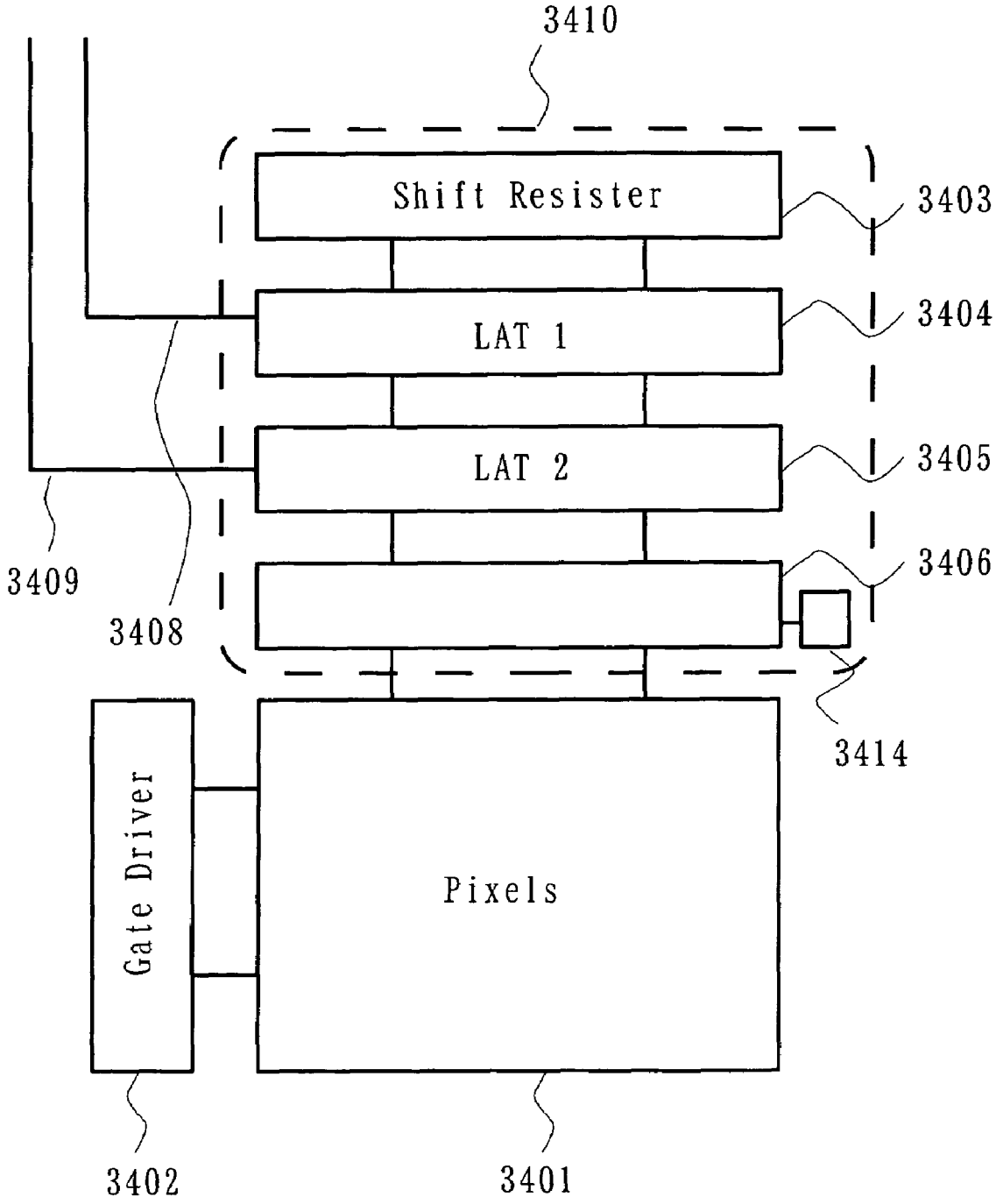
FIG. 34 is a diagram showing a configuration of the display device of the invention.

A display device comprises, as shown in FIG. 34, a pixel array 3401, a gate line driver circuit 3402 and a signal line driver circuit 3410. The gate line driver circuit 3402 sequentially outputs a selective signal to the pixel array 3401. The signal line driver circuit 3410 sequentially outputs a video signal to the pixel array 3401. In the pixel array 3401, a state of light is controlled depending on a video signal to display images. A video signal inputted from the signal line driver circuit 3410 to the pixel array 3401 is a current in many cases. In other words, a state of a display element and an element for controlling the display element that are disposed in each pixel changes in accordance with a video signal (current) inputted from the signal line driver circuit 3410. As a display element disposed in each pixel, an EL element, an element used for FED (Field Emission Display) and the like are taken as an example.

It is to be noted that a plurality of gate line driver circuits 3402 may be disposed as well as a plurality of signal line driver circuits 3410.

The signal line driver circuit 3410 can be divided into plural parts. It can be roughly divided, for instance, into a shift register 3403, a first latch circuit (LAT1) 3404, a second latch circuit (LAT2) 3405, and a digital to analog converter circuit 3406. The digital to analog converter circuit 3406 may have a function to convert a voltage to a current as well as a function to perform gamma correction. That is, the digital to analog converter circuit 3406 has a circuit for outputting a current (video signal) to a pixel, namely a current source circuit, and the invention can be applied thereto.

As shown in FIG. 32, depending on a pixel configuration, a digital voltage signal for video signal and a controlling current for a current source circuit in a pixel are required to be inputted to the pixel. In that case, the digital to analog converter circuit 3406 does not have a digital to analog conversion function but has a function to convert a voltage to a current, and has a circuit for outputting the current to a pixel as a controlling current, namely a current source circuit to which the invention can be applied.

Furthermore, a pixel includes a display element such as an EL element, and a circuit for outputting a current (video signal) to the display element, namely a current source circuit to which the invention can be applied.

An operation of the signal line driver circuit 3410 is briefly described. The shift register 3403 is constituted by a plurality of columns of flip flop circuits (FF) and the like, to which a clock signal (S-CLK), a start pulse (SP) and a clock inverting signal (S-CLKb) are inputted. In accordance with the timing of these signals, a sampling pulse is outputted in sequence.

The sampling pulse outputted from the shift register 3403 is inputted to the first latch circuit (LAT1) 3404. In accordance with the timing of the sampling pulse, the first latch circuit (LAT1) 3404 holds a video signal in each column, which has been inputted from a video signal line 3408. It is to be noted that in the case of the digital to analog converter circuit 3406 being disposed, the video signal is a digital value. The video signal at this time is a voltage in many cases.

In the case of the first latch circuit 3404 and the second latch circuit 3405 being circuits that can hold an analog value, the digital to analog converter circuit 3406 can be omitted in many cases. In that case, the video signal may be a current. Further, in the case of data outputted to the pixel array 3401 being binary data, that is, a digital value, the digital to analog converter circuit 3406 can be omitted in many cases.

When the holding of video signals is completed until the last column in the first latch circuit (LAT1) 3404, a latch pulse (Latch Pulse) is inputted from a latch control line 3409 during a horizontal flyback period, and the video signals held in the first latch circuit (LAT1) 3404 are transferred to the second latch circuit (LAT2) 3405 at a time. Then, the video signals held in the second latch circuit (LAT2) 3405 are inputted to the digital to analog converter circuit 3406 per each row. Signals outputted from the digital to analog converter circuit 3406 are inputted to the pixel array 3401.

During a period in which the video signals held in the second latch circuit (LAT2) 3405 are inputted to the digital to analog converter circuit 3406 and then to the pixel array 3401, the shift register 3403 outputs a sampling pulse newly. That is, the two operations are carried out at the same time. According to this, a line sequential driving becomes possible. These operations are repeated thereafter.

In the case of a current source circuit included in the digital to analog converter circuit 3406 being a circuit that performs a setting operation and an output operation, that is, a circuit inputted with a current from another current source circuit and capable of outputting a current without being influenced by variations in characteristics of transistors, a circuit for supplying a current to the current source circuit is required. In that case, a reference current source circuit 3414 is disposed.

Figure 35:
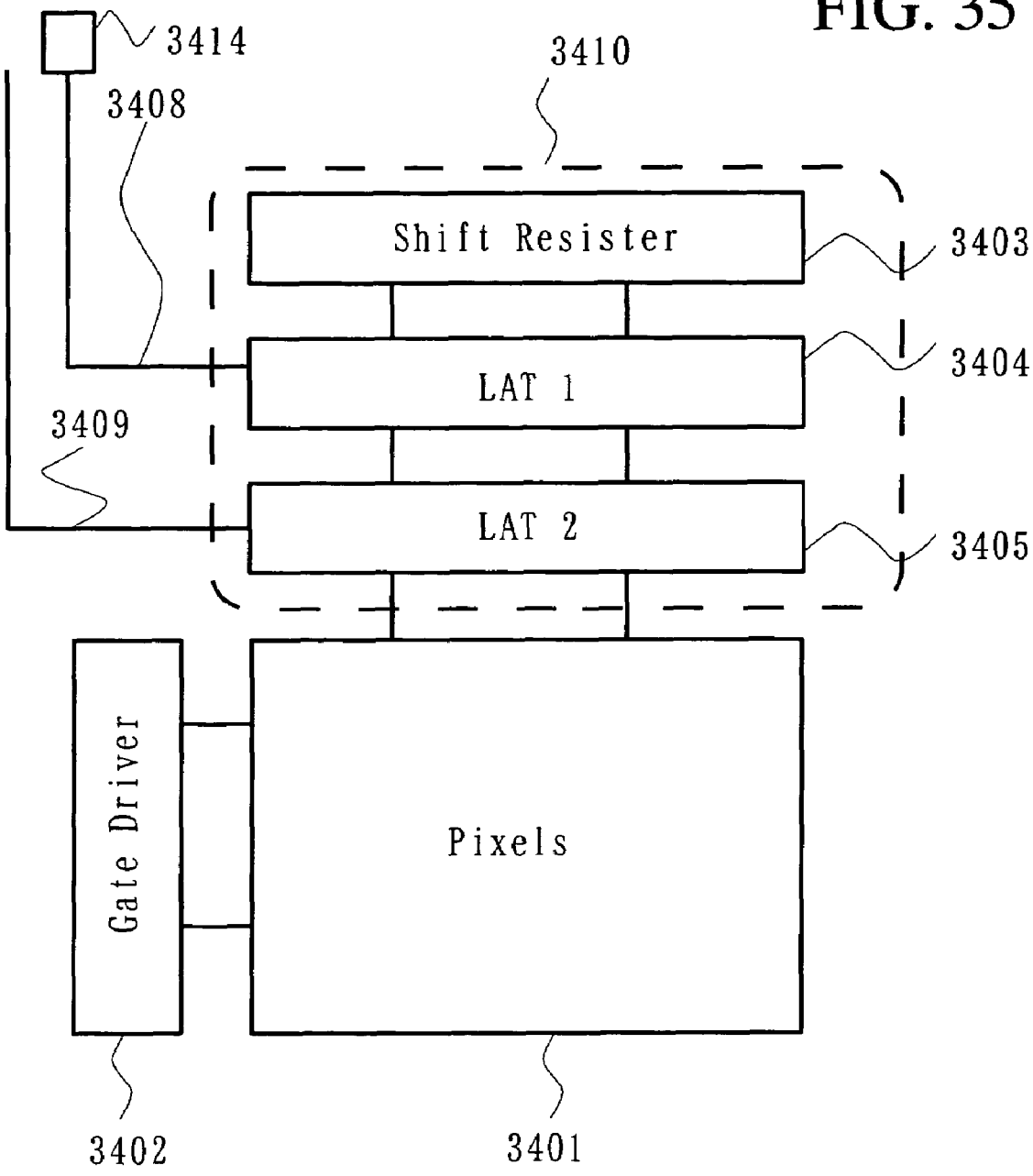
FIG. 35 is a diagram showing a configuration of the display device of the invention.

As set forth above, any type of transistor may be used for the transistor in the invention and the transistor may be formed on any type of substrate. Accordingly, the circuits shown in FIG. 34, FIG. 35 and the like may be formed on a glass substrate, a plastic substrate, a single crystalline substrate, an SOI substrate or other substrates. Alternatively, a part of the circuits shown in FIG. 34, FIG. 35 and the like may be formed on a substrate, and the other part of the circuits shown in FIG. 34, FIG. 35 and the like may be formed on another substrate. In other words, not all the circuits shown in FIG. 34, FIG. 35 and the like are required to be formed on the same substrate. In FIG. 34, FIG. 35 and the like, for example, the pixel array 3401 and the gate line driver circuit 3402 may be formed on a glass substrate by using TFTs, the signal line driver circuit 3410 (or a part of the same) may be formed on a single crystalline substrate, and an IC chip thereof may be connected by COG (Chip On Glass) to be disposed on the glass substrate. Alternatively, the IC chip may be connected to the glass substrate by TAB (Tape Auto Bonding) or a printed substrate.

It is to be noted that configurations of the signal line driver circuit and the like are not limited to the ones shown in FIG. 34.

For example, in the case of the first latch circuit 3404 and the second latch circuit 3405 being circuits that can hold an analog value, as shown in FIG. 35, a video signal (analog current) may be inputted from the reference current source circuit 3414 to the first latch circuit (LAT1) 3404. Further, in FIG. 35, the second latch circuit 3405 may be omitted. In that case, the first latch circuit 3404 often includes more current source circuits.

In such a case, the invention can be applied to a current source circuit in the digital to analog converter circuit 3406 shown in FIG. 34. The digital to analog converter circuit 3406 comprises a lot of unit circuits, and the reference current source circuit 3414 includes the current source circuit 101 and the amplifier circuit 107.

The invention can also be applied to a current source circuit in the first latch circuit (LAT1) 3404 shown in FIG. 35. The first latch circuit (LAT1) 3404 comprises a lot of unit circuits, and the reference current source circuit 3414 includes a basic current source 101 and an additional current source 103.

Furthermore, the invention can be applied to a pixel (current source circuit included therein) in the pixel array 3401 shown in FIG. 34 and FIG. 35. The pixel array 3401 comprises a lot of unit circuits, and the signal line driver circuit 3410 includes the current source circuit 101 and the amplifier circuit 107.

Figure 36:
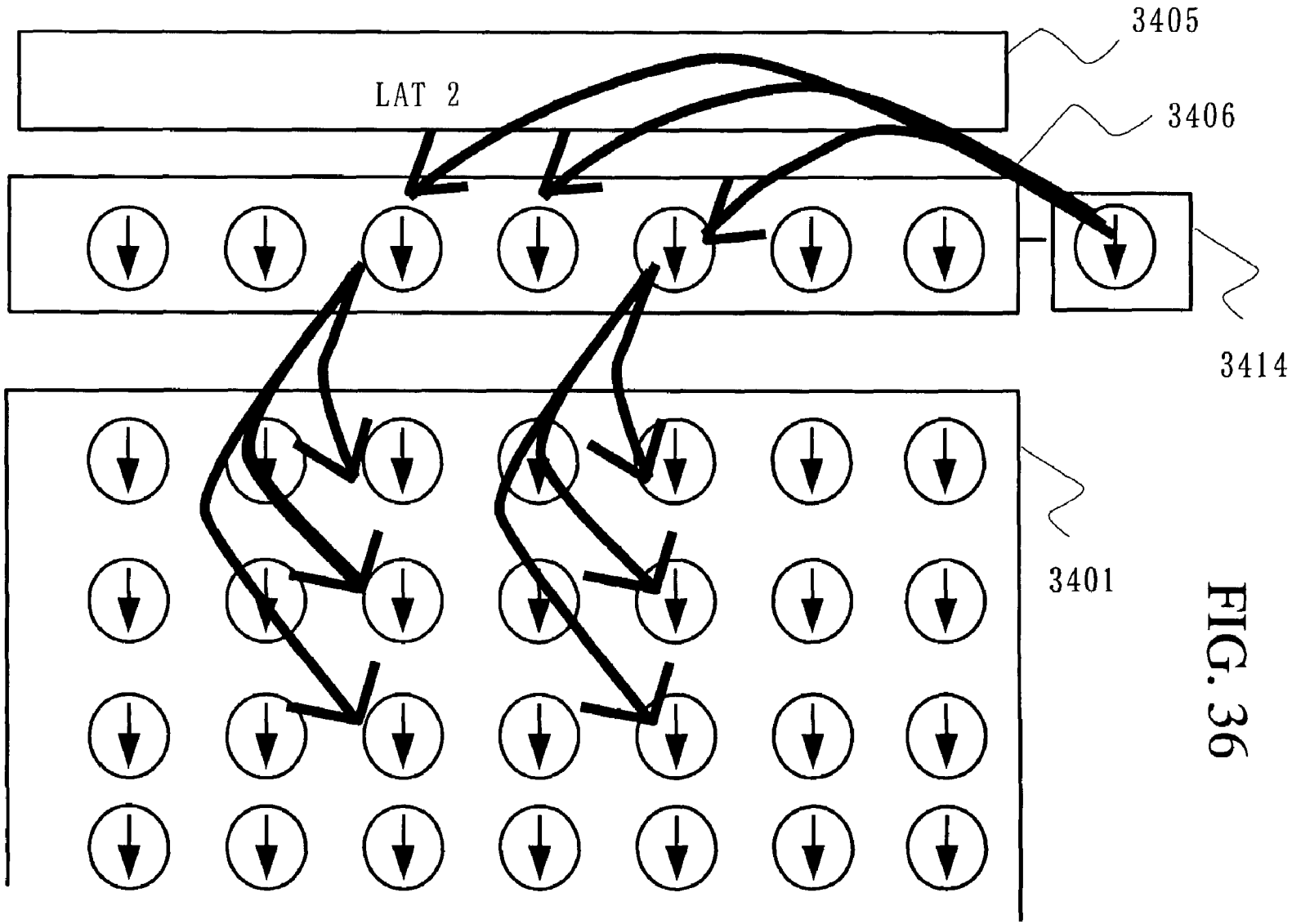
FIG. 36 is a diagram showing an operation of the display device of the invention.
Figure 37:
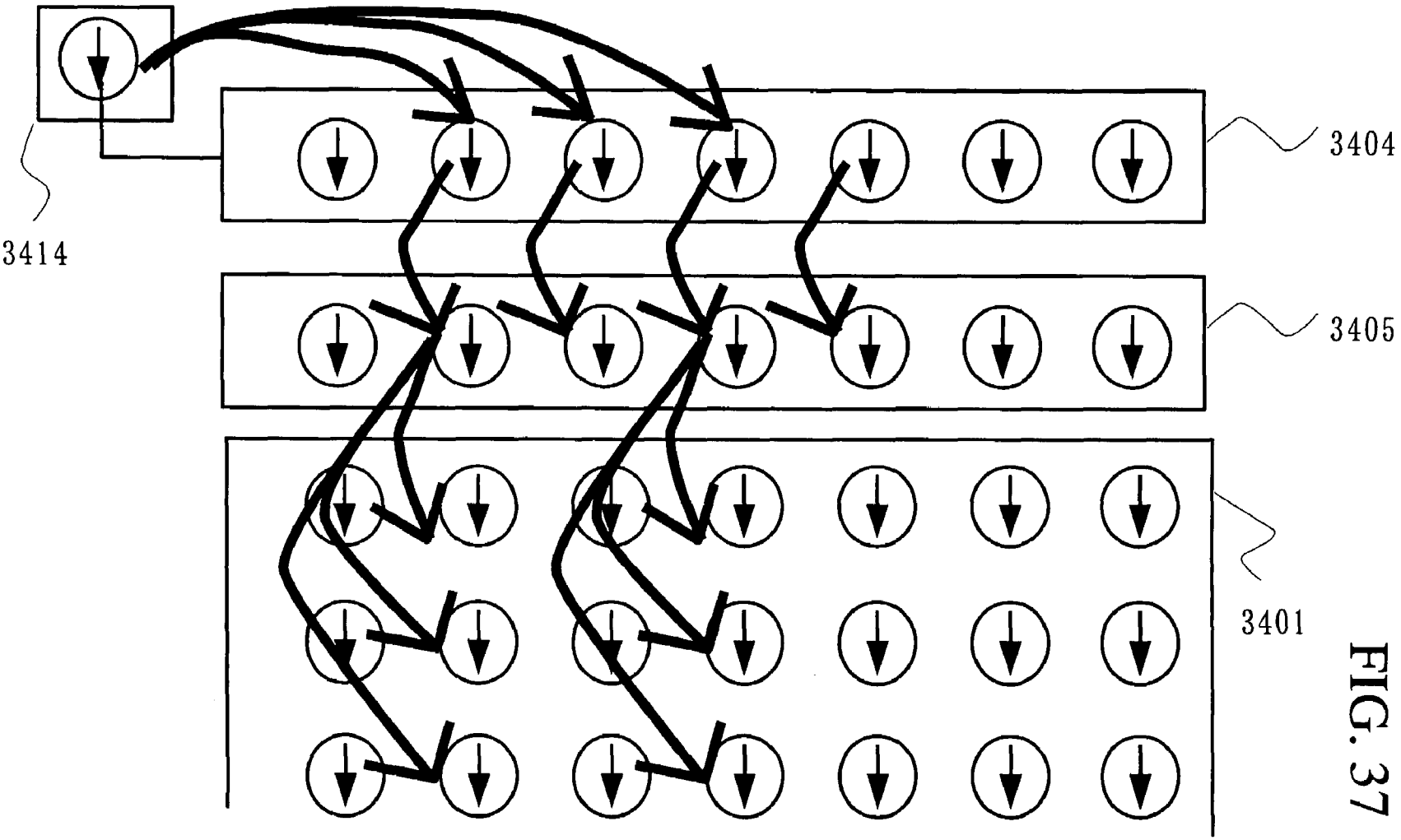
FIG. 37 is a diagram showing an operation of the display device of the invention.
Figure 38:
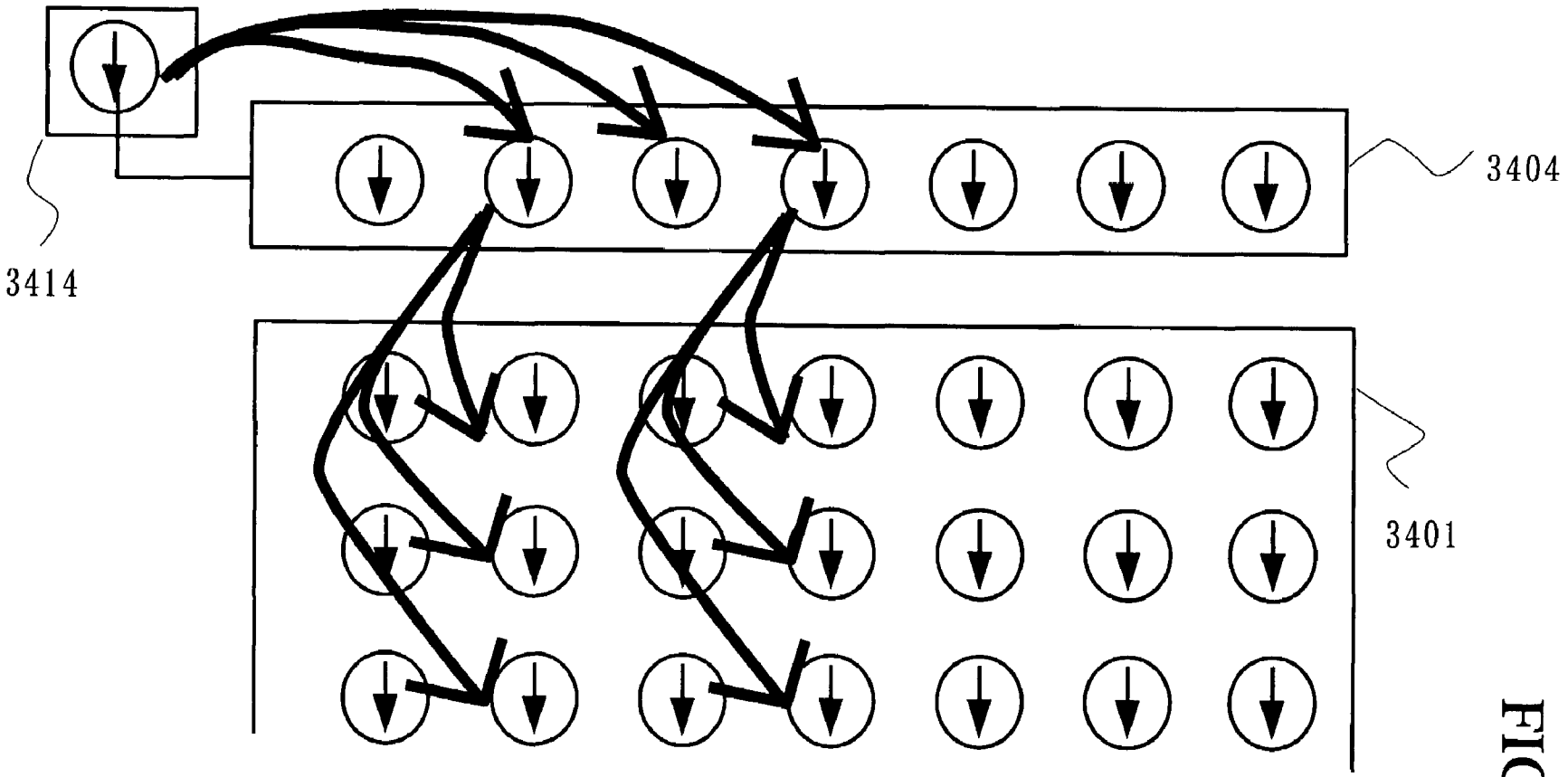
FIG. 38 is a diagram showing an operation of the display device of the invention.

That is, a circuit for supplying a current is disposed throughout a circuit. Such current source circuit is required to output a current with accuracy. Therefore, another current source circuit is used for setting a transistor to output a current with accuracy. The another current source circuit is also required to output a current with accuracy. Thus, as shown in FIGS. 36 to 38, a basic current source circuit is disposed in a certain area, then current source transistors are set in sequence. According to this, a current source circuit can output a proper current, to which the invention can be applied.

When performing a setting operation of a current source circuit, the timing thereof is required to be controlled. In this case, a specific driver circuit (shift register and the like) may be provided in order to control the setting operation. Alternatively, the setting operation of a current source circuit may be controlled by a signal outputted from a shift register for controlling the LAT1 circuit. That is, one shift register may be used for controlling both the LAT1 circuit and the current source circuit. In that case, a signal outputted from the shift register for controlling the LAT1 circuit may be inputted directly to the current source circuit. Alternatively, in order to separate between a control of the LAT1 circuit and a control of the current source circuit, the current source circuit may be controlled through a circuit for controlling the separation. The setting operation of the current source circuit may also be controlled by a signal outputted from the LAT2 circuit. The signal outputted from the LAT2 circuit is a video signal in general, therefore, in order to separate between the case of using as a video signal and the case of controlling the current source circuit, the current source circuit may be controlled through a circuit for controlling the separation. The circuit configuration for controlling the setting operation and the output operation, the operation of the circuit, and the like are disclosed in International Publication WO 03/038793, International Publication WO 03/038794, and International Publication WO 03/038795, and the descriptions thereof can be applied to the invention.

It is to be noted that this embodiment mode is described with reference to the configurations shown in Embodiment Modes 1 to 5. Therefore, the descriptions in Embodiment Modes 1 to 5 can be applied to this embodiment mode.

Embodiment Mode 7

Figure 39:
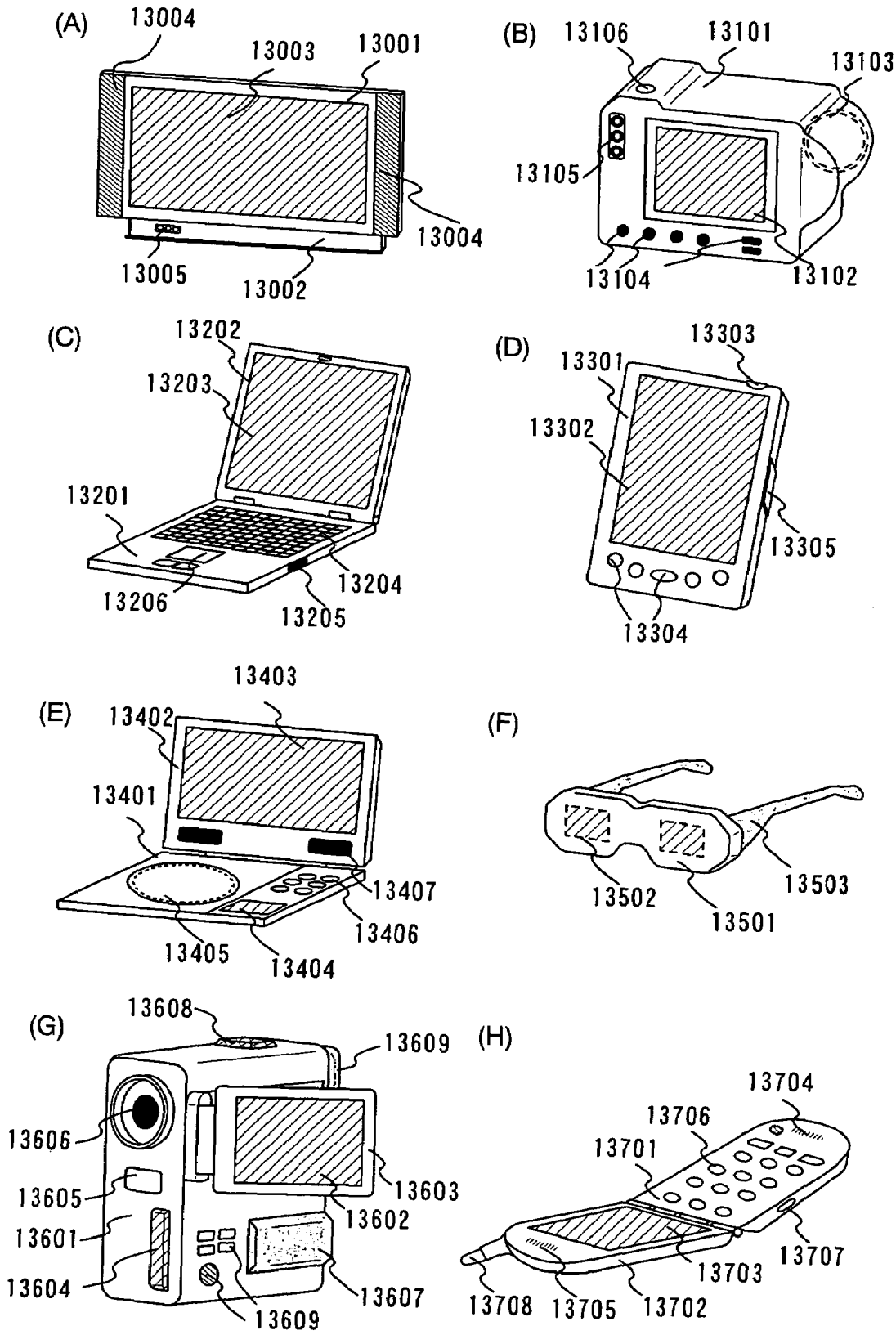
FIG. 39 shows electronic apparatuses to which the invention can be applied.

The invention can be applied to a circuit constituting a display portion of electronic apparatuses. Such electronic apparatuses include a video camera, a digital camera, a goggle type display (head mounted display), a navigation system, an audio reproducing device (an in-car audio system, an audio component set, and the like), a laptop personal computer, a game player, a portable information terminal (a mobile computer, a mobile phone, a portable game player, an electronic book, and the like), an image reproducing device provided with a recording medium (specifically, a device that reproduces a recording medium such as a Digital Versatile Disc (DVD) and includes a display capable of displaying the reproduced images), and the like. That is, the invention can be applied to a pixel constituting a display portion of these apparatuses, a signal line driver circuit for driving the pixel, and the like. Specific examples of these electronic apparatuses are shown in FIG. 39.

FIG. 39A shows a light emitting device (the light emitting device means here a display device using a self-luminous type light emitting element for a display portion) that includes a housing 13001, a supporting base 13002, a display portion 13003, speaker portions 13004, a video input terminal 13005, and the like. The invention can be applied to a pixel that constitutes the display portion 13003, a signal line driver circuit and the like. Further, according to the invention, the light emitting device shown in FIG. 39A is completed. Since the light emitting device is a self-luminous type, it requires no backlight, and thereby the display portion thereof can be made thinner than a liquid crystal display. Note that the light emitting device refers to all display devices for displaying information, including ones for personal computers, for TV broadcasting reception, and for advertisement.

FIG. 39B shows a digital still camera that includes a main body 13101, a display portion 13102, an image receiving portion 13103, operating keys 13104, an external connecting port 13105, a shutter 13106, and the like. The invention can be applied to a pixel that constitutes the display portion 13102, a signal line driver circuit and the like. Further, according to the invention, the digital still camera shown in FIG. 39B is completed.

FIG. 38C shows a laptop personal computer that includes a main body 13201, a housing 13202, a display portion 13203, a keyboard 13204, an external connecting port 13205, a pointing mouse 13206, and the like. The invention can be applied to a pixel that constitutes the display portion 13203, a signal line driver circuit and the like. Further, according to the invention, the light emitting device shown in FIG. 39C is completed.

FIG. 38D shows a mobile computer that includes a main body 13301, a display portion 13302, a switch 13303, operating keys 13304, an infrared port 13305, and the like. The invention can be applied to a pixel that constitutes the display portion 13302, a signal line driver circuit and the like. Further, according to the invention, the mobile computer shown in FIG. 39D is completed.

FIG. 38E shows a portable image reproducing device provided with a recording medium (specifically a DVD reproducing device), that includes a main body 13401, a housing 13402, a display portion A13403, a display portion B13404, a recording medium (such as a DVD) reading portion 13405, an operating key 13406, a speaker portion 13407, and the like. The display portion A13403 displays mainly image data whereas the display portion B13404 displays mainly character data. The invention can be applied to a pixel that constitutes the display portions A13403 and B13404, a signal line driver circuit and the like. It is to be noted that the image reproducing device provided with a recording medium includes a home game player and the like. Further, according to the invention, the DVD reproducing device shown in FIG. 39E is completed.

FIG. 39F shows a goggle type display (head mounted display) that includes a main body 13501, a display portion 13502, and an arm portion 13503. The invention can be applied to a pixel that constitutes the display portion 13502, a signal line driver circuit and the like. Further, according to the invention, the goggle type display shown in FIG. 39F is completed.

FIG. 39G shows a video camera that includes a main body 13601, a display portion 13602, a housing 13603, an external connecting port 13604, a remote control receiving portion 13605, an image receiving portion 13606, a battery 13607, an audio input portion 13608, operating keys 13609, and the like. The invention can be applied to a pixel that constitutes the display portion 13602, a signal line driver circuit and the like. Further, according to the invention, the video camera shown in FIG. 39G is completed.

FIG. 39H shows a mobile phone that includes a main body 13701, a housing 13702, a display portion 13703, an audio input portion 13704, an audio output portion 13705, an operating key 13706, an external connecting port 13707, an antenna 13708, and the like. The invention can be applied to a pixel that constitutes the display portion 13703, a signal line driver circuit and the like. It is to be noted that current consumption of the mobile phone can be suppressed when the display portion 13703 displays white characters on a black background. Further, according to the invention, the mobile phone shown in FIG. 39H is completed.

When the luminance of the light emitting material is improved in the future, it can be used for a front type or rear type projector by magnifying and projecting outputted light including image data by a lens and the like.

The aforementioned electronic apparatuses are becoming to be more used for displaying data distributed through a telecommunication path such as Internet and a CATV (Cable Television System), and in particular used for displaying moving pictures. The light emitting device is suitable for displaying moving pictures because the light emitting material can exhibit a remarkably high response.

Since light emitting parts consume power in a light emitting device, data is desirably displayed so that the light emitting parts may occupy as small area as possible. Accordingly, in the case of a light emitting device being adopted for a display portion that mainly displays character data, such as the one of a portable information terminal, particularly the one of a mobile phone or an audio reproducing device, it is preferably operated so that the character data emits light by using non-light emitting parts as background.

As set forth above, the application range of the invention is so wide that it can be applied to electronic apparatuses of all fields. In addition, the electronic apparatuses shown in this embodiment mode may include a semiconductor device with any one of the configurations shown in Embodiment Modes 1 to 4.

The invention claimed is:

1. A semiconductor device comprising:

a circuit in which a current supplied to a load is controlled by a transistor; and an amplifier circuit connected between a drain terminal and a gate terminal of the transistor for controlling the transistor to operate in a saturation region when a current is supplied from a current source circuit to the transistor, wherein one of a source terminal and a drain terminal of the transistor is connected to the current source circuit, and wherein the other of the source terminal and the drain terminal of the transistor is connected to the load.

2. A light emitting device that has a display portion using the semiconductor device according to claim 1.

3. A digital still camera that has a display portion using the semiconductor device according to claim 1.

4. A laptop personal computer that has a display portion using the semiconductor device according to claim 1.

5. A mobile computer that has a display portion using the semiconductor device according to claim 1.

6. An image reproducing device that has a display portion using the semiconductor device according to claim 1.

7. A goggle type display that has a display portion using the semiconductor device according to claim 1.

8. A video camera that has a display portion using the semiconductor device according to claim 1.

9. A mobile phone that has a display portion using the semiconductor device according to claim 1.

10. A semiconductor device comprising:

a circuit in which a current supplied to a load is controlled by a transistor; and an amplifier circuit connected between a drain terminal and a gate terminal of the transistor, for stabilizing a potential between the drain terminal and the gate terminal of the transistor, wherein one of a source terminal and the drain terminal of the transistor is connected to a current source circuit, and wherein the other of the source terminal and the drain terminal of the transistor is connected to the load.

11. A light emitting device that has a display portion using the semiconductor device according to claim 10.

12. A digital still camera that has a display portion using the semiconductor device according to claim 10.

13. A laptop personal computer that has a display portion using the semiconductor device according to claim 10.

14. A mobile computer that has a display portion using the semiconductor device according to claim 10.

15. An image reproducing device that has a display portion using the semiconductor device according to claim 10.

16. A goggle type display that has a display portion using the semiconductor device according to claim 10.

17. A video camera that has a display portion using the semiconductor device according to claim 10.

18. A mobile phone that has a display portion using the semiconductor device according to claim 10.

19. A semiconductor device comprising:

a circuit in which a current supplied to a load is controlled by a transistor; and a feedback circuit comprising an amplifier circuit, connected between a drain terminal and a gate terminal of the transistor, for stabilizing a potential between the drain terminal and the gate terminal of the transistor, wherein one of a source terminal and the drain terminal of the transistor is connected to a current source circuit, and wherein the other of the source terminal and the drain terminal of the transistor is connected to the load.

20. A light emitting device that has a display portion using the semiconductor device according to claim 19.

21. A digital still camera that has a display portion using the semiconductor device according to claim 19.

22. A laptop personal computer that has a display portion using the semiconductor device according to claim 19.

23. A mobile computer that has a display portion using the semiconductor device according to claim 19.

24. An image reproducing device that has a display portion using the semiconductor device according to claim 19.

25. A goggle type display that has a display portion using the semiconductor device according to claim 19.

26. A video camera that has a display portion using the semiconductor device according to claim 19.

27. A mobile phone that has a display portion using the semiconductor device according to claim 19.

28. A semiconductor device comprising:

a transistor, a source or a drain of which is connected to a current source circuit, for controlling a current supplied to a load; and an operational amplifier, wherein a non-inverting input terminal of the operational amplifier is connected to a drain terminal of the transistor;

an inverting input terminal of the operational amplifier is connected to a gate terminal of the transistor; and an output terminal of the operational amplifier is connected to the gate terminal and the inverting input terminal.

29. A light emitting device that has a display portion using the semiconductor device according to claim 28.

30. A digital still camera that has a display portion using the semiconductor device according to claim 28.

31. A laptop personal computer that has a display portion using the semiconductor device according to claim 28.

32. A mobile computer that has a display portion using the semiconductor device according to claim 28.

33. An image reproducing device that has a display portion using the semiconductor device according to claim 28.

34. A goggle type display that has a display portion using the semiconductor device according to claim 28.

35. A video camera that has a display portion using the semiconductor device according to claim 28.

36. A mobile phone that has a display portion using the semiconductor device according to claim 28.

37. A semiconductor device comprising:

a transistor, a source or a drain of which is connected to a current source circuit, for controlling a current supplied to a load; and a voltage follower circuit, wherein an input terminal of the voltage follower circuit is connected to a drain terminal of the transistor; and an output terminal of the voltage follower circuit is connected to a gate terminal of the transistor.

38. The semiconductor device according to claim 37, wherein the voltage follower circuit is constituted by a source follower circuit.

39. A light emitting device that has a display portion using the semiconductor device according to claim 37.

40. A light emitting device that has a display portion using the semiconductor device according to claim 38.

41. A digital still camera that has a display portion using the semiconductor device according to claim 37.

42. A digital still camera that has a display portion using the semiconductor device according to claim 38.

43. A laptop personal computer that has a display portion using the semiconductor device according to claim 37.

44. A laptop personal computer that has a display portion using the semiconductor device according to claim 38.

45. A mobile computer that has a display portion using the semiconductor device according to claim 37.

46. A mobile computer that has a display portion using the semiconductor device according to claim 38.

47. An image reproducing device that has a display portion using the semiconductor device according to claim 37.

48. An image reproducing device that has a display portion using the semiconductor device according to claim 38.

49. A goggle type display that has a display portion using the semiconductor device according to claim 37.

50. A goggle type display that has a display portion using the semiconductor device according to claim 38.

51. A video camera that has a display portion using the semiconductor device according to claim 37.

52. A video camera that has a display portion using the semiconductor device according to claim 38.

53. A mobile phone that has a display portion using the semiconductor device according to claim 37.

54. A mobile phone that has a display portion using the semiconductor device according to claim 38.

* * * * *